United States Patent [19]

Bobick

[11] 4,243,987

[45] Jan. 6, 1981

[54] DISPLAY PROCESSOR FOR PRODUCING VIDEO SIGNALS FROM DIGITALLY ENCODED DATA TO CREATE AN ALPHANUMERIC DISPLAY

[75] Inventor: Thomas W. Bobick, Richardson, Tex.

[73] Assignee: Xerox Corporation, Stamford, Conn.

[21] Appl. No.: 919,652

[22] Filed: Jun. 27, 1978

[51] Int. Cl.[3] ..... G06F 3/14

[52] U.S. Cl. ..... 340/799; 340/801; 340/711

[58] Field of Search ..... 340/711, 799, 800, 801, 340/744, 748, 750

[56] References Cited

U.S. PATENT DOCUMENTS

| | | | |
|---|---|---|---|
| 3,849,773 | 11/1974 | Katahira et al. | 340/801 |
| 3,868,672 | 2/1975 | Johnson | 340/711 |
| 3,878,536 | 4/1975 | Gilliam | 340/800 |
| 3,952,296 | 4/1976 | Bates | 340/800 |
| 3,974,493 | 8/1976 | de Cavaignac et al. | 340/711 |
| 4,104,624 | 8/1978 | Hamada | 340/799 |

*Primary Examiner*—Marshall M. Curtis

[57] ABSTRACT

A display processor is disclosed that receives digitally encoded text data and generates video data signals to produce video images of dot matrix alphanumeric characters on a cathode ray tube display in a format that emulates a full page of typewritten copy. The display processor receives ASCII coded character data and digitally encoded text manipulative data and generates horizontal sync, vertical sync and video data in the form of a display scan line dot pattern. The display processor includes a display refresh memory for storing coded text and manipulative data, a character generator including a font memory and video output circuitry. Operation of the display processor is under a set of microcoded instructions outputted from an internal instruction generator in a repeating program sequence, with a random access memory being utilized to store refresh memory read and write addresses and other data required during execution of the program sequence. Scan line dot patterns outputted from the font memory in parallel are converted into serial data in the video output circuitry by ping-ponging two serial shift registers.

6 Claims, 34 Drawing Figures

AR5
AR6
AR7
1176
1178
AR67
AR567
+V
AR0
ARI
AR2
AR3
AR4
AR8
ARIO
ODDP
PROM
VB2
RVS
NINT
VSS
1180
EVC32
NINTS
NDCOUTI (VS)
PAL8
PAL1
PAL2
PAL4
DCOUTD
1156
A
B
C
E
Y0
Y1
Y2
Y3
Y4
Y5
Y6
Y7
OUT 2 (VCE)
NOUT2
NDOUT3
1147
1145
BLINKP
NBLINKP
DCOUT4 (HCC)
NDCOUT5
DCOUT6
NDOUT 7
NSCP
NLLS
NSCP
DINVERTB
HINVERT
C42
1199
INVD

2400
TEXT BUFFER
RAM
2402
ASCII D
TBA0
TBA1
TBA2
TBA3
TBA4
TBA5
TBA6
TBA7
NWRITETB
R00
ASCII 1
ASCII 2
ASCII 3
ASCII 4
ASCII 5
ASCII 6
ASCII 7
NBLINK
NSUB
NSUPER
NINVERTTB
NUNDER
NCONT 1
NCONT 2
NCONT 3
2404
2406
2408
2410
2412
2414
2416
2418
2420
2422
2424
2426
2428
2430
2432
+V
R01
R02
R03
R04
R05
R06
R07
BLINKL
BLINKE
SUBL
SUPERL
INVERTL
UNDERL
CONT1L
CONT2L
CONT3L

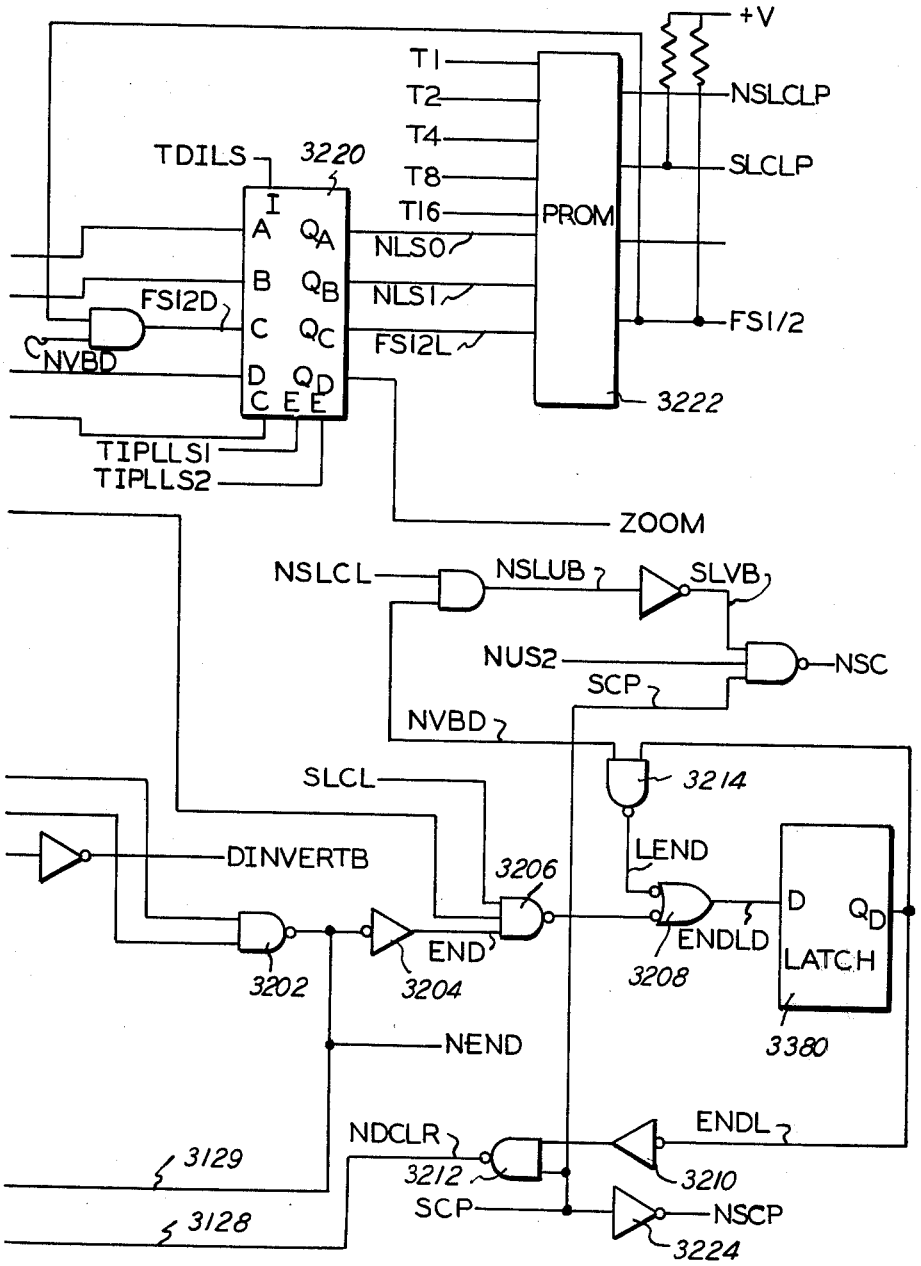
FIG. 26B D REGISTER

DISPLAY PROCESSOR FOR PRODUCING VIDEO SIGNALS FROM DIGITALLY ENCODED DATA TO CREATE AN ALPHANUMERIC DISPLAY

BACKGROUND OF THE INVENTION

The present invention relates to a display processor for producing video signals from digitally encoded data and, more particularly, relates to a display processor for word processing applications wherein video signals are produced to create an alphanumeric display that emulates a full page of typewritten copy.

Computer driven displays are found in a variety of business and scientific areas for information retrieval. Efforts to expand the application of digital technology into new areas have brought the computer driven display into use in many new applications. Most recently, word processor systems utilized for document creation and text editing have become another new application for computer driven displays.

In display based word processor systems, text is digitally encoded and stored to facilitate editing, retrieval and output. A typewriter based editor performs editing operations directly on the storage media and a display emulates the typewritten copy as it will actually appear upon print out. With a display based word processor, a visual representation is produced directly from the storage media, with the image instantaneously reflecting keyboard and editing actions.

Display based word processor systems utilized for document generation and text editing wherein a display provides a full-page alphanumeric display that emulates paper copy have generally utilized a raster scan cathode ray tube (CRT). Although other display technology, such as light emitting diodes and liquid crystal displays, have been proposed, the cathode ray tube has been the dominant display technology.

Emulation of the typewritten page necessitates that the display processor accommodate a variety of character and text line spacings. Also, it is desirable to provide for superscript/subscript and underlining. Features, such as field blinking and screen inversion to focus attention to various areas of the display, are also considered to be of value.

A display based word processor system designed for providing representations of a full page of typewritten copy has as the basic input/output devices a typewriter style keyboard, a CRT display, a printer and a storage media. The keyboard and the image produced by the full-page alphanumeric display serve as the primary interface for operator/machine dialogue.

A display processor is utilized to transform digitally encoded representations of alphanumeric characters into the necessary video drive signals for the CRT display. The display processor receives the digitally encoded representations via a direct memory access bus line. Typically, the text data is encoded in the ASCII format. The drive signals required are the serial video data and horizontal and vertical sync. The alphanumeric characters displayed on the CRT are made up of a dot matrix that is displayed in a series of scan lines, with a defined number of scan lines forming a document text line.

SUMMARY OF THE INVENTION

In accordance with the present invention, a display processor is provided for receiving digitally encoded representations of alphanumeric characters and generating the necessary video signals for displaying a full page of alphanumeric characters. The display processor of the present invention comprises four basic functional elements. These functional elements are a display refresh memory for retaining text character codes and text manipulative codes provided over a direct memory access bus line to the display processor, a character generator that receives text and text manipulative data from the display refresh memory and converts it to a video signal, video output circuitry and microprogrammed timing and control logic to provide the required timing and control signals to sequence the operation of the other elements of the display processor and also provide horizontal and vertical synchronizing pulses to the CRT deflection circuits.

The input data received by the display processor is over a bus line from a direct memory access unit. The input data includes ASCII coded text data and binary coded control data. The timing and control logic coordinates the reception of data input to the display process over the bus. An instruction generator within the timing and control logic outputs a programmed sequence of instructions, including the writing of incoming data and control codes into the display memory. During a display memory instruction, data is read from the memory and decoded to ascertain the character data and the control words. The character code and control words are then transferred to a text line buffer, making the character code and control word available to the character generator.

The character generator receives data from the display memory into a first storage register. While data is stored in the first storage register, a portion of the data is utilized to initiate a vertical adjustment of text characters within a text line on the display to accommodate a subscript or a superscript. Character code data and scan line count are then applied to a font memory that decodes the character code and outputs a dot pattern to be eventually outputted as the video data for display. The parallel bits of data output from the font memory are transferred to the video output circuitry and converted to serial data. The serial data from the video output circuitry is shifted to the video amplifier of the CRT.

The program sequence of instructions produced by the instruction generator repeats every scan line and includes instruction steps to write new data into the display refresh memory and read a character or control word out of the memory. The instruction generator outputs an instruction code for controlling the execution of designated operations within the timing and control logic that comprise a cycle of operation of the display processor. The instruction generator also outputs an address code in conjunction with specified instruction codes for addressing a memory containing refresh memory read and write addresses.

The instruction generator comprises a binary counter that changes state to define specified steps in the program sequence. The counter output code addresses a first read-only memory for producing the instruction code and a second read-only memory for producing the address code.

Character and control words read out of the refresh memory are entered into a high-speed text buffer. Data is written into and read out of the text buffer each time a new character is read out of the refresh memory. The text buffer is addressed to read and write data. The read and write addresses are generated separately and alternately selected for application to the text buffer.

The dot pattern output of the font memory is dependent upon the character code applied as an address and the particular scan line within the text line. The display of characters as a subscript or superscript is accomplished by altering the scan line count that is used in deriving the font memory output. The scan line is altered to present a fictitious count code causing the font memory to output the character dot patterns ahead of or after normal time.

The dot patterns outputted from the font memory provide a scan line-by-scan line representation of the alphanumeric characters to be displayed on the CRT. The dot patterns are outputted from the font memory in parallel and converted to serial data in the video output circuitry. Data bits from the font memory are entered into first and second shift registers to be clocked at the same clock rate but are read out alternately on transitions of the clock that are 180 degrees out of phase to effect a serial data output rate twice that of the clock rate.

BRIEF DESCRIPTION OF THE DRAWING

A more complete appreciation of the invention and many of the attendant features thereof will be readily appreciated as the same becomes better understood by reference to the following detailed description when considered in conjunction with the accompanying drawing wherein.

DESCRIPTION OF THE PREFERRED EMBODIMENT

A. General System Diagram and Functions

Figure 1:
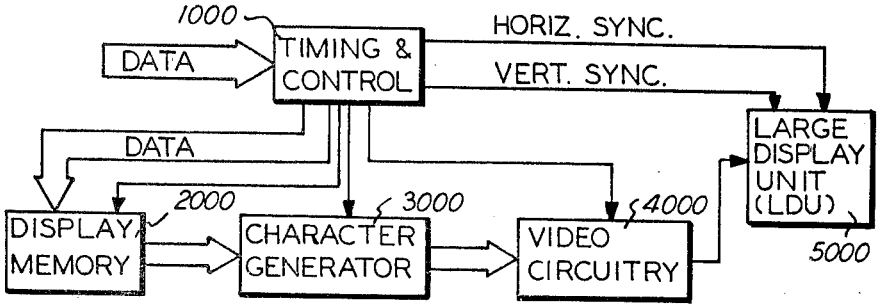
FIG. 1 is a block diagram of the display processor of the present invention.

Referring first to FIG. 1, a display processor providing video data and control signals to drive a raster scan CRT to produce a full-page alphanumeric display is presented in block diagram form. As shown in FIG. 1, the display processor basically comprises four functional blocks. ASCII coded character data and digitally coded text manipulative data enter the display processor and are routed through timing and control logic 1000 to display refresh memory 2000. During a write instruction, the data is stored in memory 2000. Data is read from memory 2000 and provided to character generator 3000 during a read instruction. Character generator 3000 receives the ASCII text and text manipulative data and converts it into dot patterns that are applied to video output circuitry 4000 to drive the cathode ray tube of the Large Display Unit (LDU) 5000.

Timing and control logic 1000 provides the required timing and control signals for the display processor in accordance with a program sequence of instructions generated therein. Timing and control logic 1000 also provides horizontal and vertical synchronizing signals to LDU 5000.

Figure 2:
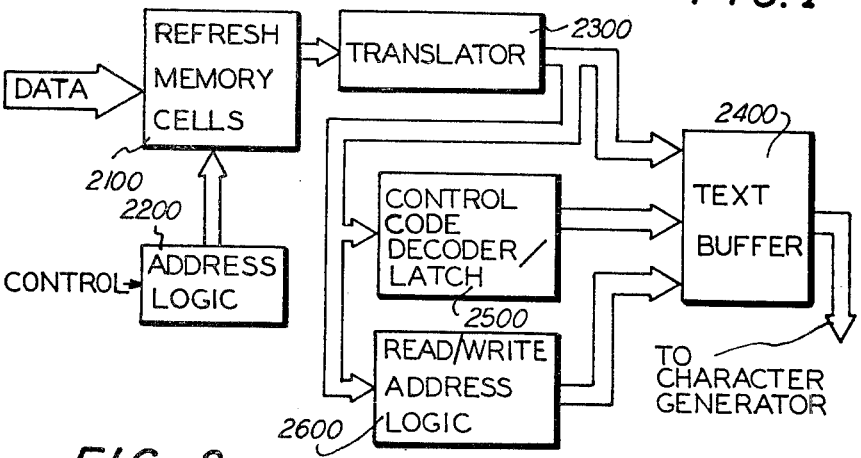
FIG. 2 is a block diagram of the display memory portion of the display processor diagrammed in FIG. 1.

Referring next to FIG. 2, a more detailed block diagram of display refresh memory 2000 is presented. As indicated, incoming data is supplied to a group of memory cells 2100 under control of address logic 2200. The data read out of memory cells 2100 is applied to translator 2300, with the output of translator 2300 being applied to text buffer 2400 along with control signals from control code decoder/latch logic 2500 and read/write address logic 2600.

Figure 3:
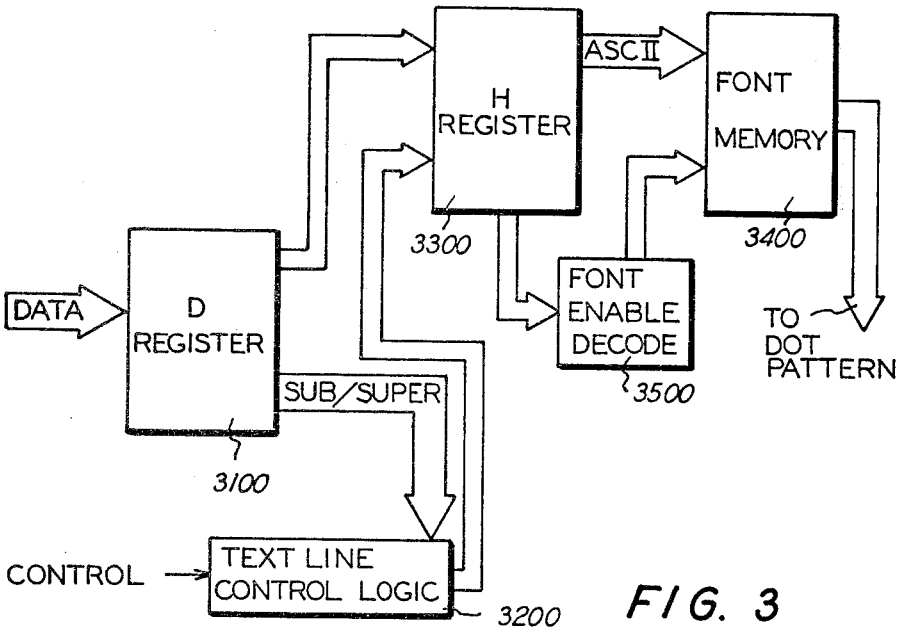
FIG. 3 is a block diagram of the character generator portion of the display processor diagrammed in FIG. 1.

FIG. 3 illustrates in block diagram form the basic elements of character generator 3000. Data from text buffer 2400 of display refresh memory 2000 is brought into character generator 3000 and held in D register 3100. Text manipulative data relating to the indication of a subscript or a superscript is applied to text line control logic 3200 to adjust the vertical positioning of a character within a text line on the screen. Both the output from text line control logic 3200 and the data in D register 3100 are applied to H register 3300. The ASCII coded data is applied directly to font memory 3400 with another portion of the contents of H register 3300 being applied to font enable decode logic 3500 to generate signals utilized in font memory 3400. The output of font memory 3400 is a dot pattern to be displayed on the screen of the CRT of the LDU 5000.

Figures 4, 5:
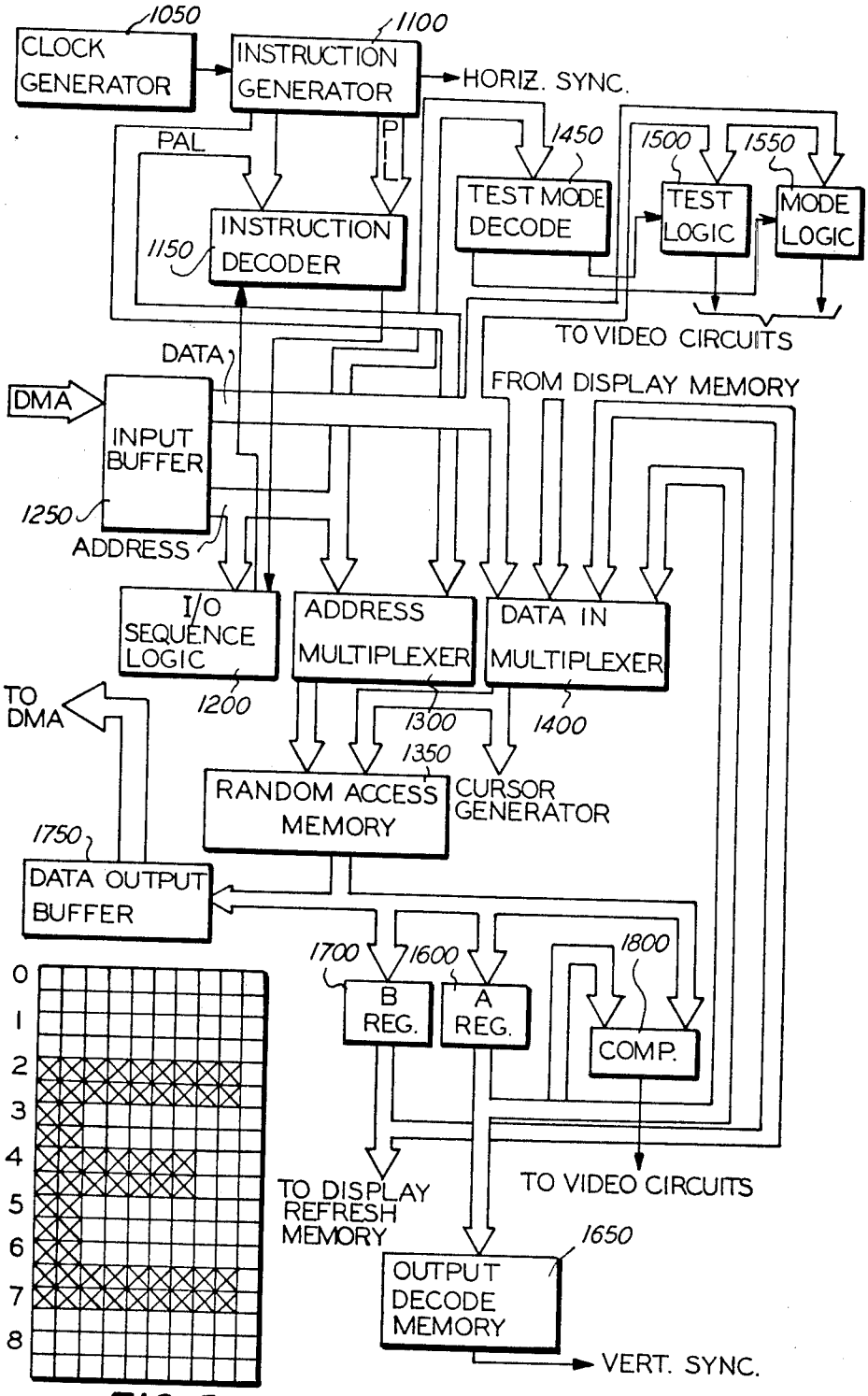
FIG. 4 is a detailed block diagram of the timing and control logic utilized in the display processor diagrammed in FIG. 1.
FIG. 5 is an illustration of a typical dot matrix character displayed on a CRT display applied with video signals from the display process or off the present invention.

FIG. 4 is a detailed block diagram of timing and control logic 1000. Clock generator 1050 generates the display processor "system" clock utilized throughout the display processor. An instruction generator 1100 provides instruction codes PIL and address codes PAL that are applied to instruction decode logic 1150. Input-/output sequence logic 1200 controls the data input to and data output from the display processor.

Data is inputted to the display processor in a series of eight bit bytes of data. The data is brought into and routed through input buffer 1250. Address information input to the display processor, and PAL instructions from instruction generator 1100 are applied to address multiplexer 1300. Address codes for addressing random access memory 1350 to write data in selected locations therein are provided through address multiplexer 1300. Information to be written in random access memory 1350 is obtained through multiplexer 1400. The data that may be entered into random access memory 1350 is available from four sources, including data input from a direct memory access unit.

Codes retained in input buffer 1250 are applied to test/mode decode logic 1450, which operates to enable test logic 1500 and mode logic 1550 to generate signals to be outputted to the video circuitry based upon the code contained in input buffer 1250.

Data read out of random access memory 1350 can be outputted to A register 1600 for communication to output decode logic 1650 for generating the vertical sync signal to be applied to the LDU 5000. Data read out of random access memory 1350 can also be outputted to B register 1700 for addressing the display refresh memory portion of the display processor. In the event that the display processor is to send data to the direct memory access controller, the contents of random access memory 1350 or refresh memory cells 2100 can be routed through data output buffer 1750.

Random access memory (RAM) 1350 in timing control logic 1000 receives and stores data to be used during execution of the program sequence of instructions that directs the cooperative operation of the functional elements of the display processor. The data stored in RAM 1350 includes both "constants" and "variables". RAM 1350 is utilized in conjunction with instruction generator 1100 to provide refresh memory read and write addresses, among other functions.

As shown in FIG. 5, the display processor of the present invention produces character images by composing a character on a scan line-by-scan line basis. For each single spaced text line, there are fourteen interlaced scan lines plus four scan lines that are outputted as background, for a total of eighteen scan lines. Each character is ten bits wide with the last bit of each character on every scan line being undisplayable to provide for spacing between characters.

Figure 6:
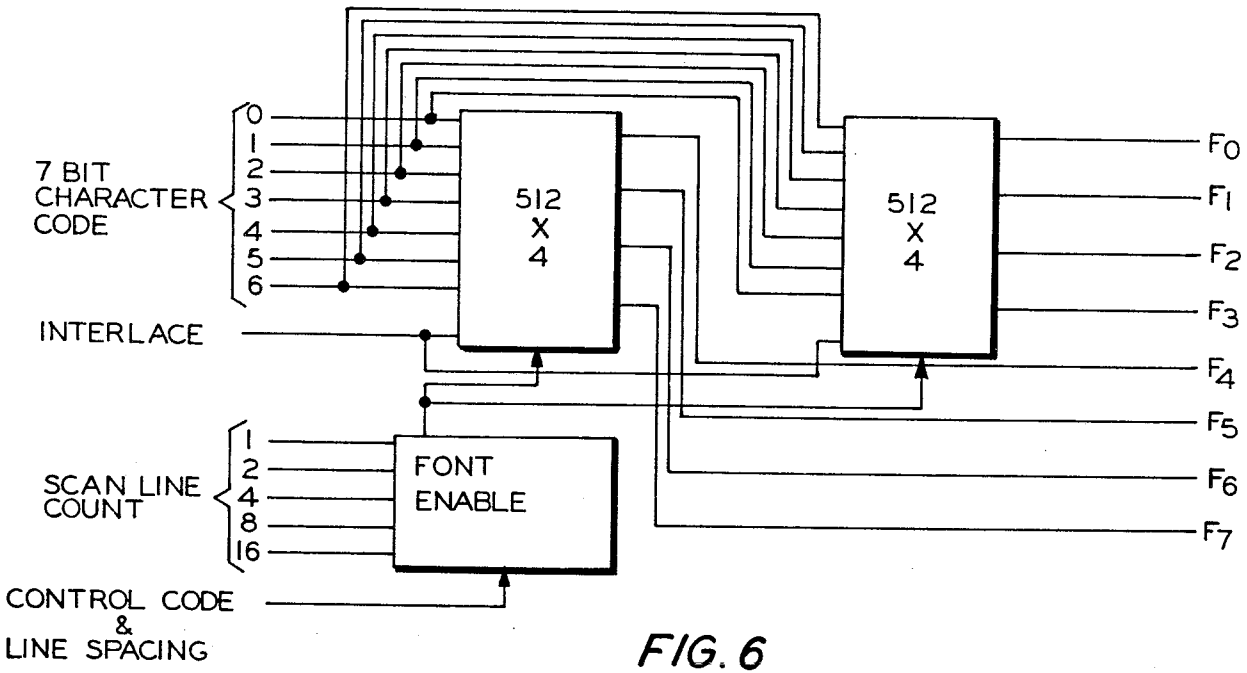
FIG. 6 is a diagrammatic illustration of the organization of the font memory in the character generator portion of the display processor.

To provide the dot patterns necessary for producing a text line of characters on a scan line-by-scan line basis, the font memory must be organized to be in effect addressable by a character code indicative of the character to be reproduced and by a scan line count to designate the particular portion of the characters to be produced during the upcoming scan. FIG. 6 outlines in schematic form the organization of the font memory wherein each memory device contains four bits of video dot data for four scan lines of every character displayed. In the font memory scheme adopted, cooperative pairs of read-only memory devices are enabled for addressing by the character code based upon the particular scan line being traced on the CRT. The read-only memories are four bits wide and 512 words long.

B. Timing and Control Logic

Figure 7:
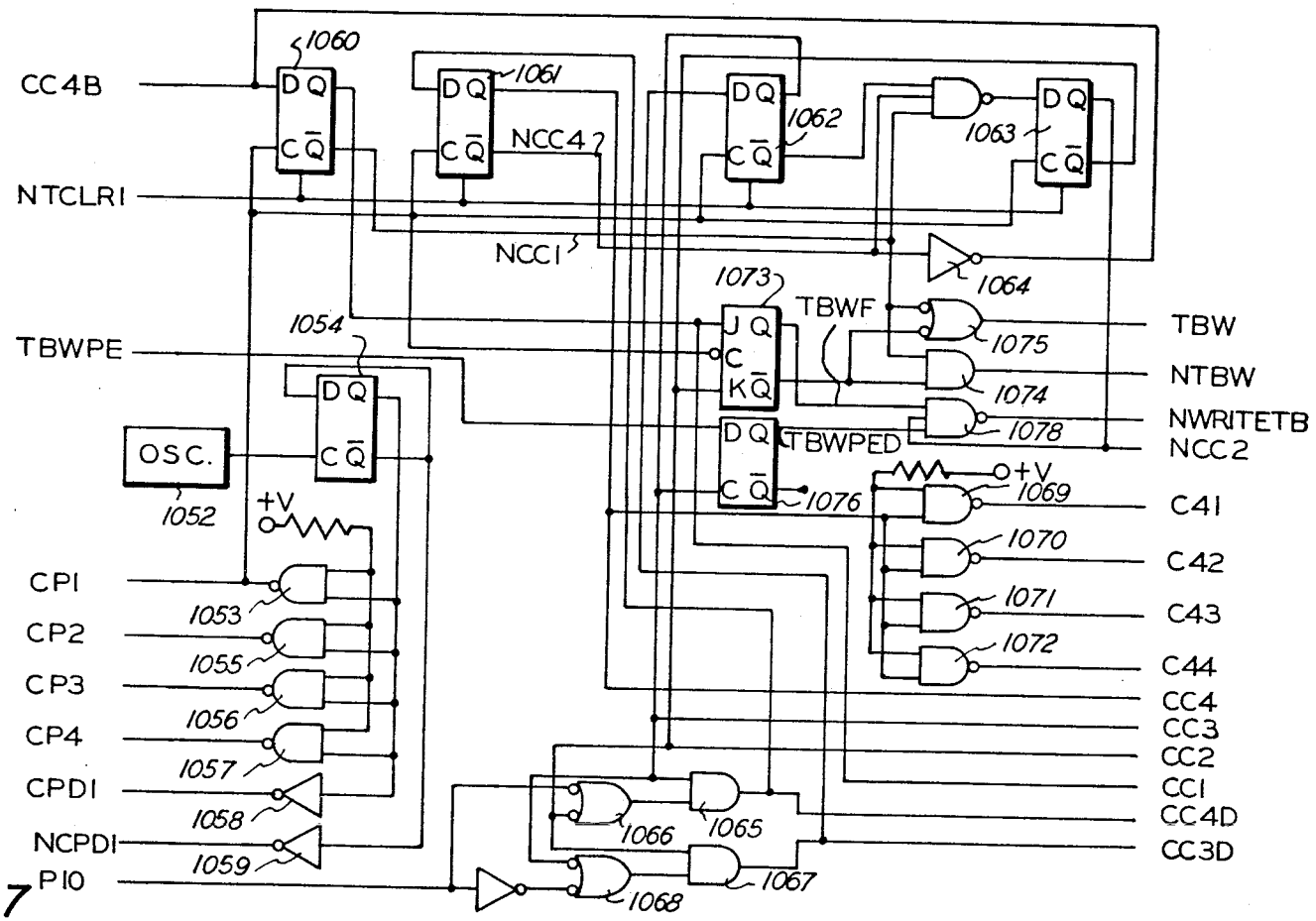
FIGS. 7–18 are schematic diagrams of specific circuitry for implementing the timing and control logic portion of the display processor.

Referring now to FIG. 7, circuitry for implementing clock generator 1050 of timing and control logic 1000 is presented. Clock generator 1050 includes master oscillator 1052 providing a 57.772 MHz clock signal. The clock signal from oscillator 1052 is applied to flip-flop 1054 to divide the master oscillator clock signal in half. Square wave pulses at one-half the master oscillator frequency, but 180 degrees out of phase, are available from the Q and $\overline{Q}$ outputs of flip-flop 1054. Q output of flip-flop 1054 is applied to each of NAND gates 1053, 1055, 1056 and 1057 to generate output clock signals CP1, CP2, CP3 and CP4. The signal available from the Q output of flip-flop 1054 is also applied to inverter 1058 to provide clock signal CPD1. The clock signal available from the $\overline{Q}$ output of flip-flop 1054 is applied to inverter 1059 to provide clock signal NCPD1. Each of the clock signals generated is a square wave clock with a frequency of one-half that of the master oscillator.

The square wave signal CP1 from NAND gate 1053 clocks flip-flops 1060, 1061, 1062 and 1063 in synchronism. The state assumed by each of the flip-flops upon being clocked is determined by their respective control logic circuitry. The state assumed by flip-flop 1060 is determined by the condition of signal CC4B derived from inverter 1064. The $\overline{Q}$ output of flip-flop 1061 is connected to the input of inverter 1064 and supplies the signal NCC4 thereto. The state of flip-flop 1061 is determined by the conditions present on the input of the combination logic comprising AND gate 1065 and OR gate 1066. The CC3 clock input to AND gate 1065 is derived from the Q output of flip-flop 1062. The CC2 input to OR gate 1066 is derived from the $\overline{Q}$ output of flip-flop 1063. The state assumed by flip-flop 1062 is in accordance with the condition of signal CC3D from combination logic comprising AND gate 1067 and OR gate 1068. AND gate 1067 receives the signal CC2 from the $\overline{Q}$ output of flip-flop 1063, and OR gate 1068 receives the logic condition on the Q output of flip-flop 1062.

Flip-flops 1060, 1061, 1062 and 1063, along with the combination logic outlined above that controls the conditions of each of the flip-flop constitutes logic for dividing down the incoming square wave CP1 to a clock that is one-fifth or one-sixth the frequency of CP1. The desired signal is available on the Q output of flip-flop 1061 and is designated CC4. The signal CC4 is applied to NAND gates 1069, 1070, 1071 and 1072 to provide clock signals C41–C44. Clock signal C4 is the basic clock for the display processor. One cycle of the C4 clock signal represents one "character time" and is approximately 173 nanoseconds or approximately 200 nanoseconds.

The clock signal CP1 is also applied to J-K flip-flop 1073. The J input of flip-flop 1073 is connected to the Q output of flip-flop 1060, and the K input receives the signal CC2 from the $\overline{Q}$ output of flip-flop 1063. The $\overline{Q}$ output of flip-flop 1073 is applied as an input to both AND gate 1074 and OR gate 1075. NCC1 available from the $\overline{Q}$ output of flip-flop 1060 is also applied as an input. AND gate 1074 generates the NTBW signal. OR gate 1075 generates the TBW signal. The manner in which these signals are utilized in the display processor will be described more fully hereinafter with regard to the read/write address logic shown in FIG. 22.

The CC3 signal from the Q output of flip-flop 1062 is applied to flip-flop 1076 to store the condition of the TBWPE signal. The Q output of flip-flop 1076 is applied to NAND gate 1078 along with the signal available from the Q output of flip-flop 1073 and the signal NCC2 from the Q output of flip-flop 1063. NAND gate 1078 generates, on the basis of its input condition, the signal NWRITETB. The use of this signal in the display processor will be explained more fully with regard to the writing of data into the text buffer shown in FIG. 23.

Figure 8:
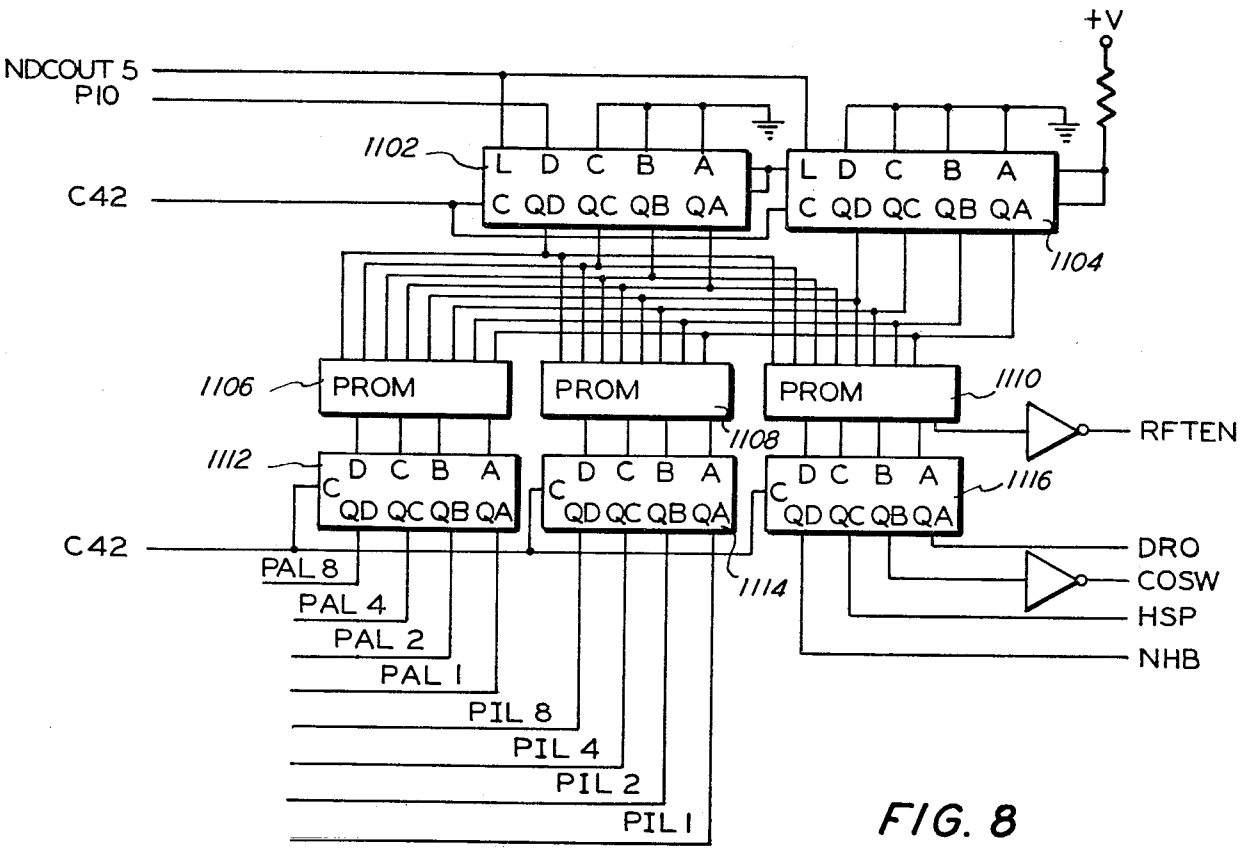

One of the most essential portions of the display processor is instruction generator 1100 shown in FIG. 8. Instruction generator 1100 is basically a microcoded device that generates a set of instructions in a program sequence. The program sequence of instructions is repeated for every scan line and includes one hundred twenty-seven steps. Instruction generator 1100 includes counters 1102 and 1104. These counters are continuously clocked by the C42 clock from gate 1070 in the clock generator circuitry of FIG. 7. The counters are incremented by one count for every C42 clock pulse. The outputs of counters 1102 and 1104 are applied to programmable read-only memories (PROM) 1106, 1108 and 1110. The instruction set is contained within the three PROM's, and the counter output codes representative of a particular state are utilized to address the PROM's to output each instruction step code. Accordingly, with each C42 clock, a new instruction is made available from the three PROM's.

The output lines from PROM 1106 provide a four-bit address code to be referred to as the PAL instructions. The PAL instructions are latched in register 1112 at the occurrence of a C42 clock. The output lines from PROM 1108 provide a four-bit instruction code to be referred to as the PIL instructions. The PIL instruction code is transferred and latched into register 1114 at the occurrence of a C42 clock.

PROM 1110 serves to decode signals that are not part of the instruction codes but are outputted directly as repeating signals for timing purposes. The output of PROM 1110 is loaded into register 1116 at the occurrence of a C42 clock pulse. The signals that are decoded directly from the state of the counter by PROM 1110 are a refresh timing enable signal (RFTEN) and a display memory write signal (COSW). Also, horizontal sync (HSP) and horizontal blank (NHB) are generated and decoded directly by PROM 1110.

Figure 9:
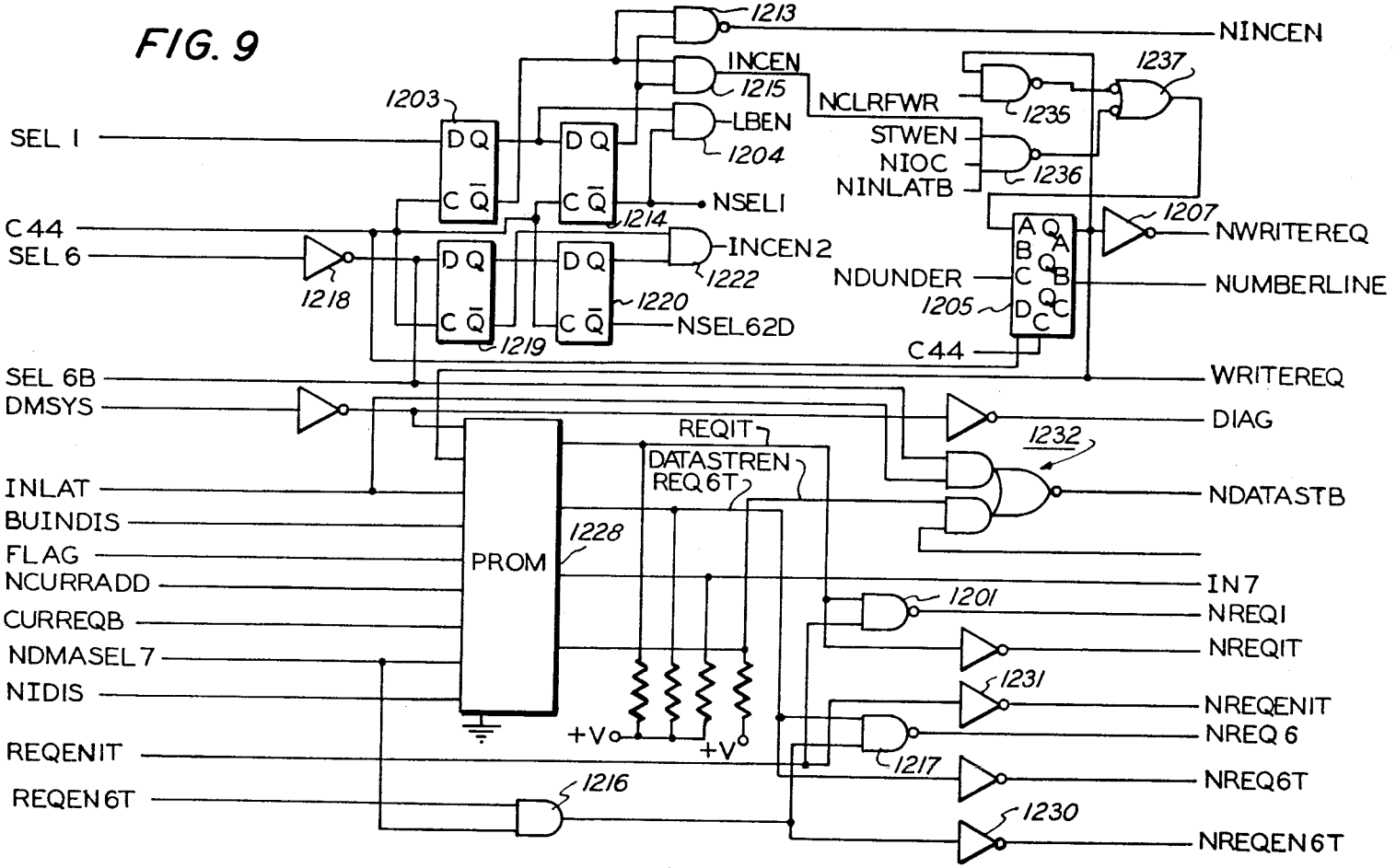
Figure 10A:
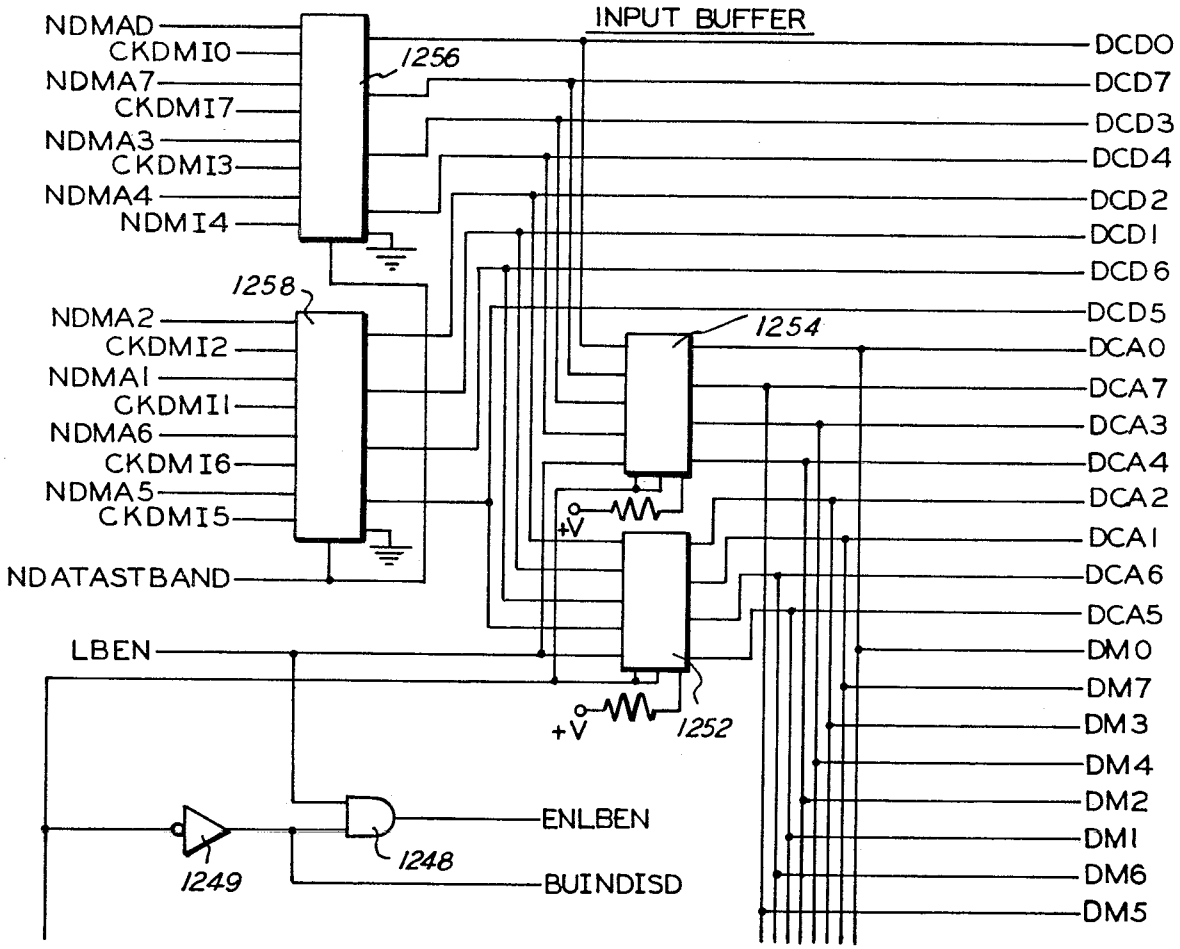
Figure 10B:
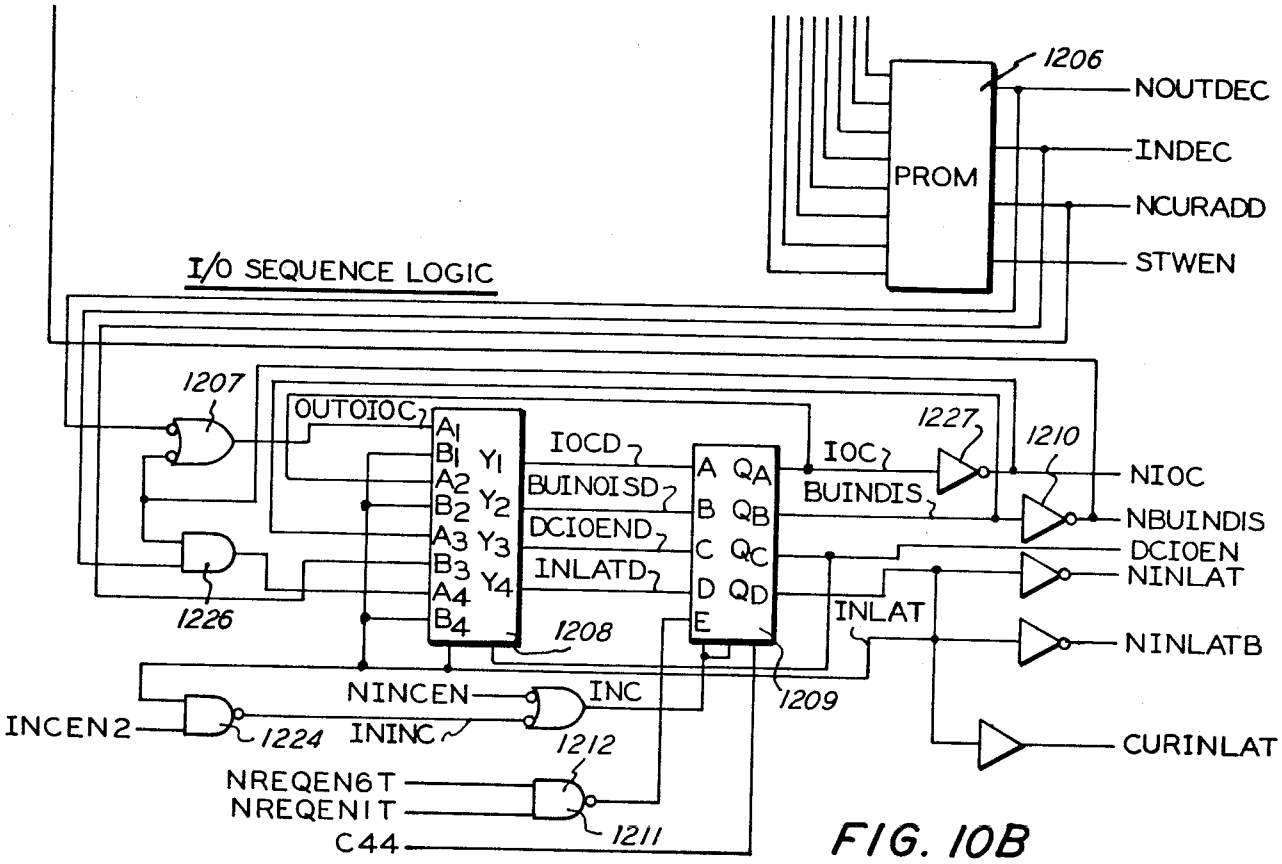
Figure 11A:
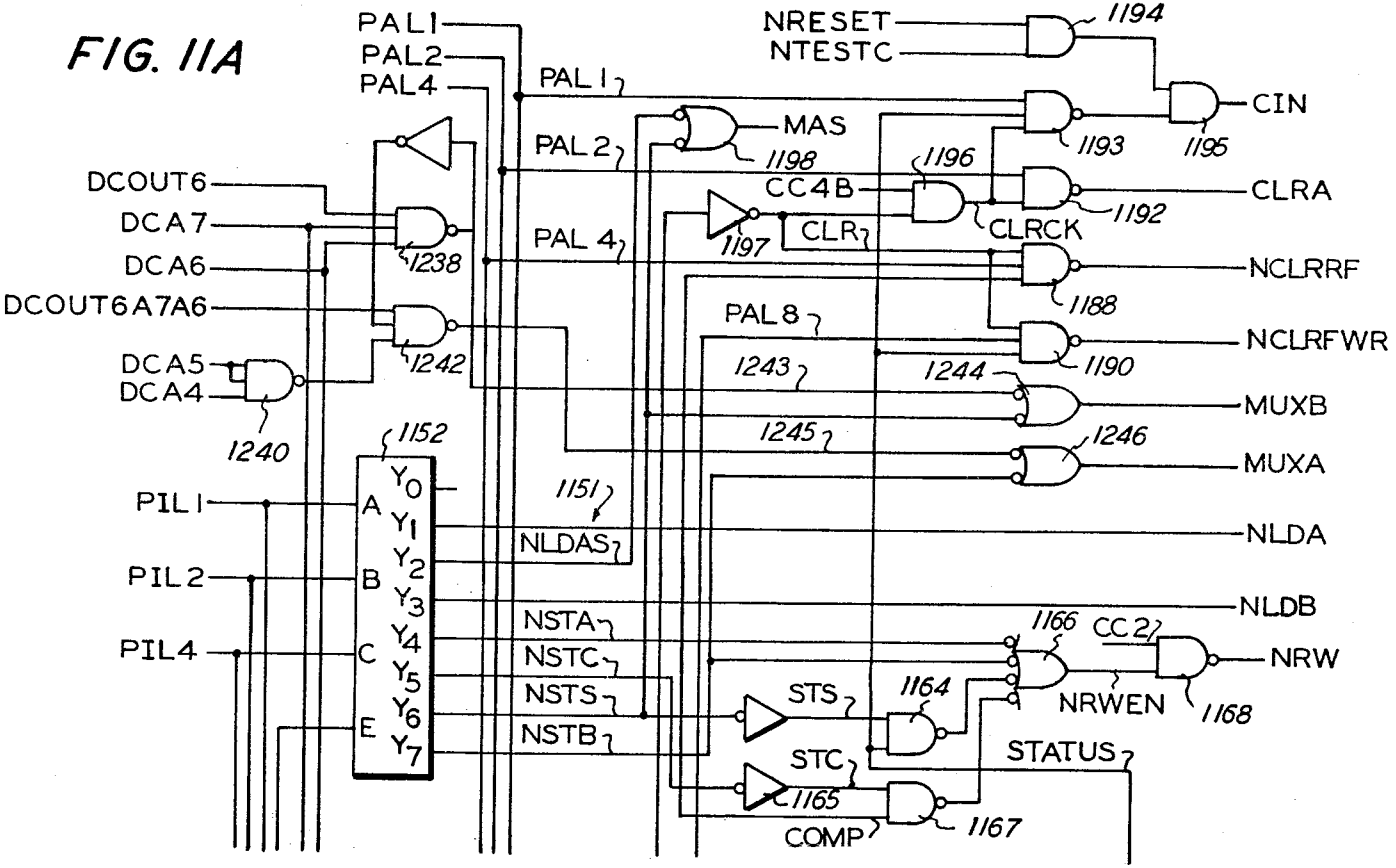
Figure 11B:
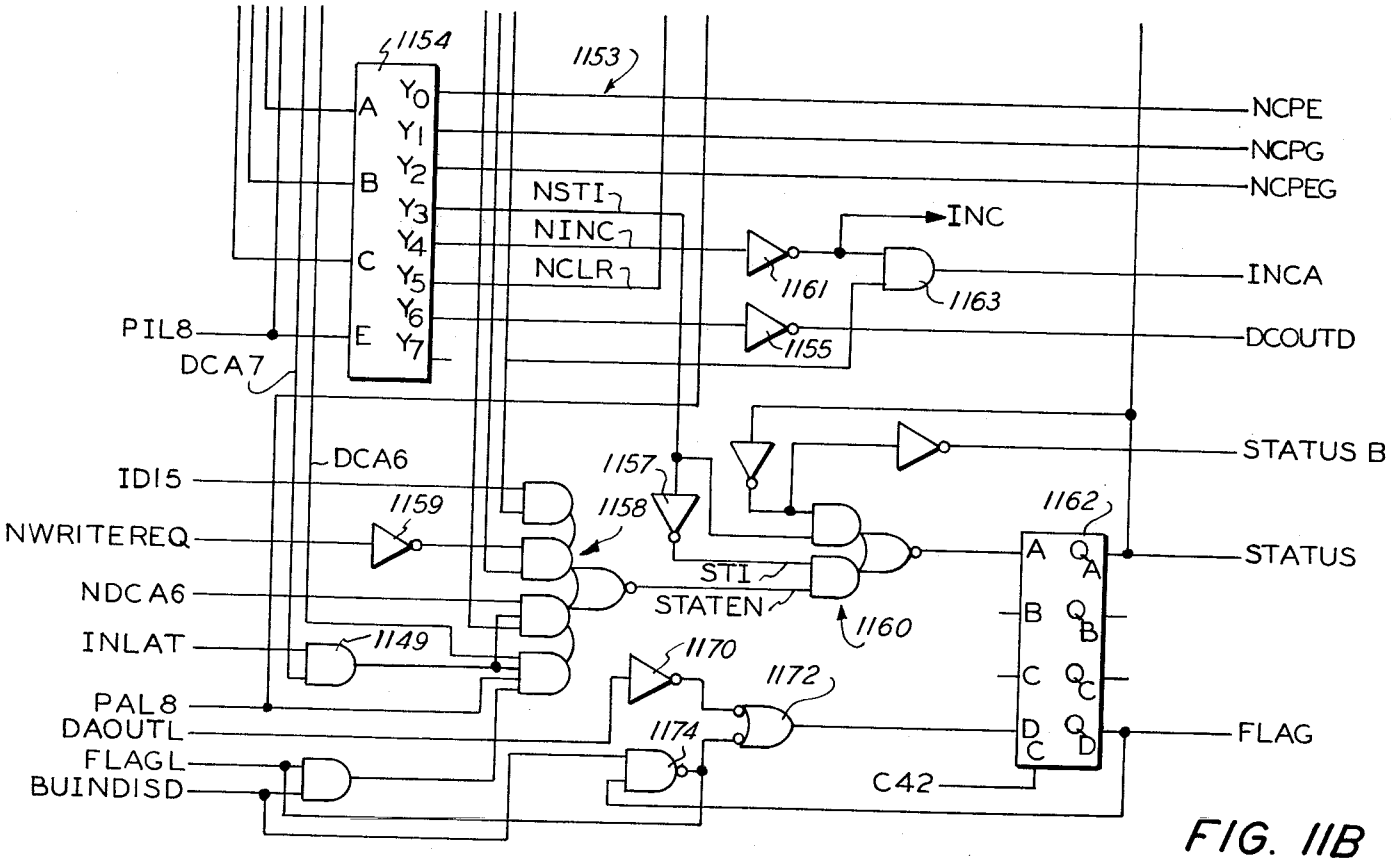

Input/output sequence logic for coordinating direct memory access unit (DMA) input and output sequences to the display processor is shown in FIGS. 9, 10 and 11. Data output by the DMA over a bus is brought into the display processor through transceivers 1256 and 1258 that are connected onto the bus. The output lines of the transceivers are brought directly out as data lines designated DCD0 through DCD7. The transceiver output lines are also connected to input data from the DMA to storage buffers 1252 and 1254. A DMA input or output sequence consists of a series of bytes of data. Buffers 1252 and 1254 under control of the input/output sequence logic are required to retain for processing various informational codes received.

The DMA bus supplies control information and data to several peripherals. The display processor is one such peripheral. Accordingly, the DMA must provide an indication to the display processor that information on the bus is for the display processor. A select line (SEL1) brought into the circuitry, as shown in FIG. 9, is provided for the purpose of providing an indication that data for the display processor is on the DMA bus. The SEL1 output from the DMA is synchronized with the display processor clock C44 by flip-flops 1203 and 1214 for a DMA output sequence. An LBEN signal for clocking input buffer registers 1252 and 1254 is generated by AND 1204 and receives as inputs the Q output of flip-flop 1203 and the $\overline{Q}$ bar output of flip-flop 1214. The output of flip-flops 1203 and 1214 is further decoded by NAND gate 1213 and AND gate 1215 to provide signals utilized in the portion of the input/output sequence logic shown in the lower portion of FIG. 10.

Referring now to FIG. 10, the output lines from input buffer registers 1252 and 1254 are applied to PROM 1206 for decoding of the data input from the DMA. PROM 1206 decodes from the first byte whether a DMA output sequence or a DMA input sequence is being commanded by the DMA. The PROM outputs a signal NOUTDEC for an output sequence and outputs a signal INDEC for an input sequence. These two signals are applied to OR gate 1207 and AND gate 1226, respectively. The output of both gates 1207 and 1226 is routed through multiplexer 1208 to a parallel loading register 1209. The output lines of register 1209 are fed back to be utilized to generate various control signals. The output of inverter 1227 is fed back as a second input to both gates 1207 and 1226 to "seal in" the DMA sequence selection decoded by PROM 1206. The $Q_A$ and $Q_B$ outputs of register 1209 are fed back to be routed through multiplexer 1208 as inputs for register 1209, causing a step sequence of outputs to be generated from register 1209. The $Q_C$ output of register 1209 is fed back as a control input to multiplexer 1208, as is the $Q_D$ output.

Register 1209 is enabled for clocking by C44 clock pulses with a signal generated by OR gate 1212. In a DMA output sequence, an enabling signal is derived by decoding the outputs of flip-flops 1203 and 1214 with NAND gate 1213 and OR gate 1212. In a DMA input sequence, register 1209 is enabled by OR gate 1212 in combination with NAND gate 1224. Inputs to NAND gate 1224 are derived from the $Q_D$ output of register 1209 and from the output of AND gate 1222 in FIG. 9. AND gate 1222 serves to decode the outputs of flip-flops 1219 and 1220.

During a DMA input sequence, in which data is transferred from the display processor to the DMA, the DMA outputs a signal indicating that it is ready to receive data. The select line SEL6 provides the indication. Flip-flop 1219 synchronizes the signals on the SEL6 line with the C44 clock of the display processor. AND gate 1222 decodes essentially the same output conditions of output flops 1219 and 1220 as NAND gate 1213 does of flip-flop 1203 and 1214 outputs.

A detailed explanation of the manner in which the input/output sequence logic 1200 functions to coordinate DMA output and DMA input sequences is presented in section F, which describes the normal operation of the display processor.

Referring now to FIG. 11, a portion of the circuitry for implementing instruction decoder 1150 is shown. The PIL instruction code generated by the instruction generator logic in FIG. 8 is applied to decoders 1152 and 1154. Each one decodes one of eight lines based upon the conditions at the binary select inputs and the enable inputs. Each one of the instruction steps is decoded into a specific operational step as indicated by the existence of a "low" condition on the selected one of the decoder output line groups 1151 and 1153. Various ones of the decoder output lines are routed to combination logic for generating particular instruction command signals upon the existence of prescribed conditions on the decoder output lines as the program sequence of instructions is executed.

Figure 12A:
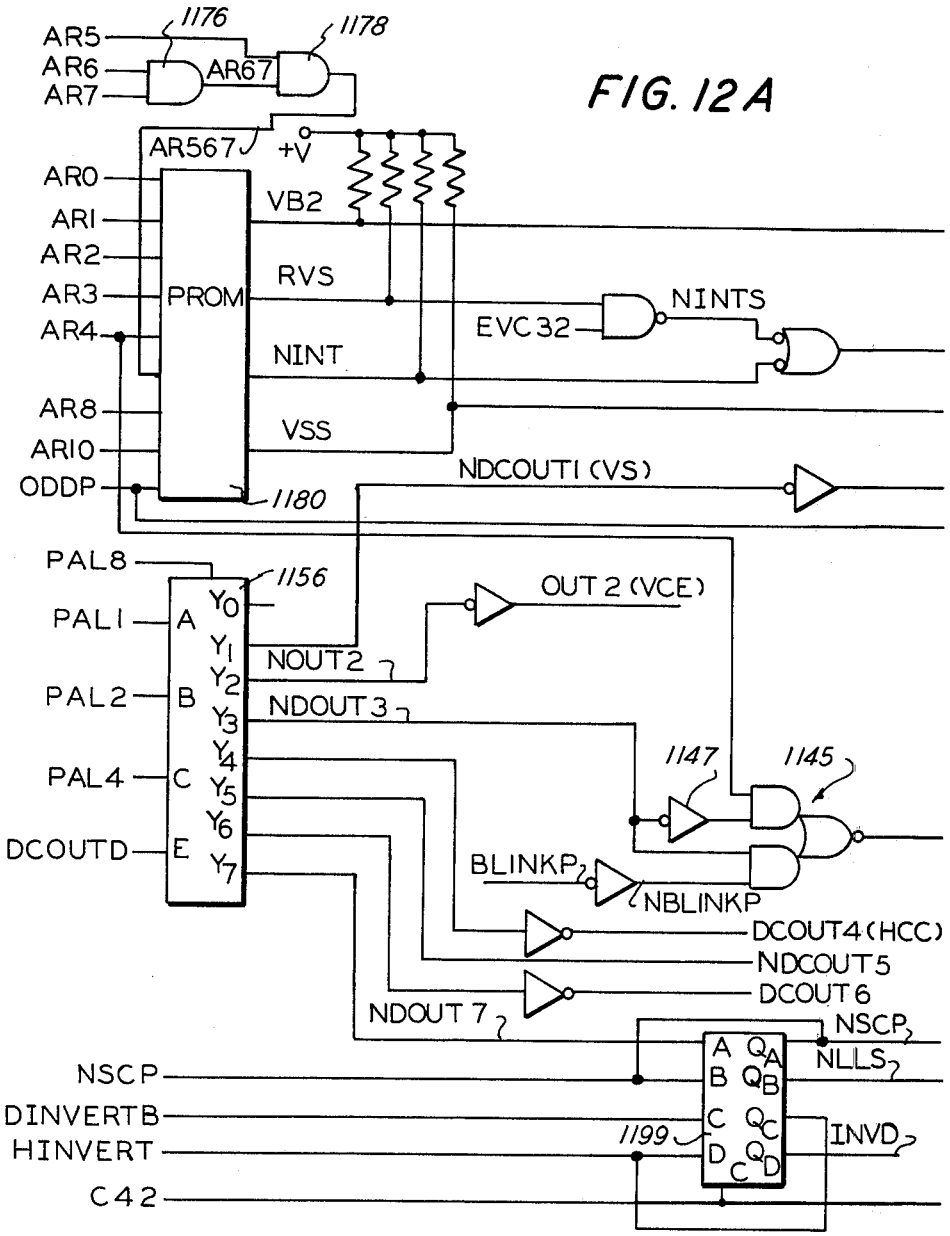
Figure 12B:
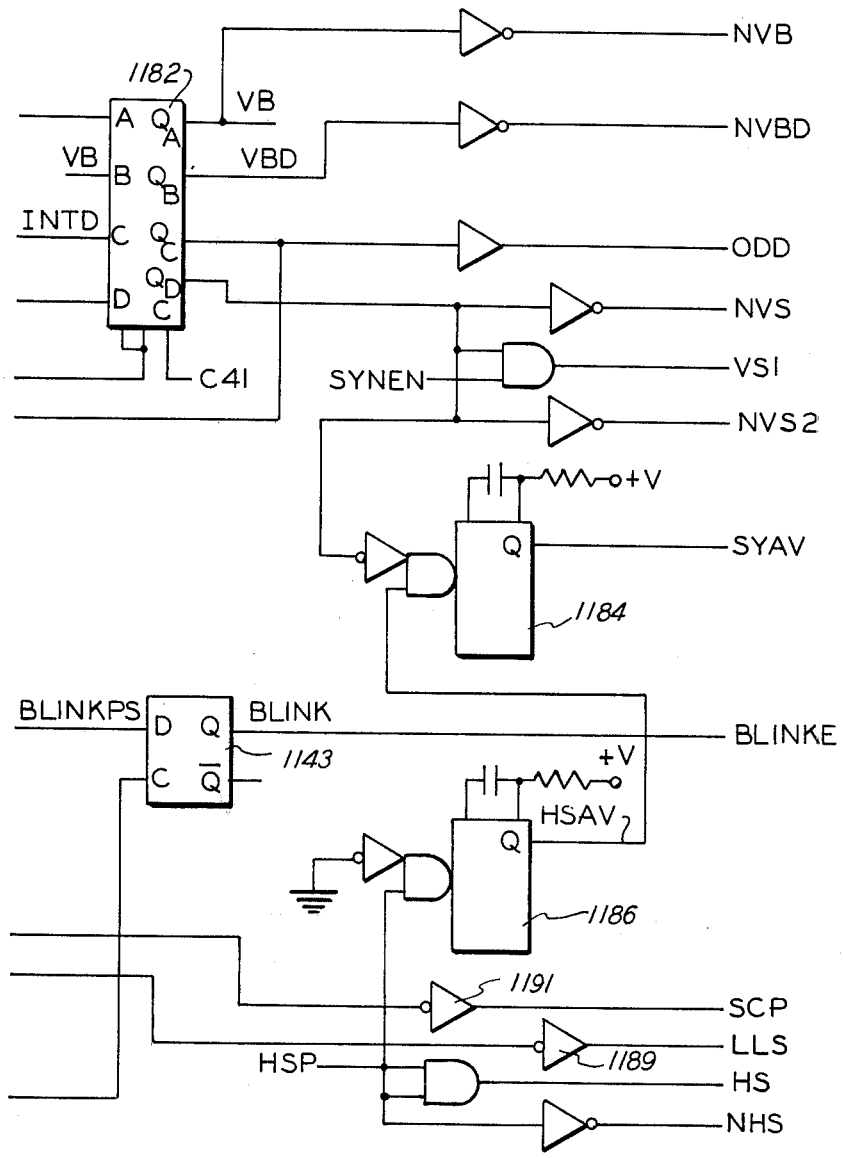

Referring now to FIG. 12, the portion of instruction decoder 1150 that receives the PAL address code portion of the instruction set is shown. Decoding of the address instruction code is performed by one-of-eight decoder 1156. The four bits of PAL instruction code are applied as inputs to decoder 1156. The output lines from decoder 1156 are utilized in carrying out various operational steps defined by the PIL instruction code.

The remainder of the instruction decoder logic shown in FIGS. 11 and 12 is best understood when described in regard to display processor operation under the direction of the program sequence of instructions. Accordingly, a more complete discussion of the instruction decoder logic is presented in Section F.

Figure 13A:
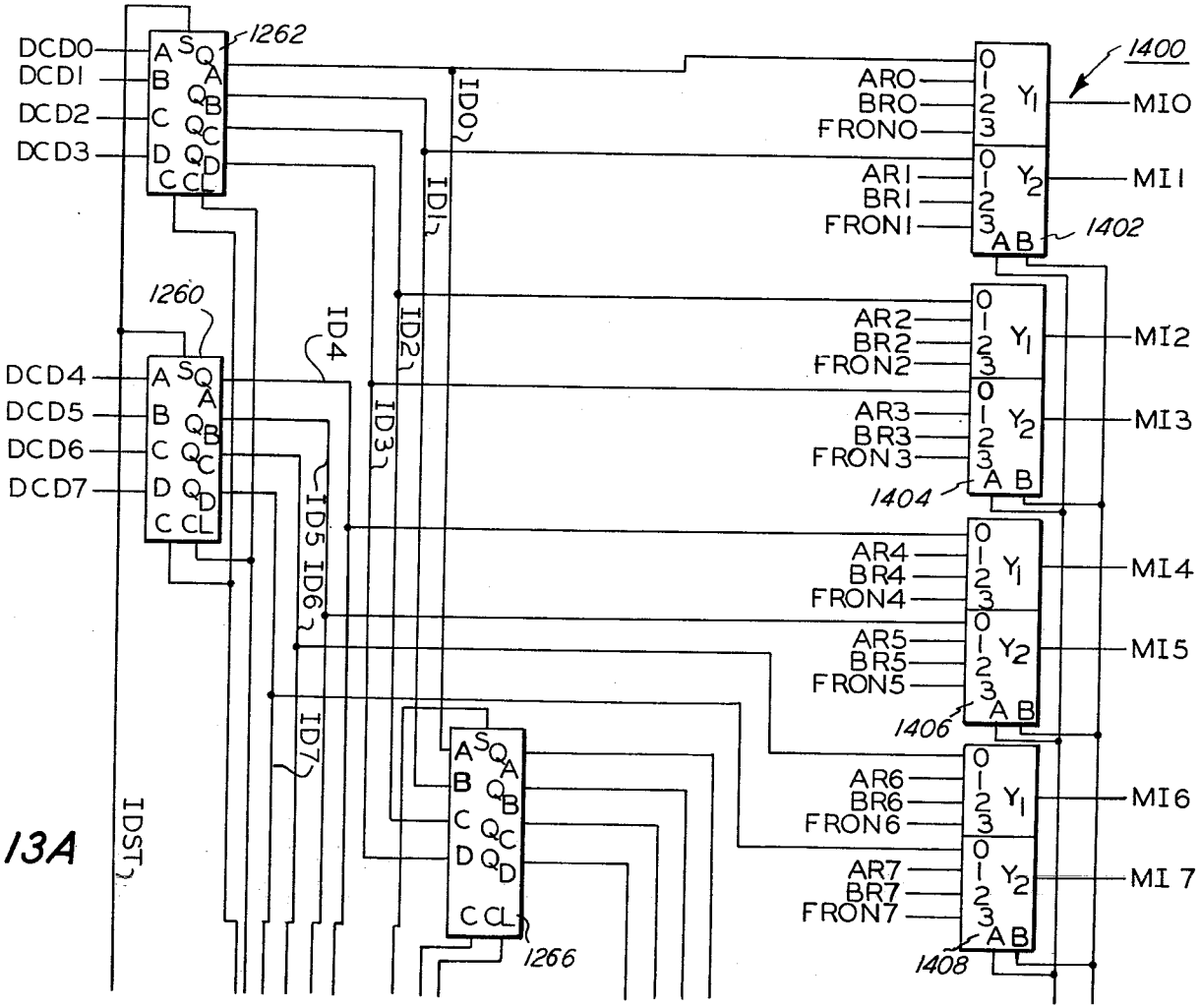
Figure 13B:
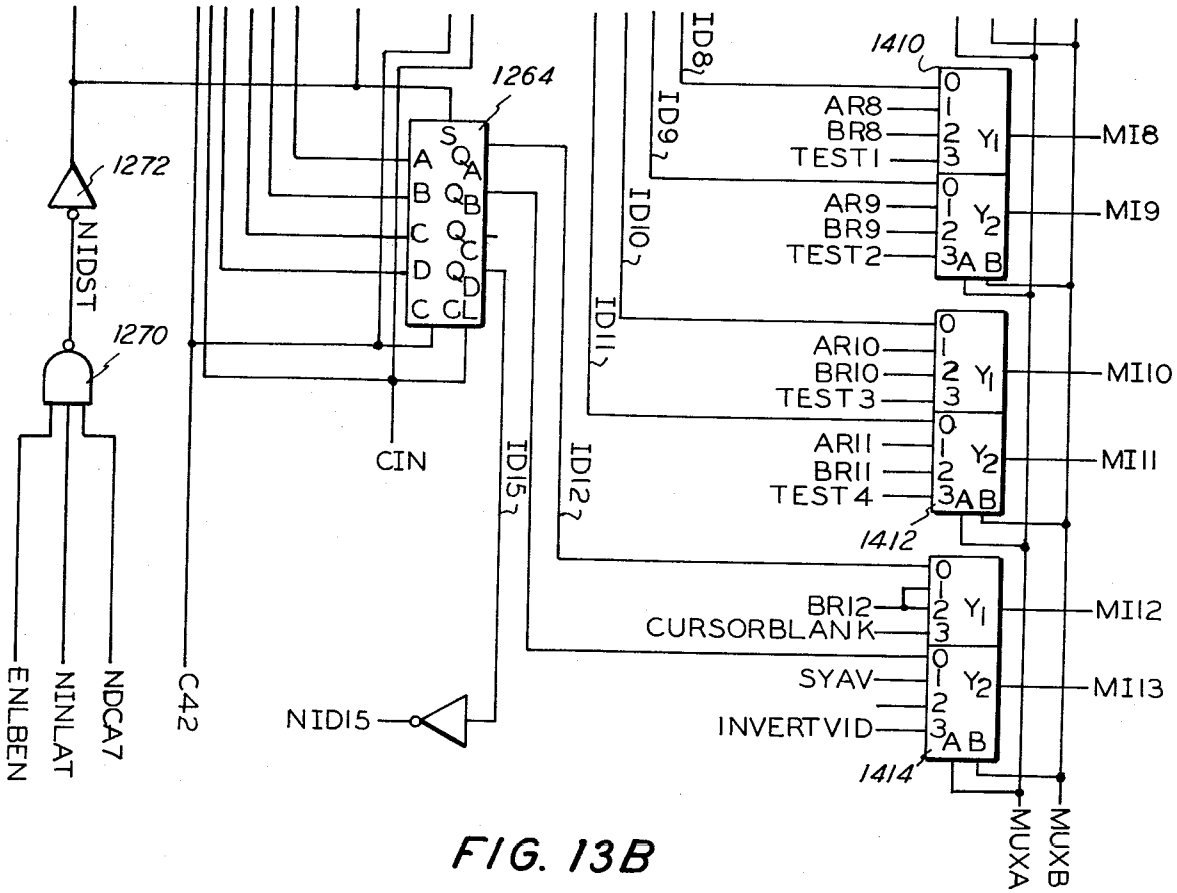

Data words outputted to the display processor from the DMA and stored in registers 1260, 1262, 1264 and 1266 in FIG. 13 provide input data to be stored in RAM 1350. The incoming data to be stored is routed through Data In Multiplexer 1400 also shown in FIG. 13. Multiplexer 1400 comprises data selectors 1402, 1404, 1406, 1408, 1410, 1412 and 1414. Each of these devices is a dual, four-line to one-line data selector. Data selectors 1402 and 1404 receive the four bits of data stored in register 1262, and data selectors 1406 and 1408 receive the four bits of data in register 1260. Data selectors 1410 and 1412 receive the four bits of data in register 1266, and data selector 1414 receives two bits of data that are stored in register 1264.

Multiplexer 1400 also receives as inputs the contents of A register 1600 and the contents of B register 1700. The other input to multiplexer 1400 is eight bits of data from memory cells 2100 of refresh memory 2000. Data selectors 1410 and 1412 receive two bits of data from register 1266, while register 1414 receives two bits of data from register 1264 in addition to indications of cursor blank, sync available, bit twelve of the B register output and a single bit invert video code.

The selected data output by multiplexer 1400 is made available to RAM 1350 over lines MI0 through MI13. Selection of the particular data to be outputted to the RAM is in accordance with the two-bit digital code on the select lines MUXA and MUXB. The contents of the A register is routed through multiplexer 1400 to RAM 1350 if a logic zero is on each of the select lines. The contents of the B register is presented to RAM 1350 if a logic one is on the MUXA line, and a logic zero is on the MUXB line. Data from registers 1260, 1262, 1264 and 1266 is presented to RAM 1350 when a logic zero is on the MUXA line and logic one is on the MUXB line. If a logic one is on both select lines, refresh memory data and test data are outputted to RAM 1350.

Figure 14:
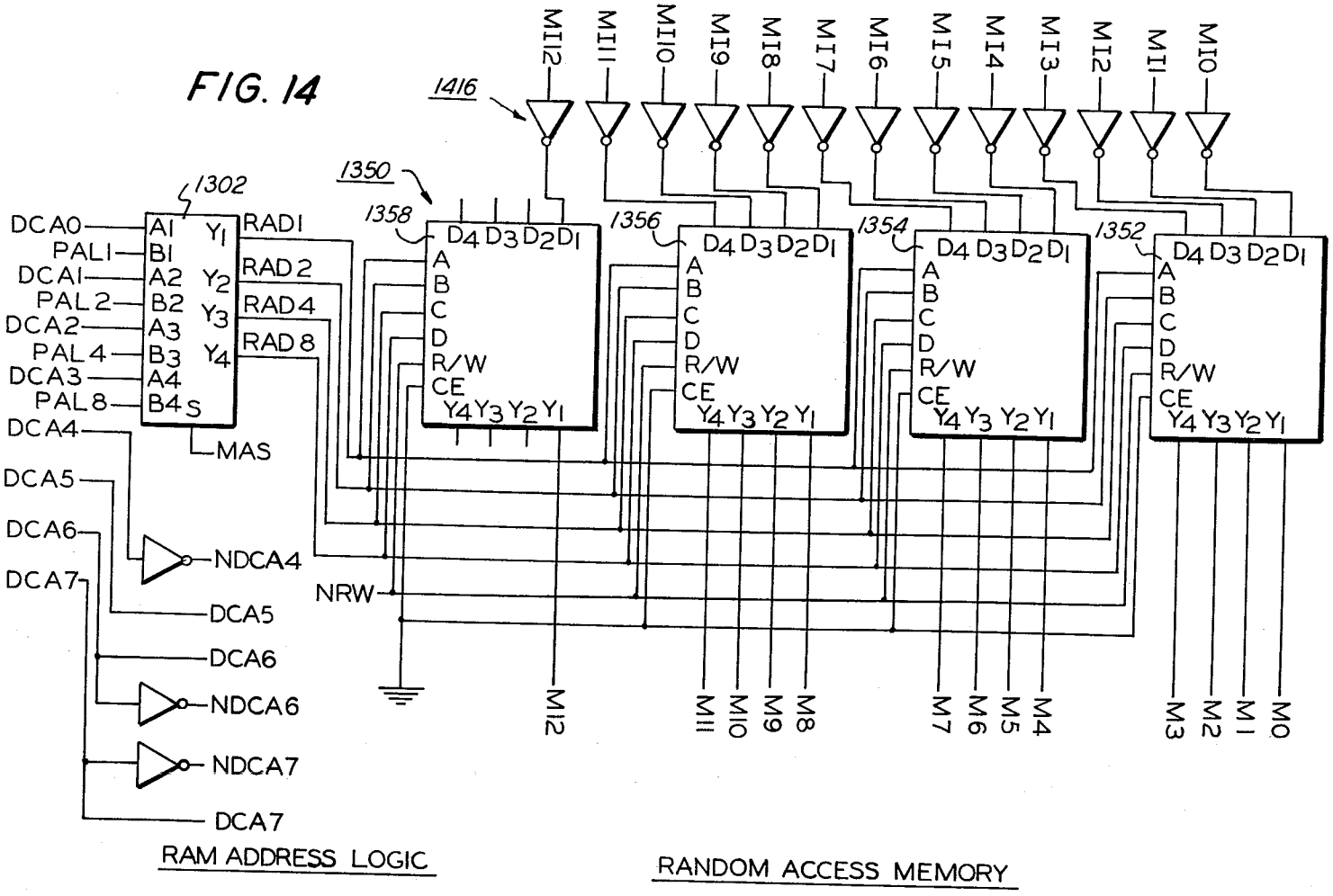

The thirteen bits of information routed through multiplexer 1400 are inverted in inverters 1416 before presentation to RAM 1350, which requires inverted data inputs. The output lines (MI) from multiplexer 1400 are also applied to data output buffer logic 1750 shown in FIG. 18. Referring first, however, to FIG. 14, RAM 1350 is shown as comprising four 64-bit read/write memories 1352, 1354, 1356 and 1358. These memory devices will accommodate sixteen digital words that are each four bits wide. Addressing of each of the memory devices is by a fourbit code selected by address multiplexer 1302 shown in FIG. 14 as a quad, two-line to one-line data selector 1302. Multiplexer 1302 receives as inputs the PAL instruction code and the DCA address code. Read/write memories 1352, 1354, 1356 and 1358 are arranged to provide a digital word that is thirteen bits wide. Digital words outputted from RAM 1350 are made available over lines M0 through M12.

Figure 15:
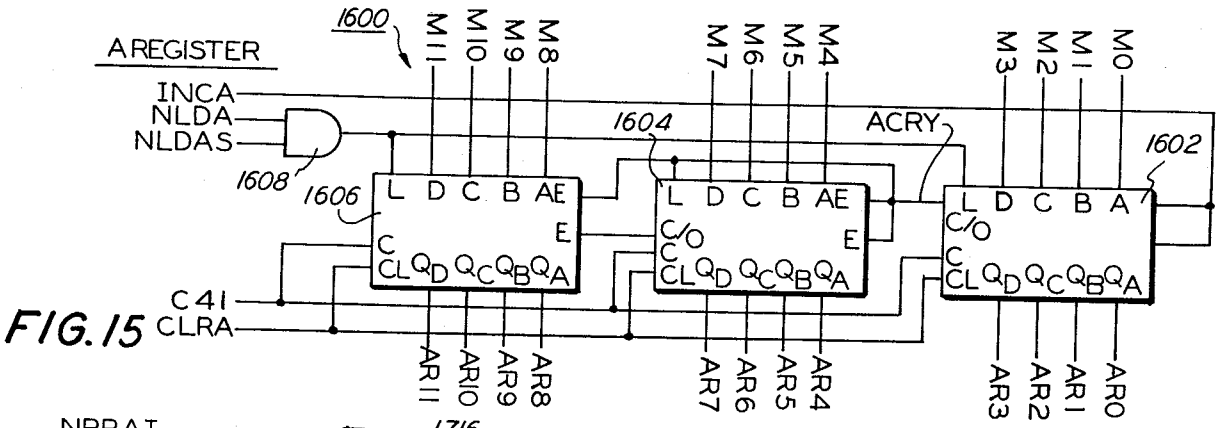
Figure 16:
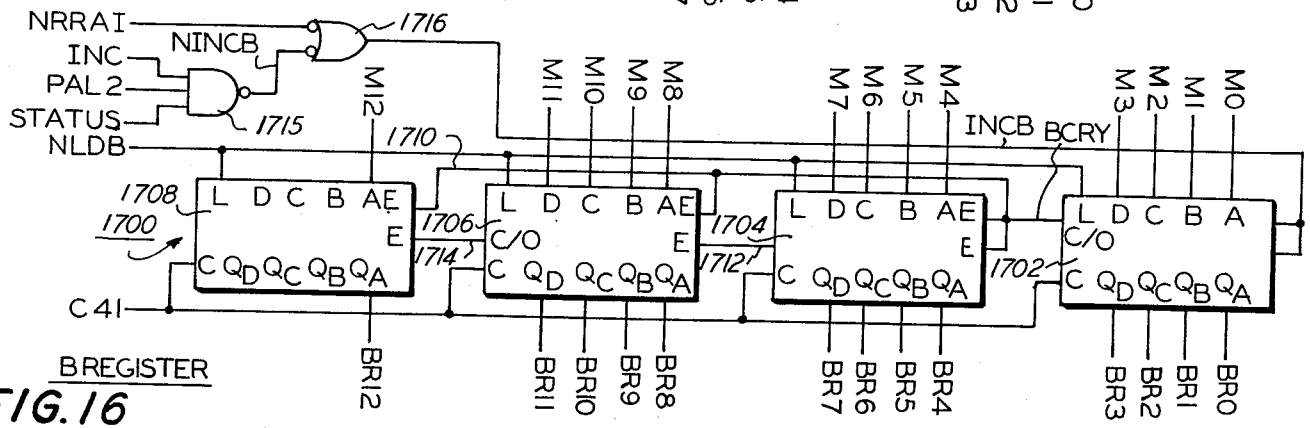
Figures 16A, 17:
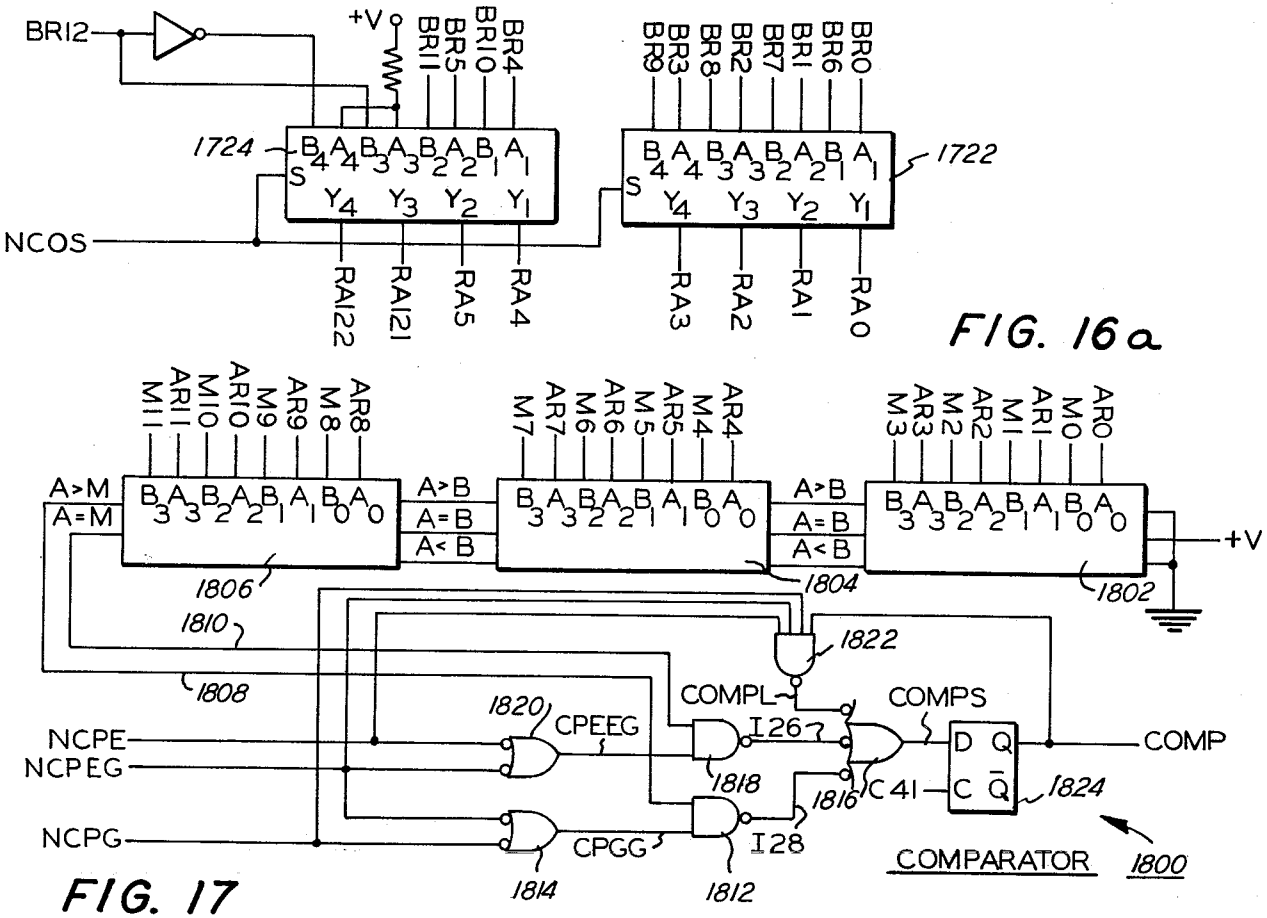

The output lines M0 through M12 from RAM 1350 are connected to the inputs of A register 1600, B register 1700 and comparator logic 1800 shown in FIGS. 15–17.

A register 1600 comprises synchronous four-bit counters 1602, 1604 and 1606. All of the counters are simultaneously clocked by the C41 clock and are simultaneously cleared by the CLRA signal. To control the incrementing of a count contained in the counters of a register 1600, the enable input of counter 1602 receives a signal INCA, with the carry output of counter 1602 being tied to the enable inputs of counters 1604 and 1606. Accordingly, in order to increment A register 1600, the INCA signal goes "high"prior to the receipt of a C41 clock pulse. To load the A register counters from memory devices 1352, 1354 1356 of RAM 1350, the output of AND gate 1608 goes "low" prior to a C41 clock pulse. AND gate 1608 is supplied with both the NLDA and NLDAS signals from the PIL decoder 1152 in FIG. 11.

B register 1700 is built around synchronous four-bit counters 1702, 1704, 1706 and 1708. Counter 1702 receives a signal INCB that enables incrementing of the B register. The INCB signal is applied to the enable inputs of counter 1702. The ripple carry output available from counter 1702 over line 1710 is applied to both enable inputs of counter 1704 and is further applied to one of the enable inputs of counter 1706 and 1708. The ripple carry output of counter 1704 is applied via line 1712 to the other enabling input of counter 1706. In a similar fashion, the ripple carry output of counter 1706 is fed forward via line 1714 to the other enable input of counter 1708. The INCB signal for incrementing the B register is available from OR gate 1716.

Loading of B register 1700 is under the direction of a signal NLDB applied to each of the counters. The digital word output from the memory devices of RAM 1350, and made available to the B register over lines M0 through M12, is loaded into the B register counters when NLDB goes "low" under program instruction. The contents of the B register is made available as a thirteen-bit wide digital word over output lines BR0 through BR12.

Referring to FIG. 16A, the code word output from B register 1700 is over the BR lines and is applied to a multiplexer comprising data selectors 1722 and 1724. The multiplexer alternately selects first and second groups of the B register output code bits in response to the condition on the select line NCOS. As the B register functions to output the refresh memory address, which includes both a row and column address to be separately applied, multiplexing of the B register output code bits is required. The refresh memory address codes are made available over the RA0 through RA5 lines, with the RA121 and RA122 lines being utilized to select between first and second banks of refresh memory cells.

Referring now to FIG. 17, the contents of A register 1600, available over A register output lines AR0 through AR11, and the digital word output from RAM 1350 over lines M0 through M11 are both applied to comparator logic comprising four-bit magnitude comparators 1802, 1804 and 1806. The comparators are cascaded to provide a comparison of the twelve-bit A register code with the twelve bits of RAM output code. Comparator outputs indicative of the comparison made by comparators 1802, 1804 and 1806 are available from comparator 1806 over lines 1808 and 1810. The comparator output lines are applied to combination logic for controlling the generation of a comparison result signal. Output line 1808 is applied to one input of NAND gate 1812. The second input to NAND gate 1812 is from OR gate 1814. The signals NCPEG and NCPG from PIL instruction decoder 1154 in FIG. 11 are applied as inputs to OR gate 1814. The output of NAND gate 1812 is applied to OR gate 1816 as one of the three inputs thereto. The other comparator output line 1810 is applied to NAND gate 1818 as one input. The other input to NAND gate 1818 is from OR gate 1820. The inputs to OR gate 1820 are NCPE and NCPEG that are generated by PIL instruction decoder 1154. The output of NAND gate 1818 is supplied as a second input to OR gate 1816. The third input to OR gate 1816 is from NAND gate 1822. Inputs to NAND gate 1822 are the signals NCPE, NCPEG, and NCPG. The remaining input to NAND gate 1822 is a signal from the Q output of flip-flop 1824. Flip-flop 1824 receives the output of OR gate 1816 and is caught by the C41 clock. The Q output of flip-flop 1824 provides the comparison result signal COMP.

The comparator output line 1808 is "high" if the number in A register 1600 is greater than the number outputted from RAM 1350. Comparator output line 1810 is "high" if the number in A register 1600 equals the number outputted by RAM 1350. A "low" condition on the NCPE line checks for the existence of an "equals" condition, and a "low" condition on the NCPG line checks for a "greater than" condition. A "low" condition on NCPEG enables either an "equals" or "greater than" condition to set the COMP indication.

Figure 18:
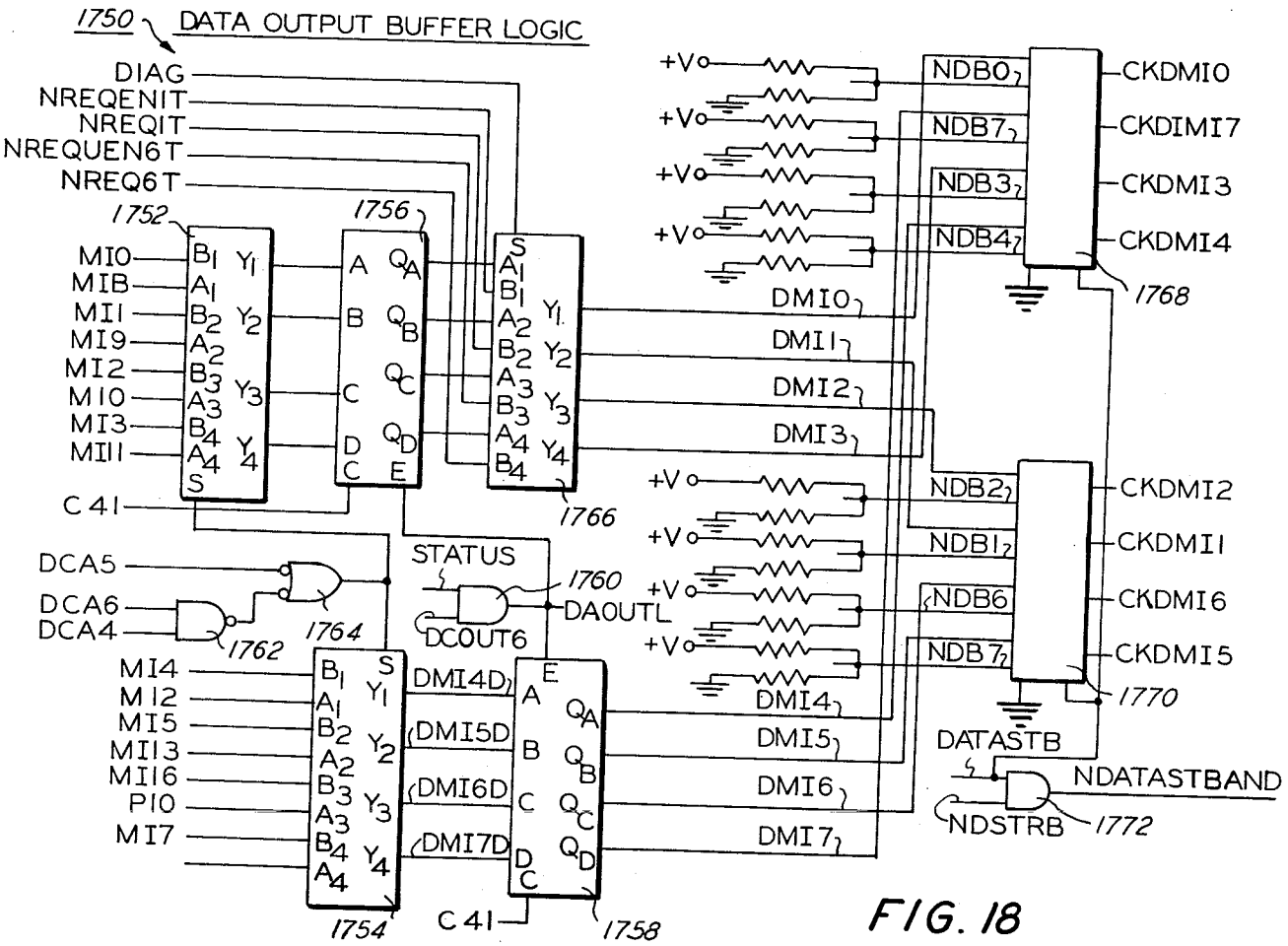

In FIG. 18 circuitry for data output buffer logic 1750 is shown. Data output buffer 1750 is connected to the output lines of multiplexer 1400 and receives data routed therethrough and outputted over lines DMI0–DMI7. The data available from multiplexer 1400 is itself multiplexed through data selectors 1752 and 1754. The selected data output by data selector 1752 is stored in register 1756, and the data output by data selector 1754 is stored in register 1758. The data is stored in registers 1756 and 1758 at the occurrence of a C41 clock pulse following enabling of the registers by a data out signal (DAOUTL) generated by AND gate 1760. The DAOUTL signal is issued from AND gate 1760 when an instruction in the program sequence is reached that executes an input status check resulting in the setting of STATUS, followed by an instruction to output a data output buffer strobe signal (DCOUT6). Both STATUS and DCOUT6 are generated in the instruction decode logic in FIGS. 11 and 12. Selection of the particular data bits to be stored in latches 1756 and 1758 is made by the condition of the DCA4, DCA6 and DCA5 bits of the address code received as the second byte of data in a DMA input sequence, as decoded by NAND gate 1762 and OR gate 1764.

The four bits of data stored in register 1756 are routed through data multiplexer 1766. The four bits of data made available from multiplexer 1766 and the four bits of data stored in register 1758 are applied as one set of inputs to data selectors 1768 and 1770. The second set of inputs to data selector 1766 contains the four bits of DMA output request and request enable, and DMA input request and request enable. The second set of inputs to data selectors 1768 and 1770 are over lines NDB0–NDB7.

The eight-bit word output from data selector 1768 and 1770 is applied as an alternate input word to input buffer 1250. The eight-bit data byte from data output buffer logic 1750 is applied to transceivers 1256 and 1258, with the transmit/receive control being provided by the signal NDATASTBAND that is applied to both transceivers 1256 and 1258.

This transmit/receive signal is generated by AND gate 1772 in FIG. 18. The NDATASTB signal that is applied as an input to AND gate 1772, and as a selector signal to data selectors 1768 and 1770, is obtained from AND/OR logic 1232 in FIG. 9. The second input signal to AND gate 1772 is NDSTRB, a strobe signal.

Figure 19:
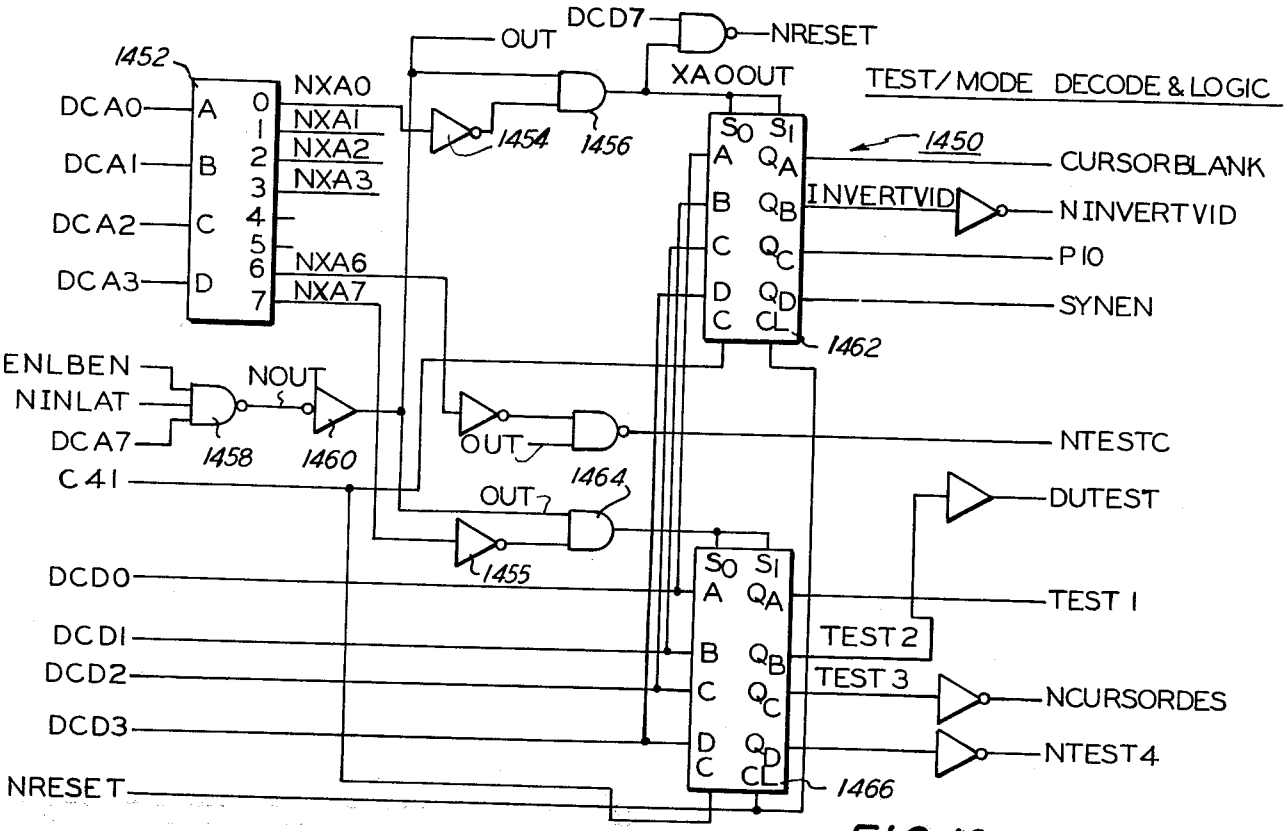
FIGS. 19–25 are schematic diagrams of specific circuitry for implementing the display memory portion of the display processor.
Figure 20:
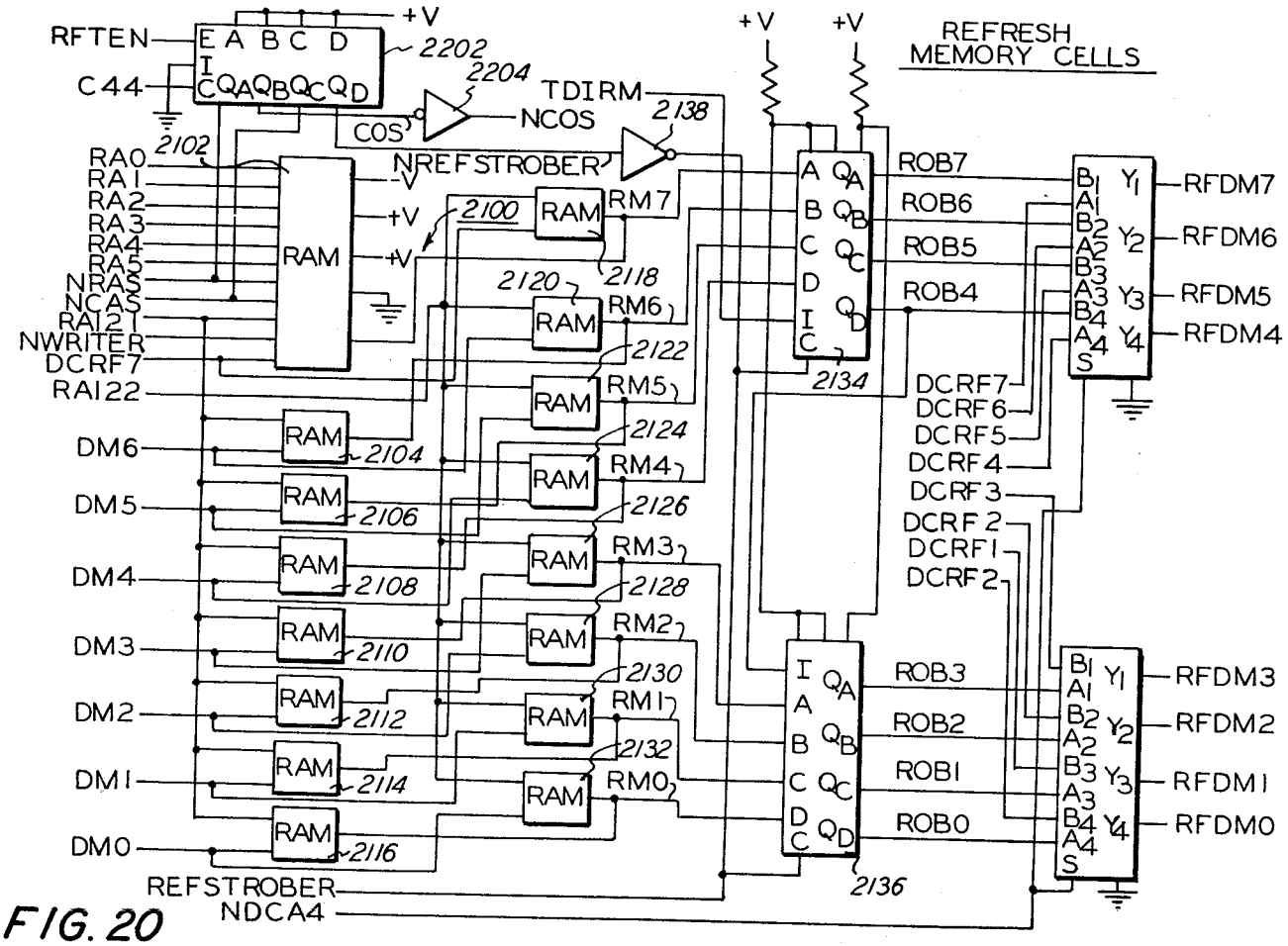

The circuitry shown in FIG. 19 is that for the test-/mode decoder 1450, the test logic 1500 and mode logic 1550. Test/mode decoder 1450 is implemented by a BCD-to-decimal decoder 1452. Four bits of the address byte stored in registers 1252 and 1254 of the input buffer are applied as an input code to decoder 1452. The four address bits DCA0 through DCA3 define whether mode data or test data is to be received over the data lines DCD0 through DCD3. Decoder 1452 outputs a mode enable signal to inverter 1454 if a mode data code is detected, or decoder 1452 ouputs a test enable signal to inverter 1455 if test data code is detected.

The output of inverter 1454 is applied to AND gate 1456 and combines with a signal derived from NAND gate 1458 and inverter 1460. Upon the proper conditions existing at the inputs of AND gate 1456, an enabling signal to register 1462 is generated that allows that device to enter the data on lines DCD0 through DCD3 at the occurrence of a C41 clock pulse. The data stored in mode latch 1462 provides information to set up the entire CRT screen for display.

The output of inverter 1455 is applied to AND gate 1464 and combines with a signal available from the output of inverter 1460 to enable test latch 1466 to store away the four bits of data on lines DCD0 through DCD3.

C. Display Refresh Memory Logic

Referring now to FIGS. 20–25, circuitry for implementing the display refresh memory 2000 portion of the display processor is presented. Addressing for the refresh memory cells is controlled by a four-bit shift register 2202 that receives a memory enable signal RFTEN from instruction generator 1100 and is clocked by the C44 clock. Shift register 2202 provides four outputs designated NCAS, COS, NRAS and NREFSTROBER.

The actual memory cell portion of refresh memory 2000 comprises sixteen 4K random access memories 2102 through 2132. Only RAM 2102 is shown in full detail. RAM's 2104 through 2132 are identical to RAM 2102. Each RAM receives an address over lines RA0 through RA5 from data selector 1722 and 1724 in FIG. 16A. Data selectors 1722 and 1724 route the address bits from B register 1700 to the memory cells. The NRAS signal from shift register 2202 provides a strobe signal for entering the row address, and the signal NCAS provides a strobe signal for entering the column address. Signals RA121 and RA122 are memory cell enable signals to enable entry of the data present on line DM0 through DM7 into either the bank of memory cells comprised of RAM's 2102 through 2116 or the bank of memory cells comprised of RAM's 2118 through 2132. The signal NWRITER provides the read/write control signal for setting up the enabled RAM's for the writing of data available on the DM lines or for reading data and over the RM lines.

Data read out of refresh memory cells 2100 are brought out over lines RM0 through RM7. These lines are connected to refresh memory registers 2134 and 2136. The eight-bit word read out of the refresh memory is entered in registers 2134 and 2136 at the occurrence of a strobe pulse (REFSTROBER) provided from the output of inverter 2138. REFSTROBER is generated from shift register 2202.

Figure 21:
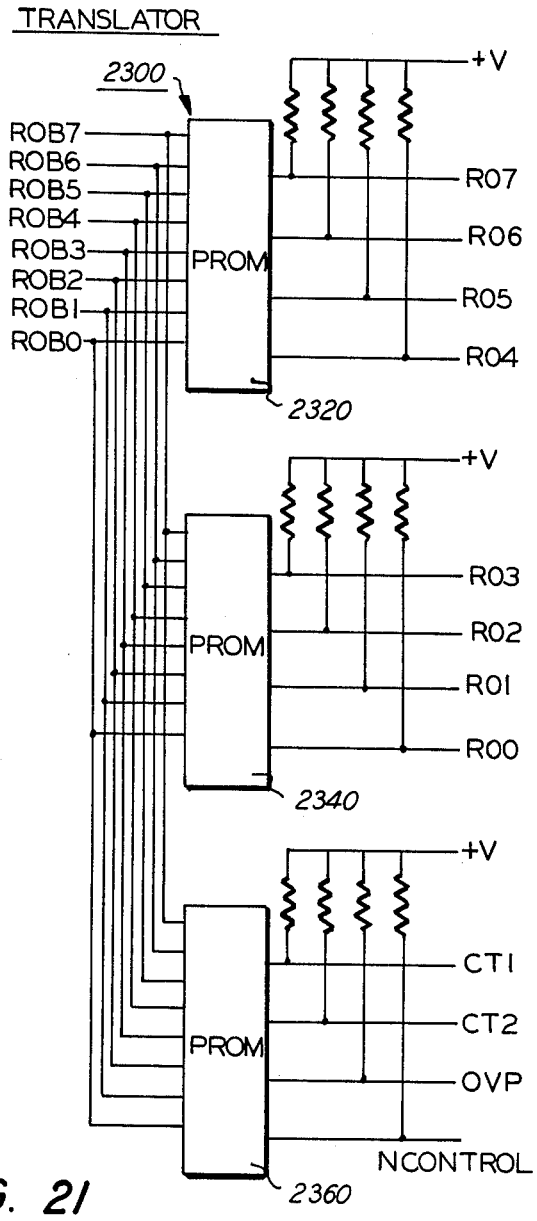

The eight bits of data stored in memory register 2134 and 2136 are applied to translator 2300 in FIG. 21 over lines ROB0 through ROB7. Translator 2300 comprises programmable readonly memories 2320, 2340 and 2360. PROM's 2320 and 2340 translate the code available over the ROM lines from the refresh memory cells into an eight-bit code that is outputted over lines RO0 through RO7. PROM 2360 translates the code available over the ROB lines and converts it into four bits of control code data designated CT1, CT2, OVP and NCONTROL.

Figure 22:
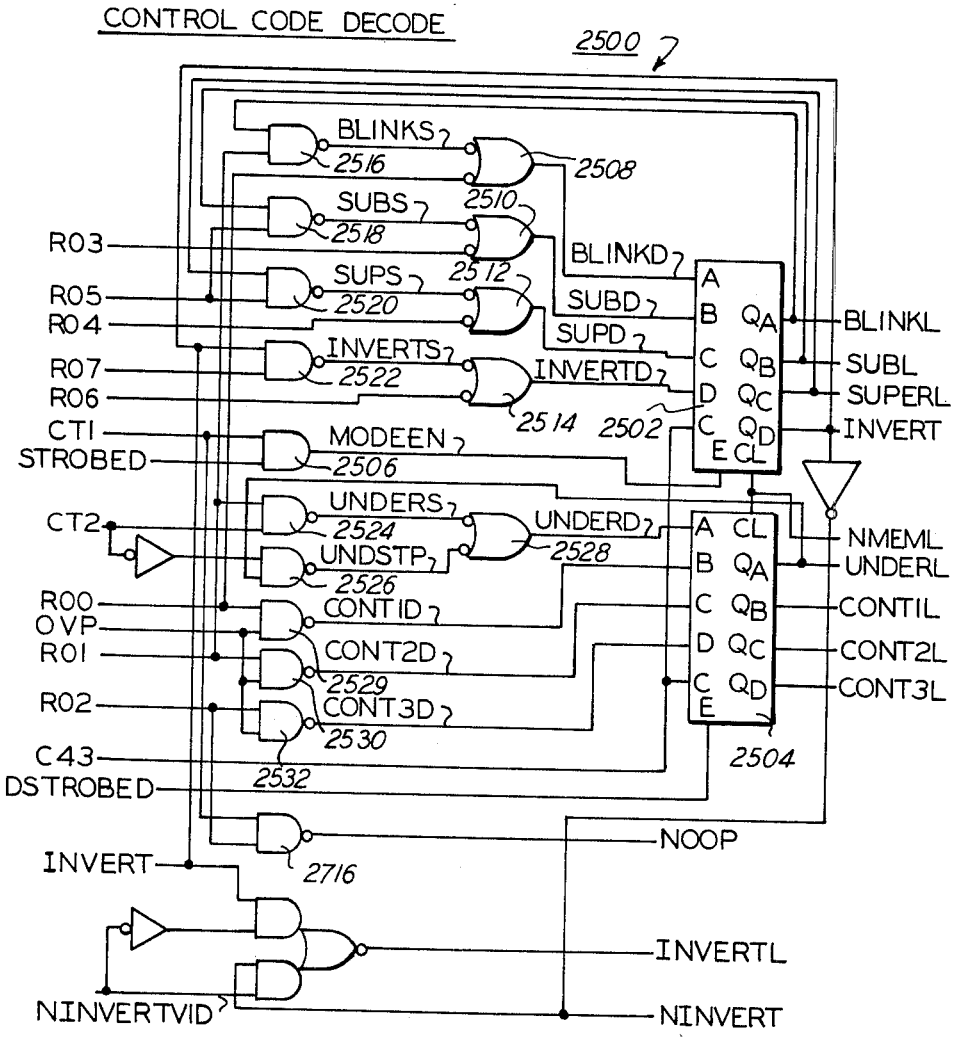

The output code available from translator 2300 is applied to control code decode logic 2500 in FIG. 22. Control code decode logic includes more latches 2502 and 2504. Latch 2502 is enabled by a signal from AND gate 2506. The mode enable signal is generated by AND gate 2506 in response to conditions on the CT1 line from PROM 2360 and STROBED output from the logic shown in FIG. 25 to be described hereinafter. Latch 2504 is enabled by DSTRODED, also outputted from the logic shown in FIG. 25. Upon being enabled, latches 2502 and 2504 store data at the occurrence of a C43 clock pulse. Inputs to latch 2502 are from OR gates 2508, 2510, 2512 and 2514. A logic one condition entered for any one of the four bits stored in latch 2502 is maintained by a feedback line from the Q output for that particular latch bit. The feedback path is from the particular Q output of latch 2502 to one input of a NAND gate having its output connected as an input to the OR gate that supplies the input condition for the particular latch 2502 bit position. In the circuitry shown in FIG. 22, a connection is made between the $Q_A$ output of latch 2502 to NAND gate 2516. Similarly, the $Q_B$, $Q_C$ and $Q_D$ outputs of latch 2502 are fed back to respective NAND gates 2518, 2520 and 2522.

The A input of latch 2504 receives as an input the output of combination logic comprising NAND gates 2524, 2526 and OR gate 2528. A feedback line connects between the $Q_A$ output of latch 2504 and one input of NAND gate 2526. The B, C and D inputs of latch 2504 receive a signal from AND gates 2529, 2530 and 2532, respectively. The OVP signal from PROM 2360 is applied as an input condition common to each of AND gates 2529, 2530 and 2532.

The RO0–RO7 output lines from PROM 2320 and 2340 are variously applied as inputs to the combination logic that sets the logic one or zero input to each bit position of latches 2502 and 2504. The output lines from latches 2502 and 2504 are applied to text buffer 2400 shown in FIG. 24.

Figure 23:
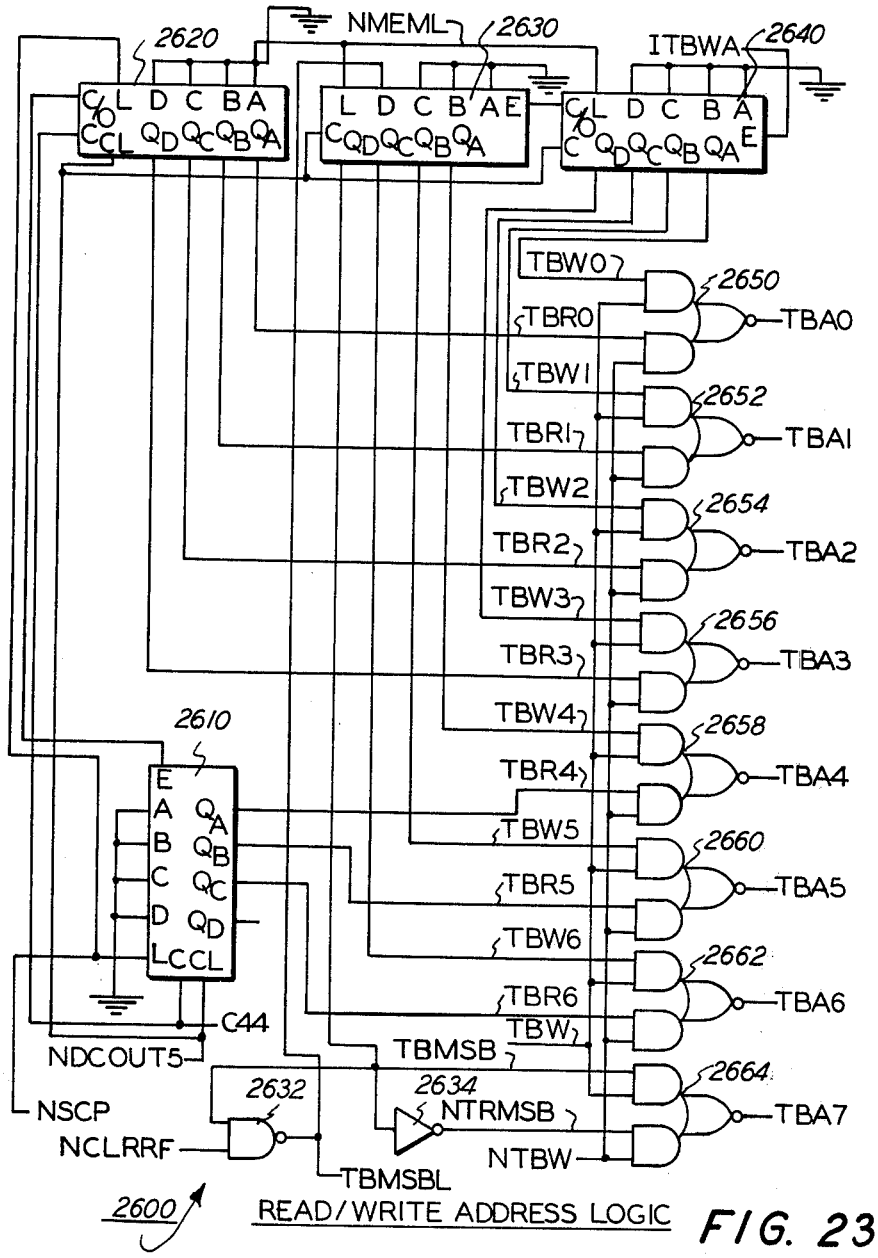

With reference now to FIG. 23, text buffer read/-write address logic 2600 is presented. Address logic 2600 is implemented using two synchronous four-bit counters 2610 and 2620 that serve as read-character counters and by two synchronous four-bit counters 2630 and 2640 that serve as write-character counters. Counters 2610, 2620, 2630 and 2640 are all clocked by the C44 clock. Counters 2610 and 2620 are cleared by a signal NSCP that parallel loads both counters with all zeros. NDCOUT5 is applied to counters 2610 and 2620 as a "clear" signal. Counters 2610 and 2620 are interconnected with the ripple carry output of counter 2620 being used to enable counter 2610. The TBR lines make available as outputs all four bits of counter 2620 and three bits of counter 2610.

Counters 2630 and 2640 are interconnected with the ripple carry output of counter 2640 being applied to the enable input of counter 2630. The signal NMEML controls loading of counters 2630 and 2640. At the occurrence of a logic zero on the NMEML line, counter 2640 is loaded with all zeros, and counter 2630 is loaded with zeros in the three lower bit positions. The fourth bit position is loaded with a bit value corresponding to the logic level of a signal TBMSBL derived from NAND gate 2632. Counter 2640 is enabled by ITBWA derived from the write control logic for text buffer 2400 shown in FIG. 25.

The seven TBR lines from read counters 2610, 2620 and the seven TBW output lines from write counters 2630, 2640 are multiplexed by AND/OR select logic circuits 2650 through 2662. The $Q_D$ output of counter 2630 is applied directly to AND/OR select logic 2664, with the complement thereof available from inverter 2634 being applied as a second alternative input to logic circuit 2664. Selection of the text buffer read address or the text buffer write address is made in accordance with the conditions existing on the TBW and NTBW lines that enable one or the other of the TBW and TBR address code lines to be outputted over the TBA0 through TBA7 address lines. The TBW and NTBW signals are generated in the clock generator circuitry in FIG. 7.

Figure 24:
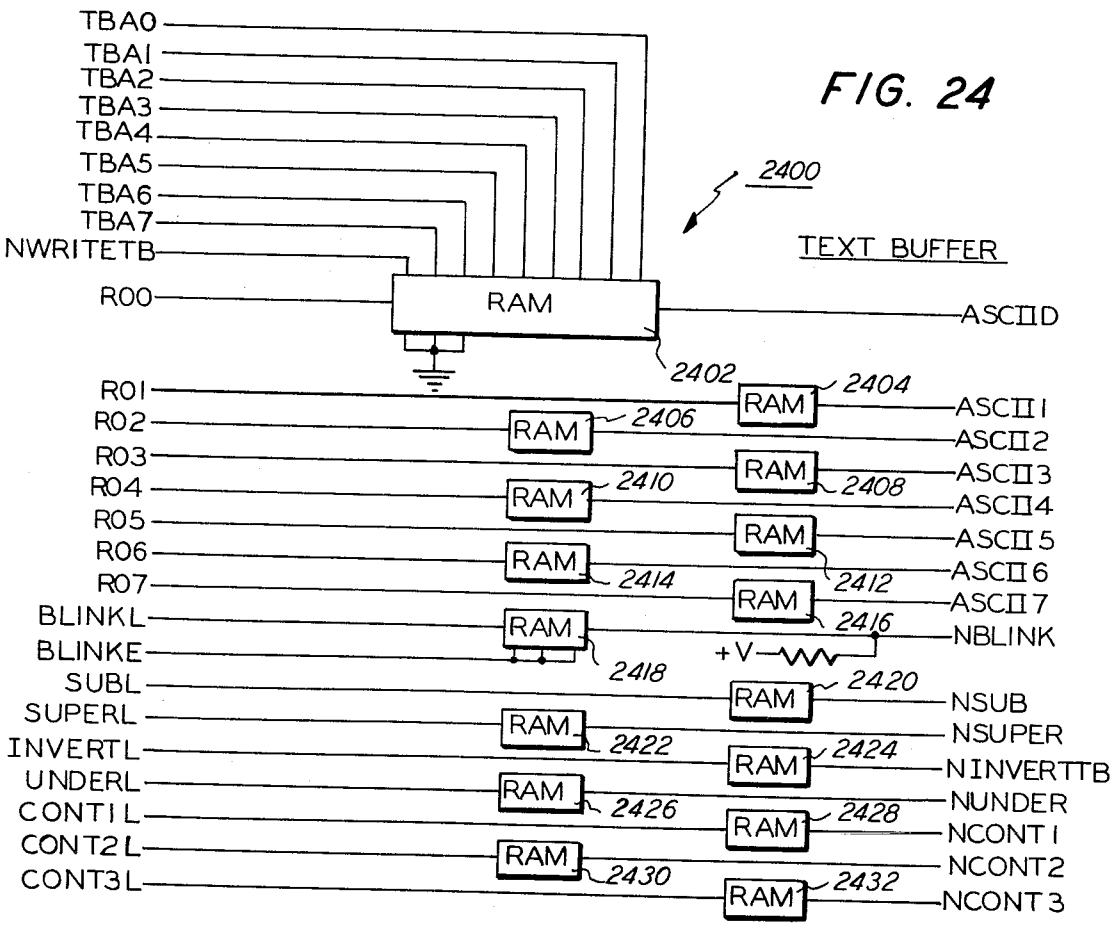

With reference now to FIG. 24, text buffer 2400 is implemented by sixteen 256×1 random access memories 2402 through 2432. Although only RAM 2402 is shown in detail, it is to be understood that each of the other random access memories is identical to 2402. Each RAM receives the TBA lines from the read/write address logic of FIG. 23. A text buffer write (NWRITETB) signal controls the read and write operation of each RAM.

Text buffer 2400 is sixteen bits wide, and data to be written into the random access memories of text buffer 2400 include that available from PROM's 2320 and 2340 of translator 2300 over the RO0–RO7 lines and the eight bits of text information contained in latches 2502 and 2504.

Figure 25:
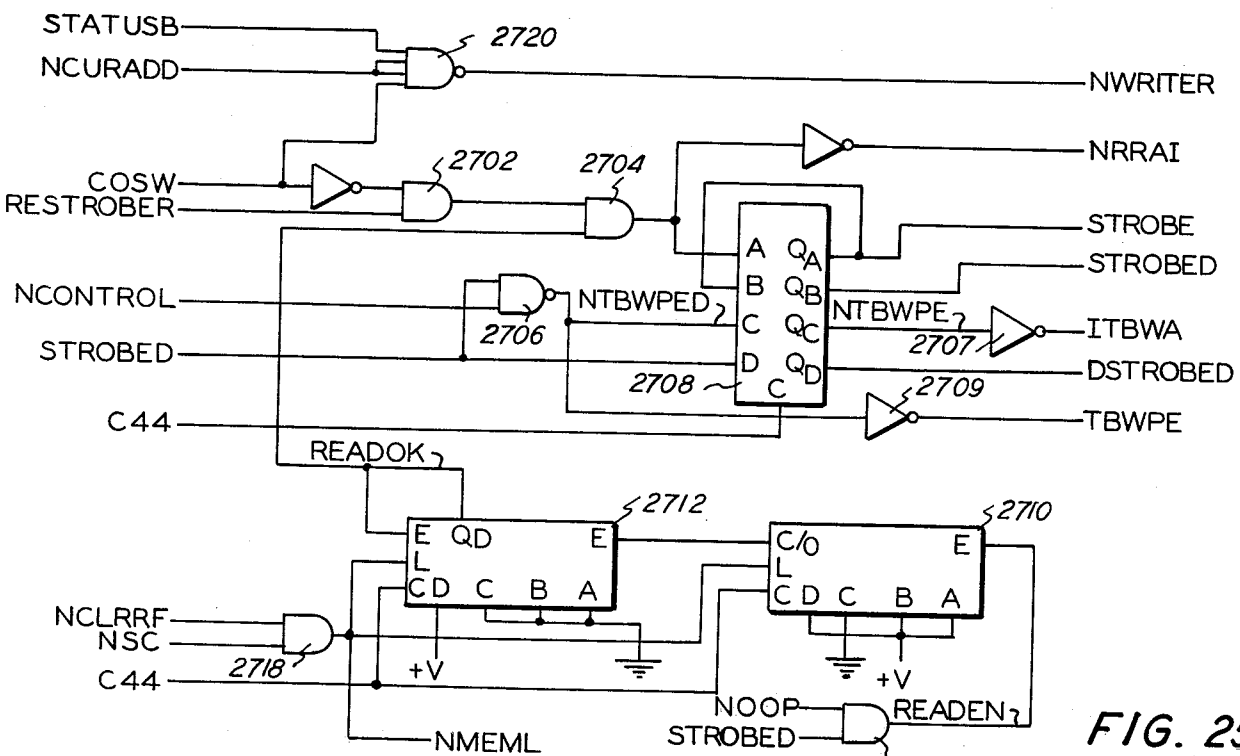

Writing of data into text buffer 2400 at the address specified is controlled by the logic shown in FIG. 25. Control logic comprising AND gates 2702, 2704 and NAND gate 2706 generates the STROBED and DSTROBED signals utilized in the control code decoder logic in FIG. 22. The logic signals generated by the combination logic are stored in latch 2708 at the occurrence of a C44 clock pulse. The logic shown in FIG. 25 also includes character counters 2710 and 2712 that are incremented by the C44 clock. Counters 2710 and 2712 are interconnected with the ripple carry output of counter 2710 being applied as an enabling input to counter 2712. Counter 2710 is enabled by a signal generated from AND gate 2714 in response to STROBED, except during a nonoperation step as detected by NAND gate 2716.

Counters 2710 and 2712 are preset by a signal generated from AND gate 2718. A logic zero from AND gate 2718 presets counter 2710 to a count of eleven, and counter 2712 is preset to a count of eight. After one hundred seventeen characters have been read out of text buffer 2400, the READOK line, extending from counter 2712 to AND gate 2704, causes a logic zero to be entered in latch 2708 on the subsequent C44 clock pulse. The strobe signal then disables latches 2502 and 2504 in the control code decoder of FIG. 22 to prevent further entry of data from translator 2300. The logic zero is fed back to the B input of latch 2708, and following a C44 clock pulse appears at the $Q_B$ output as STROBED. The logic zero on the STROBED output line is applied to NAND gate 2706 resulting in a logic one being set up at the C input of latch 2708. This logic condition is entered in latch 2708, and following inversion in inverter 2709, the text buffer write enable signal (TBWPE) goes to a logic zero. The logic zero condition of the text buffer write enable signal is propagated through flip-flop 1076 in the clock generator circuitry of FIG. 7 and applied to NAND gate 1078, causing the text buffer write signal to go to a logic one, which disables text buffer write capability.

The sixteen bits of information available from the text buffer include eight bits of modified ASCII character code and eight bits of text manipulative or control information. All sixteen bits available from text buffer 2400 are then applied to character generator 3000.

D. Character Generator Logic

Figure 26A:
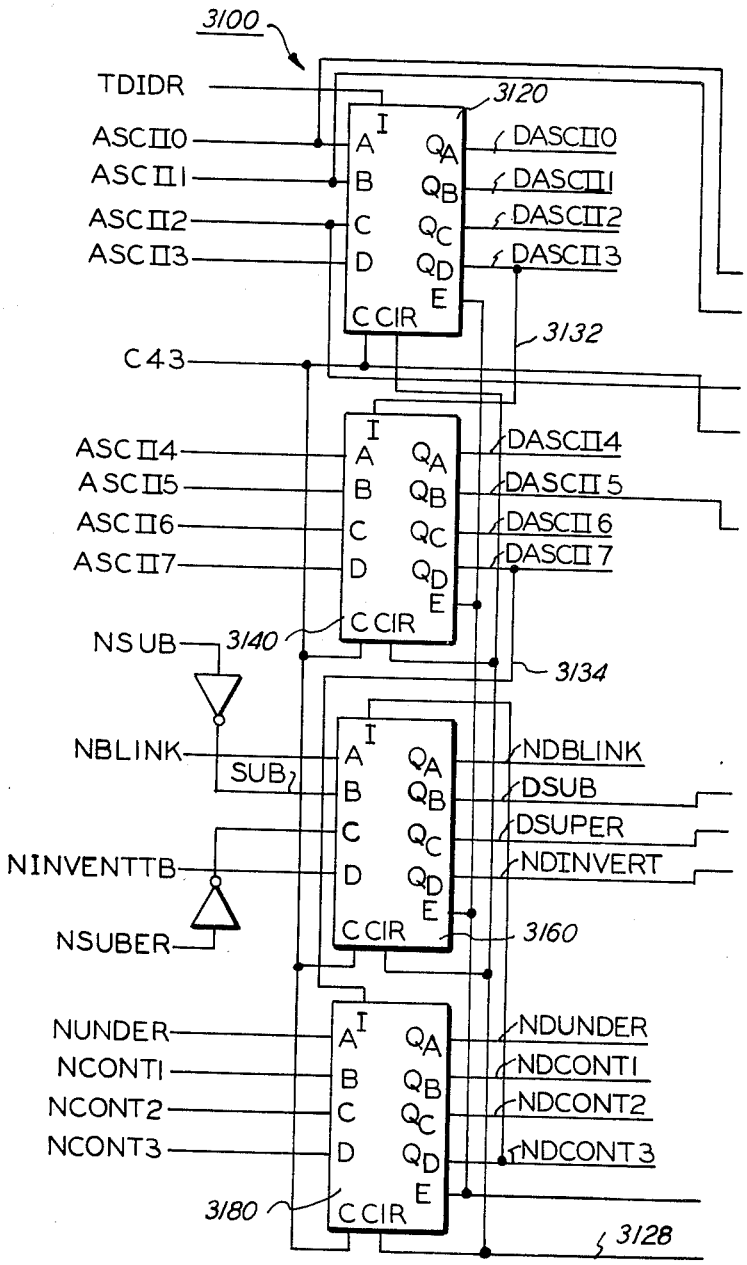
FIGS. 26–31 are schematic diagrams of specific circuitry for implementing the character generator portion of the display processor.

D register 3100 of character generator logic 3000 that receives the modified ASCII character code and text manipulative data is shown in FIG. 26. D register 3100 includes four four-bit latches 3120, 3140, 3160 and 3180. The eight bit modified ASCII character code is stored in latches 3120 and 3140, and the eight bits of text manipulative data are stored in latches 3160 and 3180. The four shift register latches are simultaneously cleared by NDCLR. TDIDR is applied to the shift right data input of register 3120. The shift right data input on shift register 3140 is connected to the $Q_D$ output of shift register 3120. Similarly, the $Q_D$ output of shift register 3140 is connected to the shift right data input of shift register 3180, and the $Q_D$ output of shift register 3180 is connected to the shift right data input of latch 3160.

Figure 27:
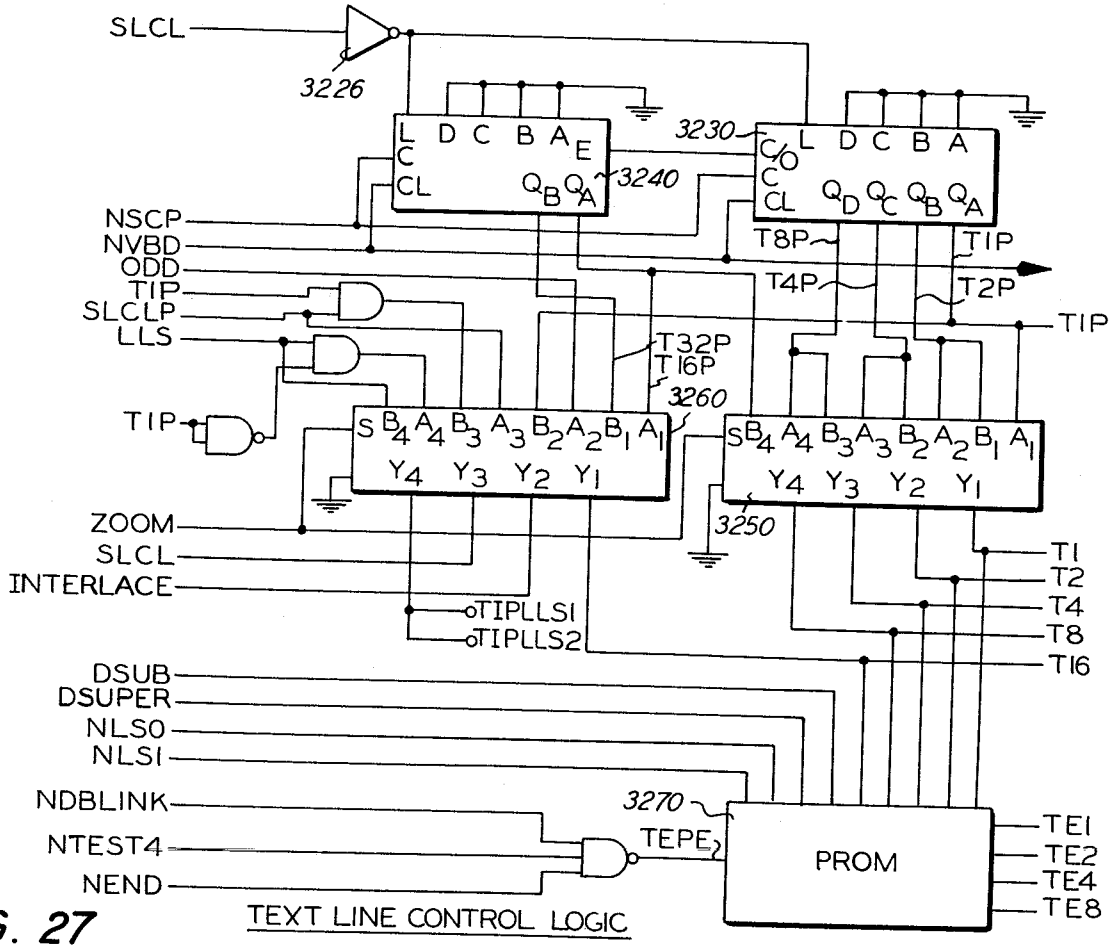
Figure 28:
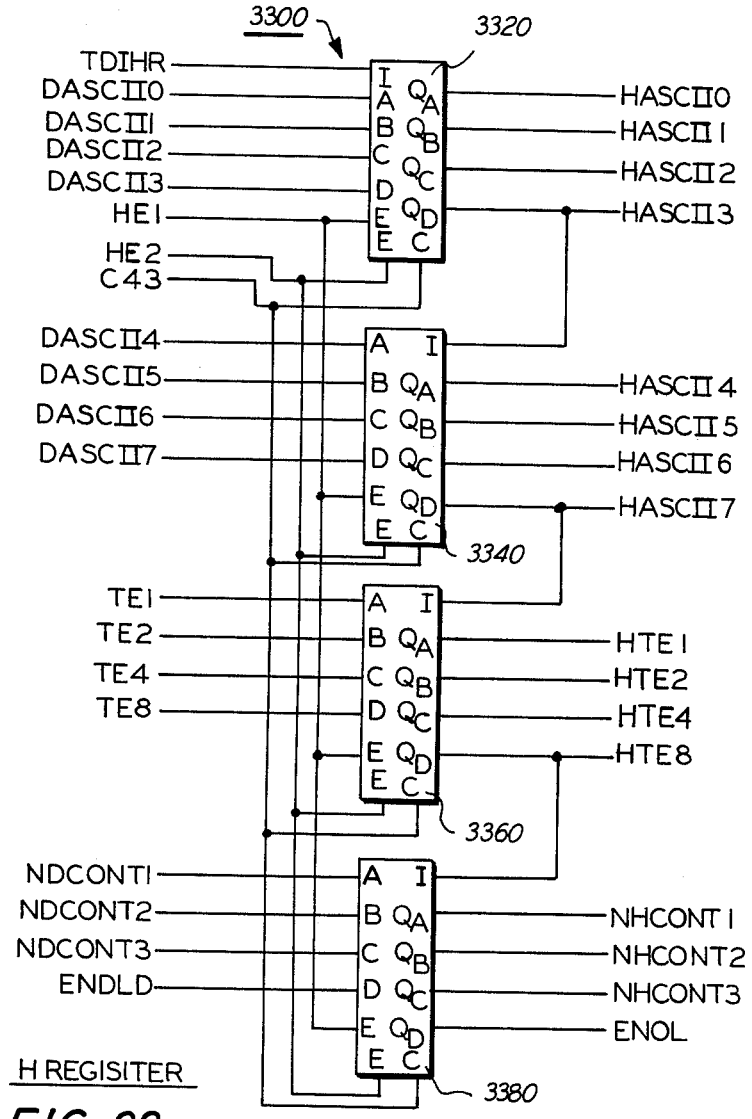

The eight bit modified ASCII character code available from shift registers 3120 and 3140 is applied to H register 3300 shown in FIG. 28. The text manipulative code available from shift registers 3160 is inputted to text line control logic 3200 shown in FIGS. 26 and 27. The $Q_B$ and $Q_C$ outputs of shift register 3160 provide the signals DSUB and DSUPER, respectively, and are applied as inputs to NAND gate 3202, which generates the NEND signal, which is applied as a strobe enable to D register 3100. The output of NAND gate 3202 is applied via inverter 3204 to one input of NAND gate 3206. The other two inputs to NAND gate 3206 are SLCL and the $Q_B$ output of shift register 3140, which is bit 5 of the modified ASCII code. The output of NAND gate 3206 is applied through OR gate 3208 to register 3380. The output of 3380 is inverted by 3210 and applied to NAND gate 3212. NAND gate 3212 also receives the start cycle pulse (SCP) and generates the D register "clear" signal. The output of register 3380 is fed back through NAND gate 3214. The output of NAND gate 3214 is the second input to OR gate 3208. NAND gate 3214 also receives a signal NVBD available from the instruction decoder logic shown in FIG. 12.

Shift register latch 3220 shown in the upper portion of FIG. 26 receives bits 0 through 3 of the modified ASCII character code available from the text buffer. These three bits are entered in shift register latch 3220 by the C43 clock and are also entered into shift register latch 3120. The shift right data input of device 3220 is connected to signal TDILS. The strobe enable inputs to device 3220 are TIPLLS1 and TIPLLS2. The $Q_A$, $Q_B$ and $Q_C$ outputs of device 3220 are applied to programmable read-only memory 3222. The $Q_D$ output constituting the ZOOM control bit is applied to the logic in FIG. 27.

Turning now to FIG. 27, synchronous four-bit counters 3230 and 3240 are clocked by an inverted start cycle pulse signal (NSCP) available from inverter 3224 in FIG. 26. The NVBD signal utilized in the circuitry in FIG. 26 is applied as the "clear" input to counters 3230 and 3240. The output of inverter 3226 provides the load enable input to counters 3230 and 3240.

The output of counter 3230 is multiplexed through data selector 3250 to PROM 3270. Only the $Q_A$ and $Q_B$ outputs of counter 3240 are utilized and these two outputs are multiplexed through data selector 3260 to PROM 3270. The $Y_1$ through $Y_4$ outputs of data selector 3250 and the $Y_1$ output of data selector 3260 are made available as lines T1 through T16 and are applied to PROM 3222 in FIG. 26. The select input of both data selector 3250 and 3260 is controlled by ZOOM available from shift register latch 3220 in FIG. 26.

Additional inputs to PROM 3270 include the subscript and superscript code bits, DSUB and DSUPER and the $Q_A$ and $Q_B$ outputs of shift register latch 3220. PROM 3270 provides four output lines TE1, TE2, TE4 and TE8. The code on these output lines represents the scan line count and can generate a fictitious scan line count in order to provide subscript and superscript notations within a text line.

The H register in FIG. 28 comprises four shift register latches 3320, 3340, 3360 and 3380. The modified ASCII character code from D register 3100 is applied to devices 3320 and 3340. The scan line count code bits (TE1, 2, 4, 8) are applied as inputs to register 3360. Register 3380 receives the $Q_B$, $Q_C$ and $Q_D$ outputs of D register 3180.

The modified ASCII character code, scan line count and control code bits are entered into the four shift registers at the occurrence of a C43 clock pulse. The shift right data input of register 3320 is by TDIHR, with the $Q_D$ output of shift register 3320 being applied to the shift right data input of register 3340. Similarly, the $Q_D$ output of shift register 3340 is applied to the shift right data input of register 3360, and the shift right data input of register 3380 is connected to the $Q_D$ output of register 3360. H register 3300 outputs to the font memory 3400 in FIG. 29 and to the font enable decode logic 3500 in FIG. 30.

Font memory 3400 incudes a font set for characters typically used in typewritten matter produced in the United States. The font memory also contains a second, international font set having characters and symbols utilized in various other countries of the world. Finally, font memory 3400 includes circuitry for providing an overlay capability on the CRT screen to provide for unique character associated symbols, such as the accent mark.

The font set for characters used in the United States is contained in PROM's 3422 through 3436. Each PROM receives the modified ASCII character code. Again, for purposes of simplifying the schematic diagram, only PROM 3422 is shown in detail, with the others being shown in a less complex diagrammatic form. The various pairs of PROM's that contain the U.S. font set are selected by select lines USF1 through USF4 obtained from the font enable decode logic of FIG. 30.

The font set for international characters, which works in association with the U.S. font set, includes PROM's 3438, 3440, 3442 and 3444. Appropriate pairs of these PROM's are selected by select lines INT1 and INT2.

The circuitry for implementing the overlay capability includes a signal programmable read-only memory 3450 receiving control input signals from registers 3360 and 3380 of the H register and a signal OLPEN from AND-/OR select logic 3460.

Figure 29A:
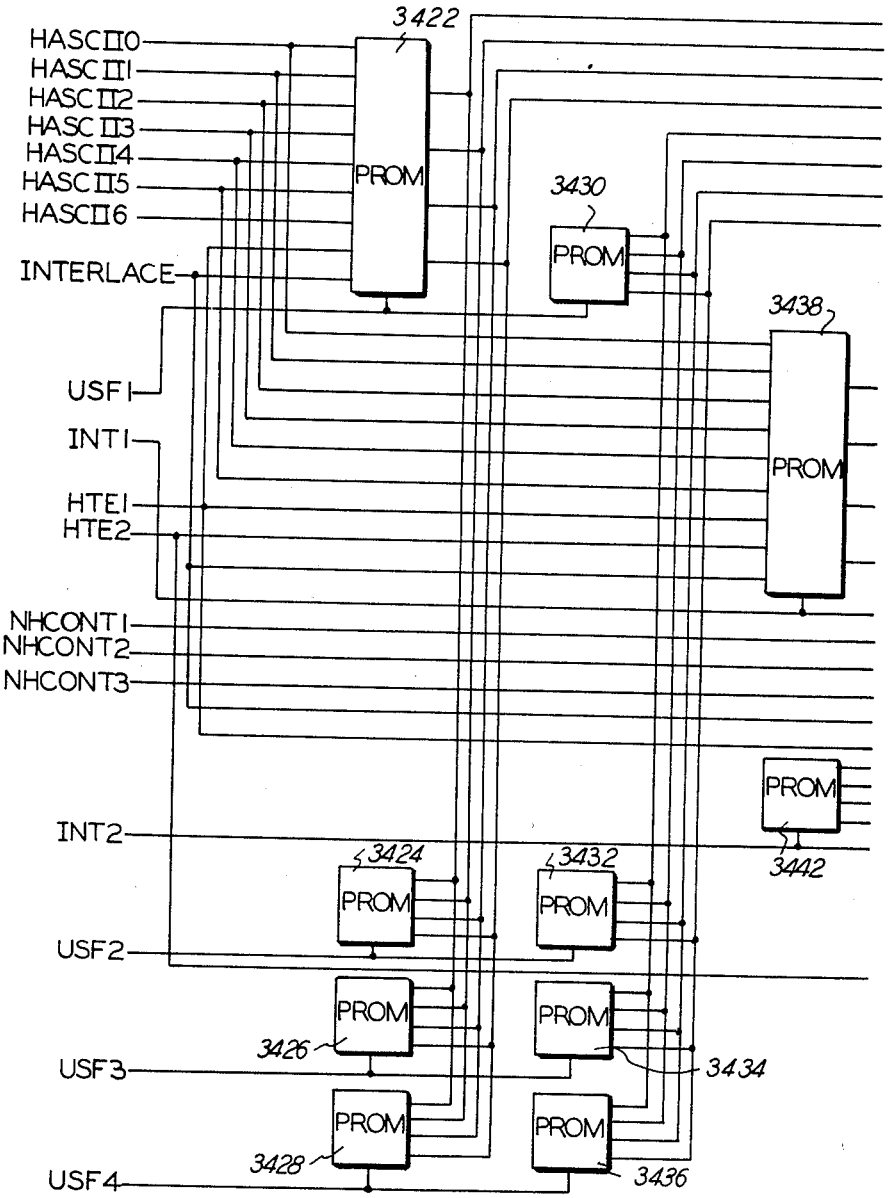
Figure 29B:
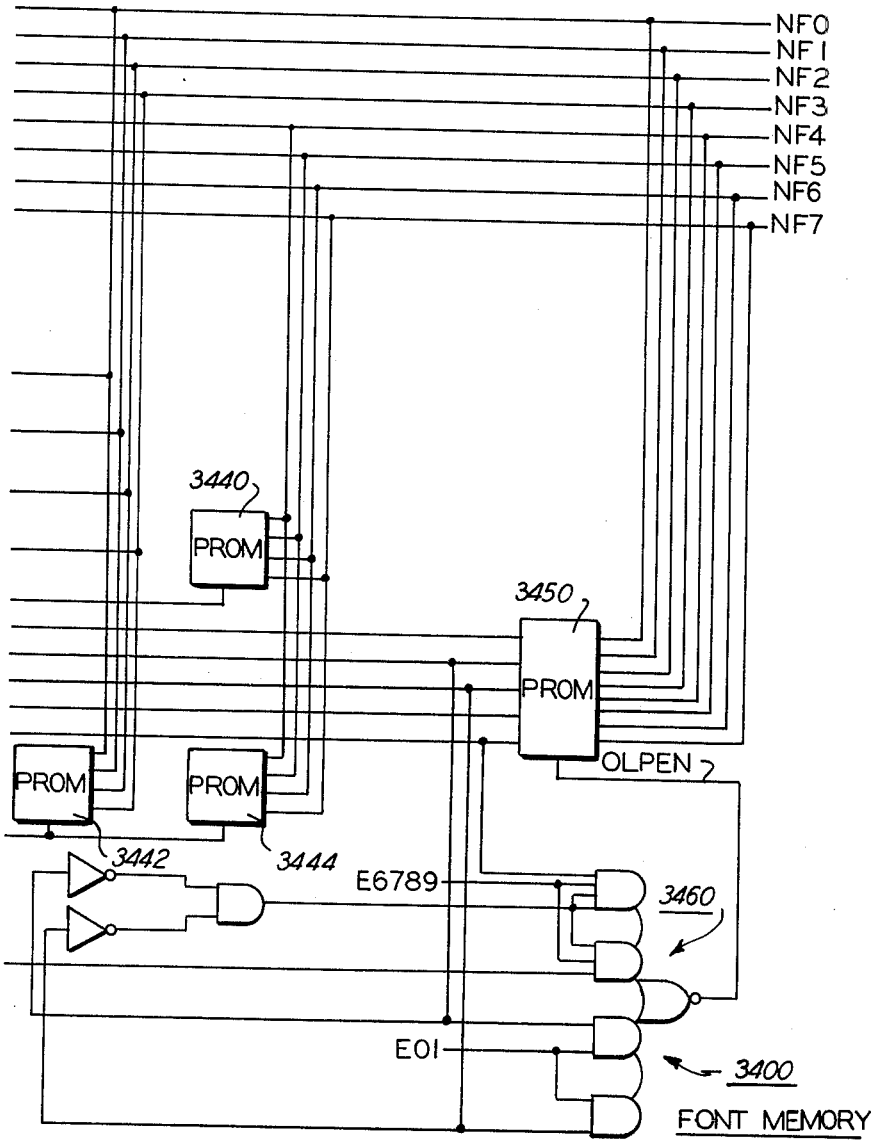
Figure 30:
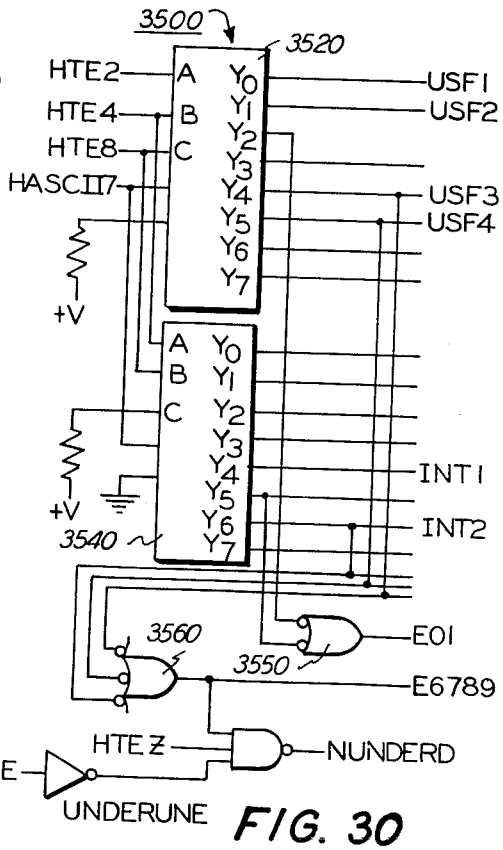

The font enable decode logic 3500 shown in FIG. 30 is built around decoders 3520 and 3540. Each of these devices decodes one of eight lines, based upon the conditions at three binary select inputs A, B and C. The $Y_2$ output of decoder 3520 and the $Y_5$ output of decoder 3540 are utilized as inputs to OR gate 3550 to generate a signal EO1 applied to AND/OR select logic 3460 in FIG. 29. Also, the $Y_4$ and $Y_5$ decoded outputs of decoder 3520 and the $Y_6$ output decoder 2540 are utilized as inputs to OR gate 3560 to generate the E6789 signal applied as an input to AND/OR select logic 3460.

Figure 31:
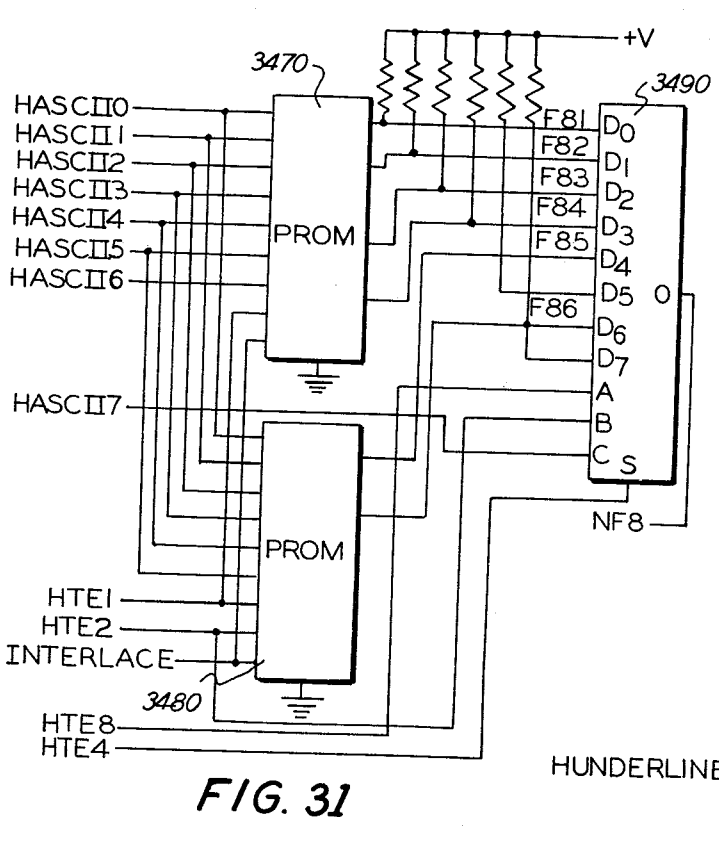

With reference to FIG. 29, font memory output lines NF0 through NF7 make available the dot pattern bits outputted from the PROM's in the font memory. A ninth font memory output line NF8 is provided, and data to be outputted over that line is generated by the logic shown in FIG. 31. PROM 3470 receives the same inputs as the PROM's of the U.S. font set, and PROM 3480 receives the same inputs as the four PROM's of the international font set. Four bits outputted from PROM 3470 and two bits from PROm 3480 are applied to data selector 3490. In addition to the data bits from PROM's 3470 and 3480, data selector 3490 receives the HTE2, 4 and 8 data bits and the seventh bit of the modified code contained in the H register. Data selector 3490 provides the ability to select one of eight data sources applied to the $D_0$ through $D_7$ inputs. A particular data source is selected in accordance with a three-bit select code presented to the A, B and C select inputs and outputs NF8.

E. Video Output Circuitry

Figure 32:
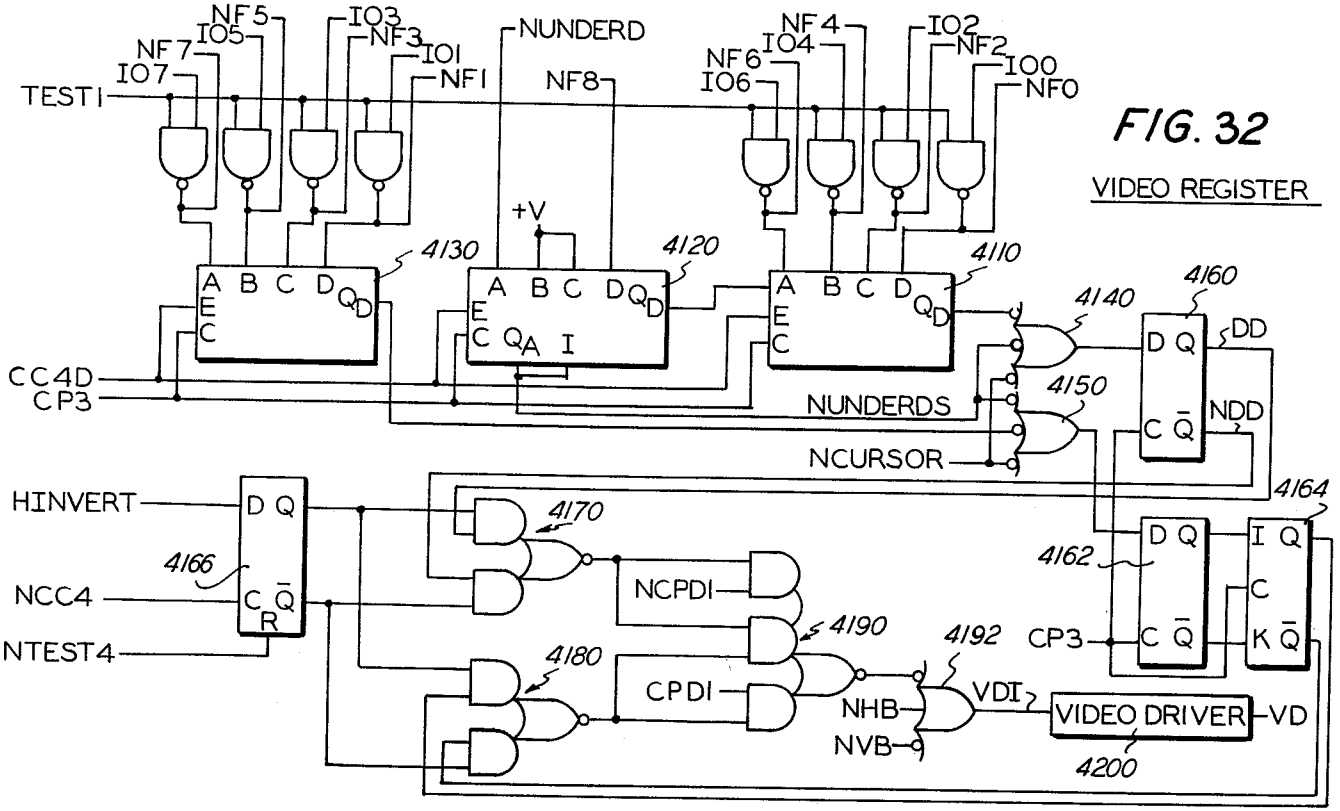
FIGS. 32 and 33 are schematic diagrams of specific circuitry for implementing the video output circuitry of the display processor.

Referring to FIG. 32, the ten bits of data from the font memory, NF0–NF8 are NUNDERD, are provided in parallel to the video output circuitry. As will be readily apparent, however, video data must be outputted serially to the CRT display. Further, the serial video data must be shifted out at 57.772 MHz. The ten bits of video data available over the NF lines and the NUNDERD line are parallel loaded into shift registers 4110, 4120 4130. In order that the data may be shifted within the video register at an actual rate of 28.886 MHz, yet the CRT display will receive the data at an apparent 57.772 MHz, multiplexing or ping-ponging of the video data within the video output register is necessary. Accordingly, the video data bits are arranged with the even bits NF0, 2, 4 and 6 being loaded into shift register 4110, and the odd bits NF1, 3, 5 and 7 being loaded in shift register 4130. The NF8 data bit and the NUNDERD data bit are loaded into shift register 4120. All three shift registers are clocked by the same CP3 clock. The serial output of shift register 4110 is applied as one input to OR gate 4140, and the serial output of shift register 4130 is applied as one input to OR gate 4150. The shift right serial/input of shift register 4120 is connected to the $Q_A$ output of that device. The $Q_A$ output of register 4120 is further provided as an input to both OR gate 4140 and OR gate 4150. The third input to each of the OR gates is the NUCURSOR signal from the cursor generator in FIG. 32. The output of OR gate 4140 is applied as an input to a high-speed D flip-flop 4160. The output of OR gate 4150 is applied as an input to D flip-flop 4162. Both flip-flops are clocked by the CP3 clock.

The Q and $\overline{Q}$ outputs of flip-flop 4160 are applied directly as inputs to AND/OR select logic 4170. The Q and $\overline{Q}$ outputs of flip-flop 4162, however, are applied as inputs to JK flip-flop 4164, which is clocked by the negative going transition of the CP3 clock. The Q and $\overline{Q}$ outputs of JK flip-flop 4164 are applied as inputs to AND/OR select logic 4180. Accordingly, an even numbered video data bit output from shift register 4110 is applied to AND/OR select logic 4170 ahead of the application to AND/OR select logic 4180 of an odd numbered video data bit output from shift register 4130 on the same CP3 clock pulse by a time equal to one-half of a CP3 clock pulse cycle.

Flip-flop 4166 is clocked by the NCC4 clock and receives HINVERT as an input to provide the necessary selection signals for AND/OR select logic 4170 and 4180. Depending upon whether HINVERT is inputted as a logic one or a logic zero, the AND/OR select logic gates will provide either inverted or non-inverted data.

The outputs of the AND/OR select logic 4170 and 4180 are applied as inputs to AND/OR select logic 4190. Logic 4190 also receives the two clocks CPD1 and NCPD1, which are 180 degrees out of phase with each other. The CPD1 clock is combined with the output of logic 4180, and the NCPD1 clock is combined with the output from logic 4170. The clocks CPD1 and NCPD1 are utilized to prevent data from being applied to the output of logic 4190 until data that is in the respective one of flip-flops 4160 and 4164 has had time to stabilize. The output of logic 4190 is applied to a video driver circuit 4200 through OR gate 4192. The output of video driver 4200 is then applied to the LDU.

Figure 33:
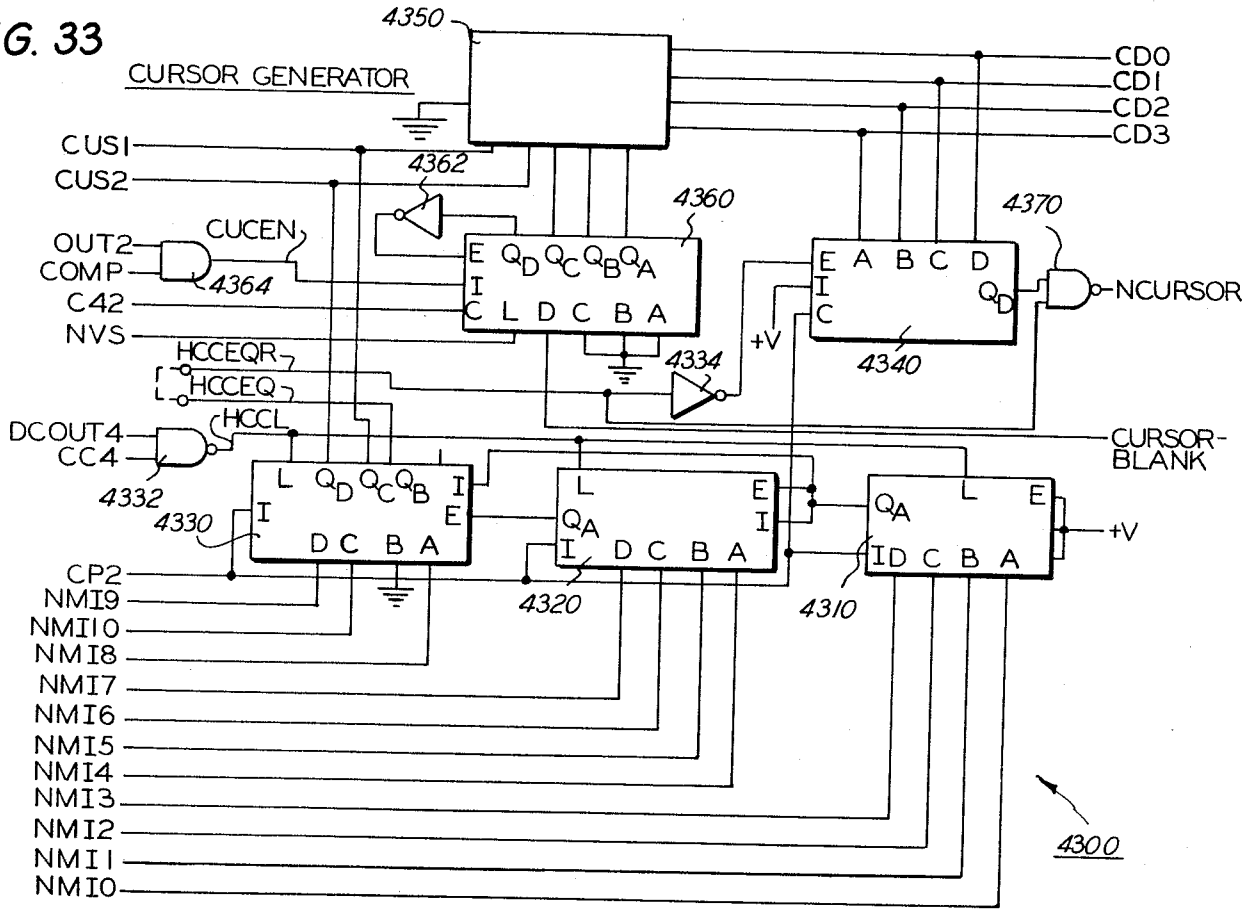

Turning now to FIG. 33, circuitry for cursor generator 4300, which generates the NCURSOR signal utilized in video register 4100, utilizes three synchronous counters 4310, 4320 and 4330 that are loaded with the horizontal cursor count provided over lines NMI0 through NMI10 from inverters 1416 in FIG. 14. Loading of the horizontal cursor count into the counters is at the occurrence of a CP2 clock pulse following the generation by NAND gate 4332 of the horizontal cursor count load (HCCL) signal.

Cursor generator 4300 further includes shift register 4340, which is also clocked by the CP2 clock and parallel loaded with four bits of data over lines CD0 through DC3 from device 4350. Inputs to device 4350 include the $Q_A$, $Q_B$ and $Q_C$ outputs of counter 4360 and the $Q_C$ and $Q_D$ outputs of counter 4330. Based upon the output conditions of counters 4330 and 4360, device 4350 outputs the appropriate four bits of code for parallel loading into shift register 4340. Synchronous parallel loading of shift register 4340 is disabled by the $Q_B$ output of counter 4330 via inverter 4334.

Counter 4360 is clocked by the C42 clock and is enabled for parallel loading by the vertical sync (NVS) signal. The A, B and C parallel load inputs to counter 4360 are all logic zeros; however, the D input is determined in accordance with the cursor blank signal. The $Q_D$ output of counter 4360 is supplied through inverter 4362 to a count enable input. Another count enable input for counter 4360 receives the cursor count enable (CUCEN) provided by AND gate 4364 in response to COMP from the comparator logic and OUT2 from the instruction decode logic.

NCURSOR is generated in cursor generator 4300 and outputted from NAND gate 4370. Inputs to NAND gate 4360 are the serial output of shift register 4340 and the $Q_B$ output of counter 4330.

F. Display Processor Operation

Although the display processor of the present invention utilizes a program sequence of instructions to control its own internal operations, the display processor exists as a peripheral device receiving data when selected by a direct memory access unit, and, as such, the display processor operation must be coordinated with the DMA. Therefore, before discussing operation of the display processor under the direction of the instruction program, a discussion of the operation and the circuitry involved in bringing text data and text manipulative codes into the display processor is in order.

Text character data and text control codes are brought into the display processor during a DMA output sequence. A DMA output sequence can be for the purpose of providing display refresh memory data line (i.e., ASCII coded character data) and text control data (i.e., subscript or superscript notation, underlining, etc.) to be utilized within the display processor to formulate the dot pattern to be displayed on the CRT to produce character images. As the display processor is merely one of several peripheral devices connected to the DMA bus, a separate dedicated control line is required between the DMA and the display processor. In order to output data to the display processor, the DMA must indicate to the display processor that it has been selected. Referring then to FIG. 9, a select line (SEL1) from the DMA to the display processor is synchronized with the display processor clock C44 in flip-flop 1203. The existence of a selection of the display processor by the DMA is indicated by a "high" condition on the SEL1 line causing flip-flop 1203 to be set at the occurrence of the subsequent C44 clock pulse. A "high" condition on the SEL1 line is provided by the DMA following a set-up of data for the display processor on the DMA bus.

With reference to FIG. 10, the available data is brought in to the display processor through transceivers 1256 and 1258. Input buffer registers 1252 and 1254 are connected to the transceiver outputs in order that an eight bit byte of received data can be entered into input buffer registers 1252 and 1254. Loading of data into input buffer registers 1252 and 1254 is by LBEN, a signal generated by AND gate 1204 in FIG. 9. The Q output of flip-flop 1203 and the $\overline{Q}$ output of flip-flop 1214 are applied as inputs to AND gate 1204. Accordingly, upon the setting of flip-flop 1203 in response to SEL1, AND gate 1204 generates LBEN to clock registers 1252 and 1254 and parallel load the DMA output data. Registers 1252 and 1254 are enabled for loading by a buffer enable signal generated from register 1209. NBUINDIS is initially "cleared", causing the buffer enable line to be in a "high" condition.

The first byte of data outputted by the DMA and stored in the input buffers is applied to PROM 1206. In a DMA output sequence, the first byte is a dedicated code "OD" in hex, denoting that an output sequence is to be done. The indication that an output sequence is to be performed is indicated by the NOUTDEC output line from PROM 1206 going "low". The NOUTDEC signal is applied as one input to OR gate 1207 to establish a logic one at its output. The output of OR gate 1207 is routed through multiplexer 1208 to the A input of register 1209.

At the occurrence of the following C44 clock pulse, flip-flop 1214 is set by reason of the connection of the Q output of flip-flop 1203 to its D input. After SEL1 goes "low" and flip-flop 1203 is reset, NAND gate 1213 generates NINCEN to cause OR gate 1212 in FIG. 10 to enable parallel loading of register 1209. At the next C44 clock pulse, the input conditions at register 1209 are parallel loaded. The $Q_A$ output of register 1209 goes "high" and that condition is fed back through multiplexer 1208 to the B input of register 1209. The $Q_A$ output of register 1209 is routed through inverter 1227 and fed back as the second input to OR gate 1207 to "seal in" the logic one condition originally established by the NOUTDEC input. The NIOC signal outputted by inverter 1227 is applied as an input to NAND gate 1236 in FIG. 9. Also, at the occurrence of the C44 clock pulse, flip-flop 1214 is reset, disabling register 1209.

When the DMA outputs the second byte of data and SEL1 again goes "high", flip-flop 1203 is again set by the following C44 clock pulse. Setting a flip-flop 1203 causes AND gate 1204 to again initiate the LBEN signal, causing input buffer registers 1252 and 1254 to enter the second eight-bit byte of data. The second byte of data is applied to PROM 1206 and is either a 0X or an 8X code. If the code is a 0X, then the DMA is going to be outputting data to be stored in random access memory 1350. If an 8X code is received, then the DMA is going to output mode or test data.

The second byte of data doubles as an address for the information to be written into RAM 1350. With brief reference to FIGS. 13 and 14, it is to be remembered that data inputted to RAM 1350 is routed through multiplexer 1400, with data from the DCD lines being but one source of data that can be selected by multiplexer 1400. Accordingly, the outputs of data registers 1260, 1262, 1264 and 1266 must be selected by multiplexer 1400 in order for data to be written in RAM 1350. Selection of the particular input to be outputted over the multiplexer output lines is by the establishment of a proper code on the MUXA and MUXB select lines.

Logic for generating the select signals for multiplexer 1400 is shown in FIG. 11. Data bits available over the DCA4, 5, 6 and 7 lines from input buffer registers 1252 and 1254 are applied as inputs to logic comprising NAND gates 1238, 1240 and 1242. Since the display processor is not doing an output of data to the output buffer, DCOUT6 is applied to NAND gate 1238 as a logic zero. If the bytes three and four are in fact to be stored in the display processor RAM, the DCA4 through 7 address bits are all logic zero disabling lines 1243 and 1245. The other four address bits, DCA0 thrugh DCA3, are selected by multiplexer 1302 in FIG. 14 as the RAM address code. The data is stored in the RAM by NSTS going to logic zero, and OR gate 1244 going to logic one to select the address for multiplexer 1302 and causing NRW (NAND 1168) to be generated.

With reference once again to FIGS. 9 and 10, on the next C44 clock pulse following that which again set flip-flop 1203, flip-flop 1214 is set. On the next C44 clock pulse following the SEL1 line going "low", flip-flop 1203 is reset. NAND gate 1213 again generates NINCEN and register 1209 is enabled for clocking on the next C44 clock pulse. Register 1209, after clocking, sets $Q_B$ and generates the input buffer disable signal NBUISDIS available from inverter 1210. The "low" condition on the buffer disable line prevents further entry of data in registers 1252 and 1254 to maintain the address byte stored therein. The $Q_B$ output of register 1209 is also fed back through multiplexer 1208 to the C input of register 1209. The C44 clock that causes the $Q_B$ output of register 1209 to be set also resets flip-flop 1214.

When the third data byte from the DMA is ready and SEL1 again goes "high", flip-flop 1203 is set, resulting in register 1252 and 1254 being disabled.

The third byte output by the DMA is routed over the DCD lines to data registers 1260 and 1262 in FIG. 13. On the next C42 clock pulse, the data is entered into registers 1260 and 1262. The registers are enabled for loading by an input data storage enable (IDST) signal outputted from NAND gate 1270 and inverter 1272. To enable the registers, the most significant bit of the data byte must be a logic zero, and ENLBEN generated by logic comprising AND gate 1248 and inverter 1249 of FIG. 10 must be "high".

On the C44 clock pulse that is coincident with the C42 clock pulse that enters data into registers 1260 and 1262, flip-flop 1214 of FIG. 9 is set. Following resetting of flip-flop 1203 after the SEL1 line goes "low", NINCEN is again generated to enable loading of register 1209.

On the following C44 clock, the $Q_C$ output of register 1209 of FIG. 10 is set. The $Q_C$ output of register 1209 is fed back as a control input to multiplexer 1208, and after setting of the $Q_C$ output, each output of multiplexer 1208 assumes a "low" state. Accordingly, a logic zero is applied to each input of register 1209. The same C44 clock pulse that clocks register 1209 to set $Q_C$ causes flip-flop 1214 to be reset and disable further clocking of register 1209.

On the next C44 clock following SEL1 going "high" for output by the DMA of the fourth data byte, flip-flop 1203 is again set and LBEN is again generated. ENLBEN of FIG. 10 is also generated, and registers 1260, 1262, 1264 and 1266 are enabled for parallel loading of data. On the next C42 clock pulse, the fourth byte of data from the DMA is entered into registers 1260 and 1262. The third byte of data stored in registers 1260 and 1262 is shifted down into registers 1264 and 1266. The most significant bit of the third byte, available from the $Q_D$ output of register 1264, generates an ID15 indication that data is in the input storage registers and available for routing through multiplexer 1400 to RAM 1350. The C44 clock pulse that occurs simultaneously with the C42 clock that enters the fourth byte of data sets flip-flop 1214 and removes LBEN to prevent further clocking of the data input storage registers.

On the next C44 pulse following transition of the SEL1 line to a "low" condition, register 1209 is again enabled for clocking. On the next C44 clock pulse, the Q outputs of register 1209 assume a "low" state and release the input/output sequence logic for another input sequence operation.

The existence of ID15 indicates that data is in the input buffer registers to be stored in the RAM. Circuitry for presenting a status check is in the timing and control logic shown in FIG. 11.

When an input status instruction (NSTI) is decoded by decoder 1154 and ID15 is a logic one, conditions are set up for the setting of a status flag. The PALX code portion of the internal microcode instruction for doing an input status to check request to input data to the RAM, if any is available, has the PAL1 bit set. PAL1 and ID15 are combined in logic 1158 to generate a signal to be combined with STI as inputs to logic 1160. The output of logic 1160, indicating that the STATUS bit is set, is entered in register 1162 on the next C42 clock. The $Q_A$ output of register 1162 providing the status but is fed back as an input to logic 1160 to maintain the STATUS flag until the next input STATUS check, when it can then be reset.

The STATUS bit from register 1162 and the status store line (STS) from decoder 1152 are applied to NAND gate 1164 in FIG. 11. During a status store instruction, if STATUS is set, OR gate 1166 generates a write enable (NRWEN) signal in response to a logic zero outputted from NAND gate 1164. The NRWEN signal is applied to NAND gate 1168 to generate the write (NRW) signal at the occurrence of the CC2 clock signal. NRW writes the data set up at the RAM 1350 input at the address prescribed by the address code on lines DCA0 through DCA3.

It is in the foregoing manner that data and control information to be utilized during cycles of operation under the direction of the program sequence instruction set are brought into the display processor RAM. Among the necessary pre-operational inputs that must be stored in the RAM are vertical sync max (VSM), vertical sync start (VSS) and refresh start count (RSC). Vertical sync max, vertical sync start and refresh start count are stored in addresses 0000, 0001 and 0100. These three data codes are "constants" utilized in the display processor operation. Vertical sync start determines the vertical size of the simulated page to be displayed.

In addition to the above constants, several "variables" are to be entered in RAM 1350 and utilized in the operation of the display processor under program control. Vertical cursor (VC) and horizontal cursor (HC) provide cursor location data. Vertical cursor and horizontal cursor are stored in the display processor RAM at addresses 0010 and 0011, respectively. Another "variable", refresh memory start address (RMSA), provides data that will determine the refresh memory location from which the display of text will begin. The refresh memory start address is stored at address 0101 of the RAM. Refresh write address (RWA) describes the location in the display memory where character and test manipulative data will be written. Examine refresh address (ERA) allows the DMA to examine the contents of the refresh memory. The examine refresh address is stored at location E (1110) in the display processor RAM.

In addition to a DMA output sequence in which data is outputted for storage in the display processor RAM, the DMA also outputs control data to be stored in test logic 1500 or mode logic 1550. A mode output sequence from the DMA proceeds like a RAM output sequence with the dedicated code 0D being sent to denote an output sequence. The second byte of the sequence, however, is an 80. The second byte of data in the sequence is made available over the DCA lines, with lines DCA0 through DCA3 being applied to decoder 1452 of the test/mode decode logic 1450 shown in FIG. 19. If the four-bit code available over these DCA lines is that for a mode data output, then register 1462 is enabled for clocking by the C41 clock. The next two bytes of data in the sequence, which are available over the DCD0, 1, 2 and 3 lines to register 1462 carry the mode data code. Each bit in the four-bit mode data code is representative of a particular screen condition desired to be set. The control modes are cursor blank, background invert, ten-pitch and sync enable. Cursor blank prevents an output of the cursor. Background invert causes the screened background to be black rather than white. Ten-pitch sets clock generator 1050 to provide a system clock in which each C4X clock pulse cycle is equal to six CP1 clock pulse cycles. Sync enable is an enabling input required to be set after vertical sync max; vertical sync start and refresh start count are loaded into the display processor RAM in order to permit vertical sync to be provided to the CRT display.

The DMA does a test output sequence if a code denoting such is sent during the second byte. A test output code is decoded by decoder 1452 to enable loading of register 1466. In a test output sequence, the code outputted over the DCD0, 1, 2 and 3 lines indicates the particular test function to be performed. Test 1 is a display of vertical bars on the CRT display. Test 2 switches the display to a test mode after verification of sync generation. Test 3 is a cursor input disable signal, and test 4 disables the font memory and displays all white or all black on the CRT screen.

The DMA may also do a clear output sequence in which various portions of the display processor can be cleared of existing data or control codes.

A DMA input sequence, wherein data is transmitted from the display processor to the DMA, proceeds in much the same fashion and utilizes a substantial portion of the same logic circuitry used for a DMA output sequence. A DMA input sequence begins in the same manner as an output sequence, with the DMA outputting a selection signal over the SEL1 line to cause the display processor to accept a first byte of data in registers 1252 and 1254. The eight bit code of the byte of data input to the display processor is decoded by PROM 1206 as an input sequence with the INDEC output thereof going "high". INDEC is applied as an input to AND gate 1226 to establish a "high" output therefrom that is routed through multiplexer 1208 to the D input of register 1209. After the SEL1 line goes "low" and flip-flop 1203 is reset, register 1209 is enabled for parallel loading. On the following C44 clock pulse, register 1209 is loaded and a logic one is established at the $Q_D$ output. The logic one condition at the $Q_D$ output of register 1209 is fed back to the data select input of multiplexer 1208 and also to each of the group B inputs thereof, except B3. The logic one applied to the select input causes multiplexer 1208 to select the group B inputs. This selection results in a logic one condition at each of the inputs of register 1209.

The second byte of data received from the DMA during an input sequence is an eight bit address that is entered in input buffer registers 1252 and 1254. The second byte is made available over the DCA lines with the DCA0 through DCA3 bits being routed through multiplexer 1302 of FIG. 14 and utilized as an address for reading data out of the display processor RAM. The four bits of the code available over lines DCA4 through DCA7 are applied as shown in FIG. 11 to NAND gates 1238, 1240 and 1242. Those gates in combination with OR gates 1244 and 1246 provide the proper conditions on the MUXA and MUXB select lines to cause multiplexer 1400 to output the desired source of data to be inputted to the DMA.

Referring to FIGS. 9 and 10, after flip-flop 1203 has reset, register 1209 is again enabled for loading. On the next C44 clock pulse, each of the Q outputs of register 1209 is set. The set condition on the $Q_C$ output is fed back to multiplexer 1208 to drive all of the multiplexer outputs to a "low" condition and set up a logic zero at each of the register 1209 inputs. Setting of the $Q_B$ output generates the input buffer disable signal to prevent further entry of data into input buffers 1252 and 1254, thereby retaining the second byte of data.

Referring next to FIG. 18, the multiplexer 1400 output lines MI0 through MI13 apply the selected source of data to be outputted to multiplexers 1752 and 1754. The fifteen bits of data are multiplexed to provide for the selection of one byte of data to be inputted to the DMA. The desired byte of data is selected by the code on the DCA4, 5 and 6 address lines as decoded by NAND gate 1762 and OR gate 1764. The selected byte of data is stored in output buffer registers 1756 and 1758 at the first C41 clock pulse following enablement by AND gate 1760. Enabling of the output buffer register for parallel loading occurs during an OUTPUT6 step in the instruction program following a setting of the STATUS bit in register 1162 in FIG. 11. The data to be inputted to the DMA is further routed through devices 1768 and 1770 to transceivers 1256 and 1258 in FIG. 10.

The storing of data in the output buffer registers 1756 and 1758 is indicated by the DAOUTL signal generated by AND gate 1760. The data out signal (DAOUTL) is utilized in the circuitry of FIG. 11 to set the FLAG bit. The existence of a DAOUTL signal is applied through inverter 1170 to OR gate 1172 to set up a logic one at the D input of register 1162. On the following C42 clock pulse, the FLAG bit is set in the $Q_D$ output. The setting of FLAG is maintained by a signal generated by NAND gate 1174 and applied as a second input to OR gate 1172. A logic zero output is required from NAND gate 1174 and is established by feeding back the $Q_D$ output as an input to NAND gate 1174. A further condition to be satisfied is that the input buffer disable line from the $Q_B$ output of register 1209 in FIG. 10 must be "high".

The FLAG bit is applied to PROM 1228 in FIG. 9. The setting of the FLAG bit is decoded by PROM 1228 and enables the output of NAND gate 1217, causing the output request line NREQ6 to go "low" to inform the DMA that data is available to it on the DMA bus.

When the DMA inputs the data available to it from the display processor, the DMA issues an input select signal on the SEL6 select line. Flip-flops 1219 and 1220 synchronize this select line with the display processor clock. AND gate 1222 generates INCEN2 that is applied to NAND gate 1224 in FIG. 10. Issuance of INCEN2 provides the necessary conditions to enable register 1209 to be loaded upon clocking. On the next C44 clock pulse, register 1209 enters the all logic zeros that are set up at the parallel load inputs. Parallel loading of all zeros clears the conditions existing at the Q outputs of register 1209 and allows a new cycle of operation of the input/output sequence logic to take place.

Prior to normal operation of the display processor, and following application of power to the display processor, a power-up sequence is required to initialize the contents of various storage registers and set the required constants that will be needed during normal operational cycles of the display processor. Briefly, a power-up sequence of the display processor would include several DMA output sequences to clear the mode/test decode 1450 and the input buffer 1250 by resetting all Q outputs of both the mode latch and test latch. Next, the required "constants" of vertical sync max, vertical sync start and refresh start count are outputted for storage in the display processor RAM. Finally, sync enable is set to permit normal microcode cycle operation.

A cycle of operation of the display processor under the direction of the program sequence of microcoded instructions involves the execution of one hundred twenty-seven separate steps. Each cycle of operation takes place during one scan line, with each instruction step being executed during one "character time" defined by one cycle of the C4 clock. In describing a cycle of operation of the display processor under the direction of the microcode instruction set, reference will be made to both the drawing figures and to Table I below. Table I is a program listing of the instructions executed during one cycle of operation and includes the PIL and PAL instruction codes for each instruction step.

TABLE I

| Step | Instruction | PILX | PALX |
|---|---|---|---|
| | Display Processor Program | | |
| 0 | LOAD VSC | 0001 | 1000 |
| 1 | OUTPUT VS | 1110 | 0001 |
| 2 | LOAD B RWA | 0011 | 1010 |
| 3 | INPUT STATUS | 1011 | 0010 |
| 4 | LOAD VCC | 0001 | 1001 |
| 5 | COMPEG VCC VC | 1010 | 0010 |
| 6 | OUTPUT VCC | 1110 | 0010 |
| 7 | NO-OP | 0000 | XXXX |
| 8 | INC B | 1100 | 0010 |
| 9 | CLR FWR | 1101 | 1000 |
| 10 | ST B | 0111 | 1010 |
| 11 | NO-OP | 0000 | XXXX |
| 12 | NO-OP | 0000 | XXXX |
| 13 | NO-OP | 0000 | XXXX |
| 14 | NO-OP | 0000 | XXXX |
| 15 | LOAD B ERA | 0011 | 1110 |
| 16 | INPUT STATUS CLR | 1011 | 0000 |
| 17 | OUTPUT 7 (SCP) | 1110 | 0111 |
| 18 | NO-OP | 0000 | XXXX |
| 19 | NO-OP | 0000 | XXXX |
| 20 | LOAD HCC | 0001 | 0011 |
| 21 | OUTPUT HCC | 1110 | 0100 |
| 22 | INPUT STATUS | 1011 | 1000 |
| 23 | INC B | 1100 | 0010 |
| 24 | DATA OUT | 1110 | 0110 |
| 25 | STB | 0111 | 1110 |
| 26 | NO-OP | 0000 | XXXX |
| 27 | NO-OP | 0000 | XXXX |
| 28 | LOAD B RRA | 0011 | 1011 |
| 29 | NO-OP | 0000 | XXXX |
| 30 | LOAD BLINK | 0001 | 1100 |
| 31 | OUTPUT BLINK | 1110 | 0011 |
| 32 | NO-OP | 0000 | XXXX |
| 33 | NO-OP | 0000 | XXXX |
| 34 | NO-OP | 0000 | XXXX |
| 35 | LOAD VCC | 0001 | 1001 |
| 36 | INC A | 1100 | 0001 |
| 37 | STORE VCC | 0100 | 1001 |
| 38 | LOAD VSC | 0001 | 1000 |
| 39 | INC A | 1100 | 0001 |
| 40 | COMPG VSC VSM | 1001 | 0000 |
| 41 | STORE VSC | 0100 | 1000 |
| 42 | LOAD VSS | 0001 | 0001 |
| 43 | STORE/COMP VSC | 0101 | 1000 |
| 44 | NO-OP | 0000 | XXXX |
| 45 | NO-OP | 0000 | XXXX |
| 46 | LOAD RSC | 0001 | 0100 |
| 47 | COMPE RSC = VSC | 1000 | 1000 |
| 48 | STORE/COMP TEMP | 0101 | 1101 |
| 49 | LOAD VSC | 0001 | 1000 |
| 50 | COMPE VSC = VSM | 1000 | 0000 |
| 51 | CLRA | 1101 | 0010 |
| 52 | STORE/COMP VCC | 0101 | 1001 |
| 53 | NO-OP | 0000 | XXXX |
| 54 | NO-OP | 0000 | XXXX |
| 55 | NO-OP | 0000 | XXXX |
| 56 | NO-OP | 0000 | XXXX |
| 57 | NO-OP | 0000 | XXXX |
| 58 | NO-OP | 0000 | XXXX |
| 59 | NO-OP | 0000 | XXXX |
| 60 | LOAD VSC | 0001 | 1000 |
| 61 | OUTPUT VS | 1110 | 0001 |
| 62 | NO-OP | 0000 | XXXX |
| 63 | NO-OP | 0000 | XXXX |
| 64 | ND-OP | 0000 | XXXX |
| 65 | NO-OP | 0000 | XXXX |
| 66 | NO-OP | 0000 | XXXX |
| 67 | NO-OP | 0000 | XXXX |
| 68 | LOAD VSC | 0001 | 1000 |
| 69 | INCA | 1100 | 0001 |
| 70 | COMPG VSC VSM | 1001 | 0000 |
| 71 | STORE VSC | 0100 | 1000 |
| 72 | LOAD VSS | 0001 | 0001 |
| 73 | STORE/COMP VSC | 0101 | 1000 |
| 74 | NO-OP | 0000 | XXXX |
| 75 | NO-OP | 0000 | XXXX |
| 76 | LOAD RSC | 0001 | 0100 |
| 77 | COMPE RSC = VSC | 1000 | 1000 |
| 78 | STORE/COMP TEMP | 0101 | 1101 |

TABLE I-continued

| Step | Instruction | PILX | PALX |
|---|---|---|---|
| | Display Processor Program | | |
| 79 | LOAD BLINK | 0001 | 1100 |
| 80 | INC A | 1100 | 0001 |
| 81 | NO-OP | 0000 | XXXX |
| 82 | STORE/COMP BLINK | 0101 | 1100 |
| 83 | LOAD VSC | 0001 | 1000 |
| 84 | COMPE VSC-VSM | 1000 | 0000 |
| 85 | CLR A | 1101 | 0010 |
| 86 | STORE/COMP VCC | 0101 | 1001 |
| 87 | NO-OP | 0000 | XXXX |
| 88 | NO-OP | 0000 | XXXX |
| 89 | NO-OP | 0000 | XXXX |
| 90 | NO-OP | 0000 | XXXX |
| 91 | NO-OP | 0000 | XXXX |
| 92 | NO-OP | 0000 | XXXX |
| 93 | INPUT STATUS | 1011 | 0001 |
| 94 | STORE/STATUS | 0101 | XXXX |
| 95 | CLR IN | 1101 | 0001 |
| 96 | NO-OP | 0000 | XXXX |
| 97 | INPUT STATUS (PAL4) | 1011 | 0100 |
| 98 | LOAD SPEC | 0010 | XXXX |
| 99 | DATA OUT | 1110 | 0110 |
| 100 | NO-OP | 0000 | XXXX |
| 101 | NO-OP | 0000 | XXXX |
| 102 | NO-OP | 0000 | XXXX |
| 103 | NO-OP | 0000 | XXXX |
| 104 | NO-OP | 0000 | XXXX |
| 105 | NO-OP | 0000 | XXXX |
| 106 | NO-OP | 0000 | XXXX |
| 107 | NO-OP | 0000 | XXXX |
| 108 | NO-OP | 0000 | XXXX |
| 109 | NO-OP | 0000 | XXXX |
| 110 | NO-OP | 0000 | XXXX |
| 111 | NO-OP | 0000 | XXXX |
| 112 | NO-OP | 0000 | XXXX |
| 113 | NO-OP | 0000 | XXXX |
| 114 | STB RRA | 0111 | 1011 |
| 115 | LOAD TEMP | 0001 | 1101 |
| 116 | COMPE TEMP = RSC | 1000 | 0100 |
| 117 | LOAD RMSA | 0001 | 0101 |
| 118 | LOAD B RMSA | 0011 | 0101 |
| 119 | STORE/COMP RRA | 0101 | 1011 |
| 120 | CLRRF | 1101 | 0100 |
| 121 | CLRA | 1101 | 0010 |
| 122 | STORE TEMP | 0100 | 1101 |
| 123 | NO-OP | 0000 | XXXX |
| 124 | NO-OP | 0000 | XXXX |
| 125 | PROGRAM RESTART | 1110 | 0101 |
| 126 | NO-OP | 0000 | XXXX |
| 127 | NO-OP | 0000 | XXXX |

A cycle of operation begins with an instruction to load vertical sync count from the display processor RAM 1350 into the A register 1600. As will be appreciated by reference to the instruction generator circuitry of FIG. 8, in order to provide the necessary conditions for execution of the instruction step, the instruction code bits must be set up in PROM's 1106, 1108 and 1110 ahead of the actual time of execution. Accordingly, on the first step of the new cycle of operation (i.e., step 0), the instruction codes shown in Table I at step 0 are made available to the PROM's and loaded to the register at the completion of step 0. The PIL instruction code is decoded in decoder 1152 and the NLDA output line goes "low", causing AND gate 1608 in FIG. 15 to enable registers 1602, 1604 and 1606 of A register 1600 for parallel loading of data being provided over the memory output lines M0 through M11. The PAL instruction code applied to decoder 1156 is of no consequence, as decode 1156 is disabled by the DCOUTD line from inverter 1155 in FIG. 11. The PAL instruction code is, however, applied through address multiplexer 1302 in FIG. 14 as the RAM address code. The PAL code addresses the "1000" RAM address location to read vertical sync count out and make it available for parallel loading into the A register. On the next C41 clock pulse to registers 1602, 1604 and 1606, vertical sync count is loaded into the A register and made available over the A register output lines AR0 through AR11.

Referring next to FIG. 12, the contents of the A register is applied to logic comprising AND gates 1176, 1178 and PROM 1180. This combination logic transforms the vertical sync count code into a vertical sync indication on the VSS output line of PROM 1180. The VSS indication is set up at the D input of register 1182.

The next instruction step is that of outputting vertical sync. In order to execute this instruction, the proper instruction code from instruction generator 1100 must be generated during the previous instruction. Accordingly, the instruction codes for enabling execution of the vertical sync output instruction are set up during the previous instruction step. Therefore, during the loading of vertical sync count and the translation thereof by PROM 1180, docoder 1156 is decoding the PAL instruction code to generate NDCOUT1 and enable parallel loading of register 1182 at the occurrence of the next C41 clock pulse, which designates the vertical sync output instruction time. The PIL instruction code is an output code that causes decoder 1154 to output a "low" condition on the DCOUTD output line for enabling decoder 1156.

The existence of the "high" condition at the $Q_D$ output of register 1182 signifies the existence of vertical sync. To verify that vertical sync has been generated, the $Q_D$ output of register 1182 is applied to one-shot 1184 shown in FIG. 12. One-shot 1184 generates a sync available indication indicating that both horizontal and vertical sync are running. Accordingly, in addition to vertical sync, one-shot 1184 receives the output of another one-shot 1186 that indicates the existence of horizontal sync. The horizontal sync available indication is generated by one-shot 1186 in response to the horizontal sync pulse (HSP) from PROM 1116 in the instruction generator.

The next instruction step is to load B register with a refresh write address for output to the refresh memory. In order to load the B register, the condition for executing that instruction must be set up in PROM 1108 during the character time in which vertical sync is being outputted. The PIL instruction code for a B register loading instruction is decoded in decoder 1152, with the $Y_3$ output line therefrom going "low". The NLDB signal generated on the $Y_3$ output line is applied to registers 1702, 1704, 1706 and 1708 in FIG. 16 to enable these devices to parallel load data available over the RAM output lines M0 through M12. Decoder 1156 is not enabled so the PAL instruction code does not generate an output instruction. The PAL code is, however, applied through multiplexer 1300 and is utilized as the RAM address code to read the refresh write address out of RAM 1350. On the next C41 clock pulse, defining the B register loading instruction, the refresh write address read out of memory is loaded into the B register and made available over B register output lines BR0 through BR12.

The Step 3 instruction is to do an input status check for a pending write signal to store data in the refresh memory. To perform this instruction, conditions are set up in PROM 1108 during the time that register B is being loaded. The PIL instruction code is decoded in decoder 1154 with the $Y_3$ output line thereof providing the signal in STI going "low". In response to the "low" condition on STI, inverter 1157 supplies a logic one to AND/OR logic 1160. The second input from logic 1158 is made in accordance with the conditions on the write request (NWRITEREQ) input received through inverter 1159. If the second bit position (PAL2) of the PAL instruction code is a logic one, and a write is requested, the output of logic 1158 will result in a setting of the STATUS bit on the next C42 clock pulse applied to register 1162.

The write request indication is obtained from register 1205 through inverter 1207. Conditions for establishing a write request in register 1205 is through a decoding by NAND gate 1236 of the existence of a DMA output sequence in which the DMA has indicated that the output sequence is to provide data to be written into the refresh memory. A write request is maintained in register 1205 by logic comprising NAND gate 1235 and OR gate 1237 that serves to feed back the write request signal from the $Q_A$ output of register 1205 to the A input thereof.

If STATUS is set indicating that data to be written into the refresh memory is available over the DM lines from input buffer registers 1252 and 1254, NAND gate 2720 in FIG. 25 generates a signal to write data into the refresh memory address loaded into the B register during the previous instruction step. Both STATUS and NCURADD, which indicate that the DMA output signal has not been one of mode or test data, sets up condition for the generation of NWRITER when COSW goes "high".

Loading of the vertical cursor count in the A register is the next instruction to be performed. The conditions for executing this step in the program routine are set up in PROM 1108 ahead of time with the PIL instruction code generating a load enable signal from decoder 1152 that is applied to registers 1602, 1604 and 1606 through AND gate 1608. The PAL instruction code addresses RAM 1350 to output from address location "1001" the stored vertical cursor count. At next transition of the C41 clock, vertical cursor count is parallel loaded into the A register.

The following step in the display processor cycle of operation is that of comparing the vertical cursor count stored in the A register with the vertical cursor stored in the display processor RAM. To perform this comparison, the PIL instruction code is decoded, causing the $Y_2$ output line of decoder 1154 to go "low". The NCPEG output line from the $Y_2$ output causes OR gate 1820 in the comparator logic of FIG. 17 to provide a logic one input to NAND gate 1818 and OR gate 1814 to provide a logic one input to NAND gate 1812. The PAL instruction code is utilized as an address to RAM 1350 to read out the value of vertical cursor. The vertical cursor count available over the AR lines and the vertical cursor available over lines M0 through M11 from the RAM are compared in comparators 1802, 1804 and 1806. The results of the comparison for an "equal to" or "greater than" condition are provided over lines 1808 and 1810. If the comparison indicates that vertical cursor count is either "equal to" vertical cursor or "greater than" the vertical cursor number, OR gate 1816 generates a logic one condition that allows flip-flop 1824 to be set on the next C41 clock pulse. The setting of flip-flop 1824 provides a comparison signal over the COMP line. The compare bit (COMP) is maintained during subsequent clocking of flip-flop 1824 by feeding back the Q output of flip-flop 1824 through NAND gate 1822 and OR gate 1816 to the D input of the flip-flop. The compare indication is also applied as an input to NAND gate 1167 in the portion of the instruction decode logic shown in FIG. 11.

After comparing the vertical cursor count with vertical cursor, the program calls for the vertical cursor count to be outputted. The step of outputting the vertical cursor count involves the generation from decoder 1156 of an NOUT2 signal that is applied, along with the COMP output, to AND gate 4364 to enable counter 4360 in the cursor generator of FIG. 33 to be incremented by the C42 clock.

Following vertical cursor count output, a step involving no operation is stepped through. The following instruction is that of incrementing the refresh write address count being maintained in the B register. To execute an incrementing of the B register, the instruction generator outputs a PIL code that is decoded as an increment instruction output as NINC from decoder 1154. Inverter 1161, in response to a "low" condition on the $Y_4$ output of decoder 1154, presents a logic one to AND gate 1163. Since incrementing of the B register is called for by the instruction, the second bit of the PAL instruction code is set, presenting a logic one to NAND gate 1715. The other condition necessary for a signal to increment the B register is that STATUS be set. The output of NAND gate 1715 is applied to OR gate 1716 in FIG. 16 to enable clocking of counters 1702, 1704, 1706 and 1708 by the C41 clock.

After the B register has been incremented, an instruction is issued to initiate a clear refresh write. To perform the instruction, the PIL instruction code upon being decoded causes $Y_5$ output of decoder 1154 to go "low" and issue the NCLR signal that is applied through inverter 1197 to one input of NAND gate 1190 in FIG. 11. The PAL8 bit of the PAL instruction code is applied as the second input to NAND gate 1190 and is required to be set in order for a clear refresh write instruction to be executed. The remaining condition necessary to the issuance of the signal NCLRFWR for a clear refresh write is that STATUS must be set. If a write condition has been established, STATUS will be set, and the output of NAND gate 1190 will go "low". NCLRFWR is applied to NAND gate 1235 in FIG. 9, resulting in the establishment of a logic zero at the A input of register 1205. At the next C44 clock pulse, the $Q_A$ output of register 1205 is cleared, removing the write request indication.

Step 10 is an instruction to store the refresh write address in the B register back in RAM 1350. The refresh write address has been incremented to become a new refresh write address if data was written into the refresh memory. Storing of the contents of the B register involves routing the output thereof back to the RAM input through multiplexer 1400. Accordingly, as the clear refresh write instruction is being executed, the instruction generator provides a PIL instruction code to cause multiplexer 1400 to select the BR inputs from the B register. To accomplish the change in selection of the data source to be outputted by multiplexer 1400, decoder 1152 decodes the PIL instruction code and provides a "low" condition on the $Y_7$ output that provides NSTB. A logic zero on NSTB causes OR gate 1246 to set the MUXA=1. As decoder 1156 is not enabled for output, DCOUT6 is a logic zero and maintains the output of NAND gate 1238 at a logic one. Logic one condition at each input of OR gate 1244 maintains the MUXB=0. With MUXA=1 and MUXB=0, multiplexer 1400 selects the data on the BR lines connected to the B register for routing to RAM 1350. The PAL instruction code is utilized in a STORE B instruction to provide the RAM address location at which the B register data is to be written.

The $Y_7$ output of decoder 1152, indicating that a STORE B instruction is to be executed, is also applied to OR gate 1166 to set a write enable condition at NAND gate 1168. The strobe signal for writing the B register contents into RAM 1350 at the designated address location takes place at the occurrence of the CC2 clock, with the strobe being generated at the output of NAND gate 1168.

Instruction Steps 11 through 14 of the program are no-operation steps that the display processor goes through. Instruction Step 15 is that of loading the B register with the examine refresh address from the display processor RAM. Conditions for executing this instruction are set up in PROM 1108 during execution of Step 14. The PIL instruction is again decoded by decoder 1152 to enable parallel loading of B register 1700. The PAL instruction code provides the necessary read address to RAM 1350. The B register loads the data read out of memory at the occurrence of the C41 clock pulse.

The program instruction that follows is an input status clear step to "clear" the STATUS bit. To clear the STATUS bit, the instruction generator 1100 outputs a PIL instruction code that causes the $Y_3$ output of decoder 1154 to go "low". The PAL instruction code output by the instruction generator 1100 assigns a logic zero to each PAL bit, causing logic 1158 to output a logic one which results in the output of logic 1160 being a logic zero. At the next C42 clock pulse received by register 1162, the logic zero at the output of logic 1160 is entered and causes the $Q_A$ output to be reset and STATUS cleared.

The instruction program next executes an instruction to generate a start cycle pulse (SCP). Decoder 1156 enabled by the $Y_6$ output of decoder 1154 decodes the PAL instruction to output a "low" condition on the $Y_7$ output. The NDOUT7 signal available from the $Y_7$ output of decoder 1156 is applied to the A input of register 1199 shown in FIG. 12. The following C42 clock pulse enters the data bit and resets the Q output. The start cycle pulse is generated by inverter 1191 in response to the resetting of the $Q_A$ output of register 1199. The $Q_A$ output of register 1199 is fed back to the B input in order that the next C42 clock pulse will generate a load line space signal at the output of inverter 1189.

The start cycle pulse is utilized as a timing pulse set to occur just prior to the operation of reading out of text buffer 2400 in the display refresh memory logic 2000. The complement of start cycle pulse (NSCP) is applied to read counters 2610 and 2620 of the read/write address logic shown in FIG. 23. The start cycle pulse signal enables parallel loading of counters 2610 and 2620 to a count of zero at the occurrence of the following C44 clock pulse. Accordingly, the start cycle pulse serves to clear the text buffer read address counters 2610 and 2620 and initialize them for proper counting. The start cycle pulse is further utilized in the D register logic 3100 shown in FIG. 26, wherein it is applied to NAND gate 3212 and serves to generate the D register clear signal.

Steps 18 and 19 of the instruction program are no-operation steps. Step 20 is an instruction to load the horizontal cursor count from the display processor RAM into the A register. Loading of the A register during Step 20 proceeds in the same fashion as described previously with regard to loading of vertical cursor count and will therefore not be discussed in detail.

Step 21 is an instruction to output the horizontal cursor count into cursor generator 4300 shown in FIG. 33. The OUTPUT HCC instruction is one in which counters 4310, 4320 and 4330 of the cursor generator are preset by parallel loading the complement of the horizontal cursor count. The horizontal cursor count is made available to counters 4310, 4320 and 4330 from A register 1600 through multiplexer 1400. Accordingly, after loading of the horizontal cursor count into A register 1600, the horizontal cursor count is made available to the cursor generator logic a short time thereafter. Loading of counters 4310, 4320 and 4330 occurs in response to a horizontal cursor count load enable signal (HCCL) from NAND gate 4332. The instruction generator 1100 outputs a PIL instruction output code enabling decoder 1156. The PAL instruction code causes decoder 1156 to provide a "low" condition at the $Y_4$ output, with DCOUT4 being generated in response thereto. DCOUT4 is set up as one input to NAND gate 4332. The second input is that of the CC4 clock and upon its occurrence, the horizontal cursor count load enable signal is generated. At the following CP2 clock pulse, the horizontal cursor count is loaded into counters 4310, 4320 and 4330.

The display processor is next instructed by the program to perform an input status to check for the need to do an output back to the DMA. The existence of a request by the DMA for data, as indicated by a DMA input sequence code, will be decoded by logic 1158 in FIG. 11. The necessary conditions require that AND gate 1149 decode the existence of a DMA input sequence being performed and that bit 7 of the address stored in buffers 1252 and 1254 be set. An input status check for a request to send data back to the DMA is enabled if the PAL8 code is set. If a DMA input sequence is indicated, logic 1158 issues a status enable signal to logic 1160 that is combined with an input status control signal from decoder 1154 to permit register 1162 to set STATUS at the occurrence of the next C42 clock pulse. Setting of the status bit readies AND gate 1760 in the data output buffer logic of FIG. 18 for issuance of the data out (DAOUTL) signal that enables output buffer registers 1756 and 1758 for operation as has been previously described in detail.

Before doing an instruction to output the data, the program executes an instruction to increment the examine refresh address contained in the B register. Incrementing of the B register is in accordance with the procedure outlined previously with regard to incrementing of the B register during instruction Step 8. The time period during which the B register is being incremented is also necessary to provide time for data to be set up at the inputs of the output buffer registers.

The next instruction is that of generating a data output load enable signal from AND gate 1760 in FIG. 18. The DCOUT6 signal input to AND gate 1760 is provided by decoder 1156.

The program next executes an instruction to store the updated contents of the B register. Storing of the updated examine refresh address into RAM 1350 proceeds in the same fashion as Step 10 of the program in which the updated refresh write address was stored back in the RAM. Accordingly, no detailed discussion of program Step 25 is believed necessary.

Steps 26 and 27 are no-operation steps that are followed by an instruction to load the B register with the refresh read address stored at address location "1011" in the display processor RAM. The program continues with a no-operation step, and at instruction Step 30, the A register is loaded with a blink indication from RAM address location "1100".

The next step is an instruction to output blink. The execution of a blink output instruction involves the decoding of the PIL and PAL instruction codes by decoders 1154 and 1156. In an output blink instruction, the $Y_3$ output of decoder 1156 goes "low", causing inverter 1147 to output a logic one to AND/OR logic 1145. If the blink data set in the A register provides a logic one over the AR4 line, logic 1145 will provide an output to register 1143 to be entered at the next C42 clock pulse indicating that blink is to be reset. The blink indication is provided to RAM 2418 of the text buffer circuitry shown in FIG. 24 to enable the RAM to enter the blink indication provided from the control code decoder logic shown in FIG. 22.

After the output blink instruction, the program requires three no-operation steps followed by an instruction to load the A register with vertical cursor count. The next instruction is to increment the vertical cursor count, with the updated count being stored back in the display processor RAM as the next instruction. Vertical sync count is then loaded into the A register and incremented.

The instruction to compare vertical sync count with vertical sync max involves the output by decoder 1154 of a "low" condition on its $Y_1$ output. The NCPG signal available over the $Y_1$ output line is applied to OR gate 1814 of the comparator logic shown in FIG. 17. OR gate 1814 establishes an enabling input to NAND gate 1812 to be combined with the signal available from comparators 1802, 1804 and 1806 over the "greater than" compare line 1808. The instruction codes are utilized to read vertical sync max out of the display processor RAM for comparison with the updated vertical sync count. If vertical sync count is greater than vertical sync max, a logic one is outputted over line 1808 to NAND gate 1812, resulting in a setting of COMP at the next C41 clock pulse.

Following the comparison of vertical sync count and vertical sync max, the vertical sync count is stored in the display processor RAM. On the next program step, vertical sync start is loaded into the A register from the RAM. The next instruction in the routine stores vertical sync start into vertical sync count. If the comparison indicates that vertical sync start is either "equal to" or "greater than" vertical sync max, vertical sync start will be written into the RAM as the next program instruction. If, however, vertical sync start is less than vertical sync max, the store/compare step that follows is a no-operation step.

The step of storing vertical sync start if it is greater than or equal to vertical sync max involves decoding the PIL instruction code to provide a signal on the $Y_5$ output of decoder 1152 indicating that a "store if compare" instruction is to be performed. The $Y_5$ output is inverted in inverter 1165 and applied as one input to NAND gate 1167. The other input is the COMP bit from flip-flop 1824 in the comparator logic. If the value of vertical sync start stored in the A register is less than vertical sync max, the COMP bit is a zero and a write strobe is not generated. However, if the COMP bit is a logic one, NAND gate 1168 is enabled for generating a write strobe signal at the occurrence of the CC2 clock.

Display processor operation under the program continues with the loading of refresh start count into the A register, followed by a comparison of refresh start count with vertical sync count to determine if the two values are equal. The comparison is made in comparator 1800 with vertical sync count being read out of memory and made available to comparator 1800. Decoder 1154 issues signal NCPE from the $Y_0$ output that is applied to OR gate 1820. If the refresh start count number in the A register equals the value of vertical sync count, a logic one on line 1810 combines with that available from the output of OR gate 1820 to result in the setting of the COMP bit. If the comparison indicates that the two members do in fact compare, the refresh start count is stored at temporary address location "1101" in RAM 1350.

Next, vertical sync count is loaded into the A register and compared to vertical sync max to determine whether the two numbers are equal. After the comparison is made in Step 50, an instruction to clear the A register is executed. The A register is cleared by outputting a logic zero over the CLRA line connected from the output of NAND gate 1192. Conditions for generating CLRA are that decoder 1154 must decode the PIL instruction code to output a "low" condition on the $Y_5$ output. In response to the "low" condition, inverter 1197 applies a logic one to AND gate 1196, and at the occurrence of a CC4B clock pulse, a pulse is generated that is applied as an input to NAND gate 1192. PAL2 of the PAL instruction code is set as an enabling input to NAND gate 1192 for the generation of the CLRA signal.

If the comparison of vertical sync count has indicated that it is equal to vertical sync max, an instruction to store the contents of the A register in the display processor RAM at the address "1001" location corresponding to vertical cursor count is performed. Since the A register has been cleared, the number stored as a vertical cursor count is zero.

Following no-operation Steps 53 through 59 of the program, vertical sync count is again loaded into the A register, and vertical sync is outputted as the next step. Execution of these two instructions corresponds to the operation followed in Steps 0 and 1 that began the cycle of operation. The program continues with no-operation steps through Step 67. At Step 68, vertical sync count is again loaded into the A register and is incremented during the following step. A comparison is performed to determine whether vertical sync count is greater than vertical sync max. Thereafter, vertical sync count is stored in the display processor RAM.

Vertical sync start is again loaded into the A register. As the next instruction, vertical sync start is written into the RAM at the vertical sync count address location if vertical sync count in the comparison made during Step 70 has indicated that vertical sync count is in fact greater than vertical sync max. No-operation steps follow until program instruction Step 76 is reached. There it is directed by the program that refresh start count be loaded into the A register. A comparison is made during instruction 77 to determine whether refresh start count equals vertical sync count. If there is a comparison during the next program step, refresh start count is stored in the temporary address location in the RAM.

The cycle of operation continues with a load blink instruction again being performed. The A register is next incremented, followed by a no-operation step.

If the previous comparison in Step 77 of refresh start count to vertical sync count set the comparison bit, then during the next instruction, Step 82 in the routine, the contents of the A register are stored in the RAM.

Vertical sync count is again loaded into the A register and a comparison with vertical sync max is made. Afterward, the A register is cleared to all zeros. The all zeros contents of the A register are stored in the RAM at the address location for vertical cursor count if the comparison of vertical sync count with vertical sync max has resulted a finding that the two values are equal.

Program Steps 87 through 92 are no-operation steps. The following three Steps 93 to 95 constitute an input status sequence in which the input buffer is checked to see if there is data to be written into the RAM. If STATUS is set, a write is made to store data in the RAM, and the input buffer is cleared. The sequence begins with an input status check to determine if input buffer registers 1250, 1262, 1264 and 1266 contain data. The ID15 signal applied to logic 1158 in FIG. 11 provides an indication as to whether data is present. If data is present in the input buffers, the STATUS bit is set. During the next program step, the contents of the input buffer registers are stored in the display processor RAM at the designated address location. The concluding step in the sequence is the generation of a clear signal to erase the contents of the input buffer registers. The clear signal is derived from logic including NAND gates 1193 and 1195 in FIG. 11. The output of AND gate 1195 is applied via the CIN output line directly to each of the input buffers in FIG. 13.

After no operation during program Step 96, another input status sequence is executed during Steps 97 through 99. The input status sequence is executed during Steps 97 through 99. The input status sequence executed is that of determining whether data is to be sent back to the DMA. If the input status check indicates that data is to be input to the DMA from the display processor, with such determination being made in accordance with the operation outlined in the discussion regarding program Step 22, STATUS is set.

The next sequence of steps is that of doing a special loading of the A register. A load A special indication is provided from the $Y_2$ output of decoder 1152 and is applied to OR gate 1198. The output of OR gate 1198 shifts the selection of multiplexer 1302 from a PAL code address to the DCA0 through DCA3 lines, as was the case during the store status instruction of program Step 94. After RAM address multiplexer 1302 has been shifted to provide for addressing of the display processor RAM by the DCA lines, the next step is that of generating a data out signal to load the desired byte of data to be transmitted to the DMA into the output buffer registers.

The display processor between Steps 100 and 113 of the program runs through a period in which no operations take place. Operational steps again commence at program instruction Step 114 with the contents of the B register previously loaded with the refresh read address during Step 28 being written back into the display processor RAM. The program continues with the A register being loaded with data from the temporary address location in the display processor RAM. At the temporary location in the RAM is refresh start count. To ascertain whether the contents of the temporary location is indeed the value of refresh start count, a comparison is performed during the next program step to compare the two values. Refresh memory start address is loaded during the next two program steps into both the A register and the B register. If there is a comparison between the value of refresh start count stored at the temporary location and its actual value, the refresh memory start address loaded into the A register is stored in the RAM at the refresh read address location.

The next two program steps are those of clearing the character counters shown in the circuitry of FIG. 25 and clearing the A register. The all zeros contents of the A register, following it being cleared, are written into the temporary address location in the RAM during the next step to clear the temporary address location of data previously written there.

The display processor program routine concludes with two no-operation steps followed by an output instruction to reset counters 1102 and 1104 in the instruction generator and two no-operation steps. The signal to reset the program counters is generated from the $Y_5$ output of decoder 1156. The signal is obtained from decoder 1156 and applied to counters 1102 and 1104 to provide a load enable input to preset the counters to the count code set up at the parallel load input. The next C42 clock that occurs presets the counters during Step 126 of the program. At the next C42 clock, corresponding to Step 127 of the program, the PIL and PAL instruction codes generated by PROM's 1106 and 1108 are entered into and provided as outputs from registers 1112 and 1114. The PIL and PAL instruction codes are those for setting up the conditions that are necessary for execution of step O of the following cycle of operation of the display processor.

The foregoing discussion of the display processor operation under the direction of the program of instructions listed in Table I is primarily related to and carried out by the timing and control logic. Operation of the display refresh memory portion, the character generator portion and the video register portion takes place on more of a continuous basis, rather than on a periodic cycle of operation basis, like the timing and control logic. The operation of the refresh memory, the character generator and the video output circuitry involves the forming of the video data signals for producing character images on a raster scan CRT display.

Operation on the display refresh memory 2000 involves both a write cycle and a read cycle. The write cycle is executed during specified program routine instructions. With reference to Table I, a write cycle of the display refresh memory involves basically Steps 2 and 3 of the program. Program Step 2 is that of loading the B register with the current refresh write address from RAM 1350. Program Step 3 involves an input status check to determine if a write request is set, whereupon STATUS is set enabling NWRITER to be generated. The input status check, as will be recalled from the previous discussion of Step 3, sets STATUS if the DMA had indicated that a DMA output sequence is being done with data to be written into the refresh memory being made available over the bus. The refresh write address that is set into the B register during program instruction Step 2 is an address that has been updated through incrementing of the B register from an initial refresh memory write address.

The refresh write address set in the B register contains both row and column address codes for addressing of the refresh memory cells. Accordingly, the B register output lines are multiplexed through multiplexers 1722 and 1724 to alternately provide the row address and the column address. The row address is available over lines BR0–BR5. The column address is carried on lines BR6–BR11. The RA121 and RA122 output lines decoded from the BR12 line and a hardwired logic one, depending upon whether the row or column address is selected, provide signals for selecting the group of memory cells 2102–2116 or selecting the group of memory cells 2118–2132.

Multiplexers 1722 and 1724 are controlled by address logic register 2202. The RFTEN signal available from the instruction generator and the timing and control logic is input as an enabling signal to register 2202 to permit parallel loading at the occurrence of the C44 clock. When RFTEN is "low", the C44 causes a right shifting of a serially input logic condition. As the serial input to register 2202 is tied to ground potential, each C44 clock pulse occurring when RFTEN is "low" causes a "low" condition to be entered into the $Q_A$ register position and right shifted toward the $Q_D$ output. The relation of RFTEN to the C44 clock is that RFTEN is "low" for four cycles of C44 and is "high" for two cycles of C44.

The $Q_B$ output of register 2202 is applied through inverter 2204 to multiplexers 1722 and 1724 in FIG. 16A. The NCOS signal is utilized to select between the row address code and the column address code for application over the RA lines. The select signal NCOS is "low" for three C44 clock periods and is "high" for three C44 clock cycles.

When RFTEN goes "high", the next C44 clock pulse loads all ones into register 2202, presetting all Q outputs. After RFTEN goes "low", the first C44 clock pulse enters a zero into the serial input of register 2202 causing $Q_A$ to be reset. The output from $Q_A$ is applied to the RAM memory cells to enable addressing of the cells with the row address code. The row address is selected through multiplexers 1722 and 1724 by virtue of the "low" condition of NCOS. At the next C44 clock, register 2202 shifts right, and the $Q_B$ output is reset. The output of inverter 2204 is changed to its opposite state, and the column portion of the refresh write address available from the B register is selected by multiplexer 1722 and 1724 for submission to the RAM memory cell. At the next C44 clock, $Q_C$ is reset with its transition to a "low" condition acting to strobe data into the selected bank of memory cells at the indicated address location. Since NWRITER has already been shifted to the "write level", the column address select (NCAS) signal causes the data to be written into the memory cells.

At the next C44 clock pulse, the $Q_D$ output is reset, and refresh strobe signal (REFSTROBER) is generated from inverter 2138. Since a write cycle is being done, REFSTROBER really has no significance. Although a parallel load of the memory cell outputs available over the RM lines into buffer registers 2134 and 2136 takes place at the end of the write cycle, only random bit patterns are entered. The random pattern entered into registers 2134 and 2136 propagates through the translator, but since COSW is designating a write cycle, timing for writing data into the text buffer is disabled, and the random patterns sit in the registers until erased during the read cycle that takes place following step 28 of the program routine.

A read cycle of the refresh memory is initiated at Step 28 of the display processor program routine. At instruction 28, the B register is loaded with a refresh read address that is applied to the selected group of memory cells in the same fashion as the row and column addresses are applied during a write cycle. The data word read out of the refresh memory is latched in registers 2134 and 2136 at the occurrence of REFSTROBER generated at the $Q_D$ output of register 2202 and applied through inverter 2138. The stored data word is made available from the refresh memory registers 2134 and 2136 over lines ROB0 through ROB7. Translator 2300, shown in FIG. 21, alters the ASCII character code into a modified ASCII character code unique to the display processor. Translator 2300 also ascertains whether the data word read out of memory and stored in the memory registers is character data or control data. The conversion of the ASCII data is to a code that is compatible with the font memory in the character generator.

Referring briefly to FIG. 25, as character code words are read from the refresh memory, counters 2710 and 2712 count the characters that have been outputted from the memory. The counters are each four-bit counters that are preset by parallel loading a hardwired input code set up at the parallel load inputs. As each text line is to contain not more than "117" characters, therefore counters 2710 and 2712 are preset to a binary count equal to "213" such that after "117" characters have been read out of memory and counted, the $Q_D$ output of counter 2712 supplying the READOK signal will be reset. The counters are counted up by the C44 clock.

As counters 2710 and 2712 are to count only the characters or mode data read out of the refresh memory, the counters must be disabled from counting when a NO-OP code is read out. Accordingly, the count enable inputs on counter 2710 are controlled by AND gate 2714 in conjunction with NAND gate 2716 in FIG. 23. If a data word has been read out of memory, as indicated by the existence of STROBED, and if the data word has not been decoded as a NO-OP code, as detected by NAND gate 2716, the read enable (READEN) signal from the output of AND gate 2714 enables counters 2710 and 2712.

If the data word read out of the refresh memory is a control word, the NCONTROL line from PROM 2360 will go "low" to so indicate, and CT1, CT2 or OVP will be generated from PROM 2360 to permit the desired control code to be decoded and stored in registers 2502 and 2504 and remains there until cleared by removal of the control code when there is a different control code to be entered or upon the existence of a new start cycle or refresh clear. The control codes that are latched in registers 2502 and 2504 relate to any character that is subsequently read out of the refresh memory until the control code is cleared.

The control code available from the control code decoder 2500 of FIG. 22 and character data words read from memory and made available from translator 2300 over the RO0 through RO7 lines are applied as input data words to be written into the text buffer 2400. The text buffer 2400 accepts sixteen bits of data and contains the modified ASCII character code words plus the mode data. The sixteen RAM's are 256×1 high-speed bipolar RAM's that are arranged to accommodate the storage of two complete text lines of data of "102" characters per text line. The text buffer outputs character and mode data to the character generator at the rate of one character every C4 clock cycle (i.e., 173 nanoseconds). The text buffers are operated such that data is written into the text buffer RAM's during the first half of a character time (86 microseconds), and data is read out during the last half of the character time.

The timing sequence for writing data into the text buffer is performed by the logic shown in FIG. 25. Addressing of the text buffer RAM's is done by the read/write address logic shown in FIG. 23. After data is read out of the refresh memory as indicated by the condition of COSW, data is written into the text buffer during a timing sequence started by the REFSTROBER signal. Provided a read of the refresh memory has been done, and data has been stored in the refresh memory buffers, and the character count has not yet reached "117", AND gate 2704 sets up a logic one at the A input of register 2708. At the next C44 clock pulse, the $Q_A$ output is set generating STROBE. The $Q_A$ output of register 2708 is fed back to the B input and at the next C44 clock, the $Q_B$ output is set generating STROBED. If the data word read out of the refresh memory is control mode data, STROBED causes the control mode data to be latched in registers 2502 and 2504. If the data word is not control mode data, the generation of STROBED will cause NAND gate 2706 to output a logic zero to the C input of register 2708. The output of NAND gate 2706 is also fed through inverter 2709 to generate TBWPE, which is routed through flip-flop 1076 in FIG. 7 to generate NWRITETB used to set the text buffer RAM's for a write cycle. On the next C44 clock, the $Q_C$ output of register 2708 is reset, and ITBWA is generated from inverter 2707. Also, the $Q_D$ output of register 2708 is set by virtue of the introduction to the D input thereof of the STROBED signal from the $Q_B$ output.

Addressing of the text buffer RAM's for a read or a write function is by an address code outputted over the TBA lines. Both a read address and a write address are generated in the logic shown in FIG. 23. The read and write addresses are multiplexed through the AND/OR select logic gates that output to the TBA lines. Selection of the read address or the write address through the selector logic gates is controlled by the write address select lines TBW and NTBW that are derived from OR gate 1075 and AND gate 1704 in the clock generator circuitry of FIG. 7. The outputs of both AND gate 1074 and OR gate 1075 are dependent upon the NCC1 clock from the $\overline{Q}$ of flip-flop 1060. This clock is one-half of the 28 MHz CP1 clock and causes shifting of the TBW and NTBW logic levels each character time. Alternating of the text buffer write address select lines at the rate of the CC1 clock provides both a write and a read within one character time.

The address for a text buffer read is derived from counters 2610 and 2620 and from counters 2630 and 2640 for a text buffer write. The read counters are reset at the beginning of a scan line by the start cycle pulse and are incremented each character time by the C44 clock. At the end of a scan line, the program routine at instruction Step 125 resets the read counters. The write counters are also incremented by the C44 clock but are only enabled during ITBWA from inverter 2707 if the last data word read out of the refresh memory has been a character code data word. The write counters are preset by the NMEML signal derived from AND gate 2718 in FIG. 25. The write counters are reset if either a start count occurs or a refresh clear is instructed. If a refresh clear is instructed, the write counters are preset to a condition wherein the most significant bit of the write address is a one and all lesser bits are zeros. If a refresh clear is not being executed, the counters are preset to a "clear" condition by the starting of a cycle.

Operation of the character generator logic proceeds upon a continuous basis with data being received into the D register thereof during read cycles of the text buffer. The D register is loaded every character time and contains both the modified ASCII code and the control mode data.

Data bits inputted to the D register over text buffer output lines ASCII1, 2 and 3 are also provided as inputs to line spacing register 3220. The first character outputted at the beginning of every text line is a code word containing line spacing information. Line spacing data bits are loaded into register 3220 by the C43 clock. Register 3220 is enabled by a signal derived from the load line space signal (NLLS) generated at the $Q_B$ output of register 1199 in FIG. 12 immediately following the generation of a start cycle pulse. The load line space signal (LLS) from inverter 1189 is routed through multiplexer 3260 in the text line control logic of FIG. 27 and then applied to register 3220. ASCII0 and ASCII1 provide a two-bit line spacing code that is entered into register 3220 and made available as code bits NLS0 and NLS1. A "01" code corresponds to single-spaced text lines. A "00" or "10" code designates space and one-half text lines, and a "11" code specifies double-spaced text lines.

Scan line counters 3230 and 3240 count the number of scan lines traced in a text line. The scan line count is routed through multiplexers 3250 and 3260 to PROM 3222 for comparison with the number of scan lines required for the spacing that has been specified by the line spacing code stored in the line space register. When the scan line count from counters 3230 and 3240 equals the number of scan lines required for the specified line spacing, the NSLCLP signal from PROM 3222 presets the text line counters to zero and a new text line begins.

The ASCII2 code bit applied to the D input of line spacing register 3220 provides for the expansion of the video display by a factor of two in the vertical axis. If the ASCII2 bit is a logic one, the $Q_D$ output of register 3220 is set and ZOOM is generated. The ZOOM signal causes a change in selection of input signals that are routed through multiplexers 3250 and 3260. The multiplexers effect a division by two of the number of counted scan lines by shifting the scan line counter output lines over one position to the right. Accordingly, the display processor will output to the CRT display two scan lines of a particular dot pattern rather than one scan line of that dot pattern, resulting in a text line of characters that is twice the normal size.

The D register is actually provided to serve as a holding register to delay the data handled therethrough by one character time prior to actual introduction to the video output circuitry. The reason for the delay is that a certain amount of time is necessary for the text line decode logic to set itself up for providing for a subscript or superscript notation. When a subscript of superscript notation is to be displayed, the character data is in effect shifted up or down within the text line. To accomplish a vertical shifting of a character, it is necessary to output the scan line dot pattern comprising the character sooner or later than it would be outputted if the character were to be a nonscripted character.

Altering the time of output of the dot patterns for a subscripted or superscripted character is accomplished by the text line control logic through the modification of the scan line count available from counters 3230 and 3240. The count from the scan line counters is applied as a portion of an address to PROM 3270. Another portion of address code bits is comprised of the control bits identifying whether a subscript or superscript is to be performed. The ability to do subscripts and superscripts is also dependent upon the particular line spacing chosen. Therefore, the line spacing bits NLS0 and NLS1 are also part of the address applied to PROM 3270. The PROM modifies the actual scan line count based on the address code and outputs over the TE lines a fictitious scan line count. Therefore, if the character in the D register is to be superscripted, the modified scan line count brings the dot patterns for that character out sooner to effect an upward shift of the character. Accordingly, for example, rather than a scan line zero, which is displayed as background, a scan line three would instead be outputted to the font memory.

The modified ASCII character code in the D register and the scan line count number from PROM 3270 are entered into the H register along with control code bits NDCONT1, NDCONT2 and NDCONT3. The contents of the H register are outputted as an address code to the font memory. Each of the PROM's in the font memory is programmed with dot patterns that correspond to particular scan lines of particular characters. The modified ASCII character code is used as a straight address for the font memory PROM's; however, the HTE data representing the scan line count portion of the PROM address is applied to the font enable decode logic in FIG. 30.

Depending upon the particular combination of modified ASCII code and scan line count, particular ones of the paired font memory PROM's in FIG. 29 are enabled to output a particular bit pattern on the NF lines. The data bits outputted from the font memory are routed over the NF lines to the video output register as nine parallel bits. The nine bits of parallel data are transformed into a serial bit stream shifted out to the CRT display. Shifting is at an effective 57.772 MHz rate as previously explained in Section E.

The display processor shown in the schematic diagrams of the several figures and described in detail provides a full-page alphanumeric display that emulates a typewritten page visually and functionally. Accordingly, the display processor is readily suited for use in word processing applications to provide a "soft" display of text that is edited by an operator.

The foregoing description has been of a particular preferred embodiment for purposes of explanation and illustration. It will be apparent, however, to those skilled in this art that many modifications and changes in the apparatus may be made without departing from the scope and spirit of the invention. It is the intention in the following claims to cover all such equivalent modifications as fall within the scope of the invention.

What is claimed is:

1. A display processor for producing video display data to form video images of dot matrix text characters in a format that emulates a typewritten page of text, which comprises:

a display refresh memory for storing text character codes and text manipulative codes, said refresh memory including a plurality of random access memories arranged to store a number of eight-bit data words;

logic means for coordinating the addressing of said random access memories;

programmable read-only memories for modifying text character codes read out of said refresh memory and designating text manipulative codes read out of said refresh memory;

a high-speed text buffer for storing modified text character codes and text manipulative codes from said programmable read-only memories;

control means for operating said text buffer such that data is written into the text buffer during the first half of a character time, and data is read out during the last half of the character time;

a character generator for receiving text character codes and text manipulated codes read out of the display refresh memory and providing coded data words representative of portions of dot matrices for the coded text characters;

a video output register connected to the character generator for transforming the coded data words into serial data to be outputted in real time for display; and microprogrammed control logic operating on a repeating cycle of specified instruction steps for writing text character codes and text manipulative codes into the display refresh memory and reading the same out of the display refresh memory, and for generating output signals to coordinate the display of the serial data from the video output register.

2. The display processor of claim 1 wherein said control logic comprises:

instruction generator means having microprogram instructions stored therein;

means for storing data required during execution of the microprogram instructions; and mircroprogram instruction decode means connected to said instruction generator means for deriving a set of control signals decoded from the microprogram instructions.

3. The display processor of claim 2 wherein said instruction generator means comprises:

a first read-only memory providing an instruction code to initiate the performance of specified functions;

a second read-only memory providing an address code for said data storage means; and means for addressing said first and second read-only memories to select one of the microcoded instructions and one of the address codes.

4. The display processor or claim 1 wherein said character generator includes a font memory having dot matrix patterns of text characters that is addressable by a text character code and a display scan line count code.

5. The display processor of claim 4 wherein said character generator further includes:

scan line count means for providing a scan line count code indicative of the number of scan line traces within a given line of text character video images; and programmable read-only memory means for altering the scan line count code in response to a text manipulative code indicating that particular text characters in the line of text characters are to be vertically shifted with respect to the other characters to form a subscript or a superscript notation for another of the text line characters with an output from said memory means being applied to the input of said character generator.

6. The display processor of claim 1 wherein said video output register comprises:

first and second shift registers each clocked by the same clock signal, said first and second registers being simultaneously loaded with video data bits outputted from said character generator;

means for delaying the output signal from one of said shift registers for a period of time; and means for multiplexing the delayed shift register output signal and the non-delayed shift register output signal into one output signal constituting a serial bit stream of the video data bits at a rate greater than the clock signal clocking said first and second shift registers.

* * * * *